United States Patent [19]

Takeda et al.

[11] 4,328,732

[45] May 11, 1982

[54] ELECTRONIC MUSICAL INSTRUMENT CAPABLE OF FILL-NOTE GENERATION

[75] Inventors: Toshio Takeda; Takehisa Amano; Sigeki Isii; Seiya Hamada, all of Hamamatsu, Japan

[73] Assignee: Nippon Gakki Seizo Kabushiki Kaisha, Hamamatsu, Japan

[21] Appl. No.: 193,605

[22] Filed: Oct. 3, 1980

[30] Foreign Application Priority Data

Oct. 9, 1979 [JP] Japan ..... 54-130254

[51] Int. Cl.[3] ..... G10H 1/36; G10H 5/00

[52] U.S. Cl. ..... 84/1.17; 84/1.03; 84/DIG. 2; 84/DIG. 22

[58] Field of Search ..... 84/1.01, 1.03, 1.11, 84/1.12, 1.17, 1.19, 1.21, 1.24, DIG. 2, DIG. 22

[56] References Cited

U.S. PATENT DOCUMENTS

| | | | |
|---|---|---|---|
| 3,745,225 | 7/1973 | Hall | 84/1.03 |
| 3,823,246 | 7/1974 | Hebeisen et al. | 84/1.17 |
| 3,844,379 | 10/1974 | Tomisawa et al. | 84/1.01 |
| 3,871,262 | 3/1975 | Robinson et al. | 84/1.17 |
| 3,929,051 | 12/1975 | Moore | 84/1.17 |
| 3,990,339 | 11/1976 | Robinson et al. | 84/1.17 |
| 4,112,802 | 9/1978 | Robinson et al. | 84/1.01 |
| 4,192,211 | 3/1980 | Yamaga et al. | 84/1.01 |
| 4,208,939 | 6/1980 | Wangard et al. | 84/1.17 |
| 4,228,712 | 10/1980 | Uchiyama et al. | 84/1.01 |

*Primary Examiner*—S. J. Witkowski

*Attorney, Agent, or Firm*—Spensley, Horn, Jubas & Lubitz

[57] ABSTRACT

A polyphonic, keyboard-type electronic musical instrument capable of automatic production, in response to key depressions on upper and lower keyboards, of "fill notes" which bear the same note names as the depressed lower keys but which, preferably, fall within an octave below the lowest pressed upper key at every moment. The instrument is of the type wherein each depressed key is coded into key data in accordance with a binary "key code" composed of a note code and an octave code. The note code identifies the note name of each key, whereas the octave code identifies the octave to which the key belongs. Upon depression of a key on each of the upper and lower keyboards, the note-coded data derived from the key date representative of the depressed lower key are combined with the octave-coded data derived from the key data representative of the depressed upper key if the note name of the depressed lower key is below that of the depressed upper key. If the depressed lower key is of a note name above that of the depressed upper key, on the other hand, then the note-coded data of the depressed lower key are combined with octave-coded data indicative of an octave just below that of the depressed upper key. The key-coded fill-note data thus formed are fed into a multichannel tone generator circuit, along with the key data representative of the depressed upper and lower keys.

20 Claims, 21 Drawing Figures

ELECTRONIC MUSICAL INSTRUMENT CAPABLE OF FILL-NOTE GENERATION

BACKGROUND OF THE INVENTION

This invention relates to electronic musical instruments, and in particular to those of the keyboard type as exemplified by an electronic organ. The invention deals more specifically with such an instrument capable of automatically generating or synthesizing notes that bear the same names as those of keys played on one keyboard or key group but which are in closer octaval correlation (octave region) with the notes of keys played simultaneously on another keyboard or key group.

The above automatically generated notes are referred to as "fill notes", and tones corresponding thereto are termed "fill tones", since they supplement, in a sense, the notes played on the second mentioned keyboard or key group.

For a better understanding of such fill notes or fill tones, there may be considered a usual electronic musical instrument having upper and lower keyboards or manuals by way of example. As the performer plays melodies on the upper keyboard and accompaniment chords on the lower keyboard, the fill tones sounded automatically will be of the same note names as the chordally related tones played on the lower keyboard but will be more intimately associated octavely (in the near octave region) with the melody tones played on the upper keyboard.

D. R. Moore U.S. Pat. No. 3,929,051, entitled "Multiplex Harmony Generator" and dated Dec. 30, 1975, describes and claims such an instrument capable of fill-note generation. For the production of chord tones octavely correlated with melodies, the instrument according to this U.S. patent relies on data identifying the chordally related notes to be sounded as fill tones in terms of timewise location of the pulses. A brief discussion of the D. R. Moore U.S. patent follows in order to better distinguish the present invention therefrom.

In the prior patented instrument the key switches of the upper keyboard are scanned one after another in the order of the key arrangement (alignment) on the keyboard. During each scanning cycle of the upper key switches, the key switches of the lower keyboard are repeatedly scanned only as to the 12 note names (C through B) in all octaves commonly (simultaneously). Upon depression of any key a pulse is generated at the corresponding one of successive positions in time referred to as the time slots. The time slot corresponding to the highest or representative one of the upper keys played together (depressed concurrently) is followed by a time interval equivalent to one octave, into which there are inserted the pulses indicative of the note names of the depressed lower keys. Thus the chord notes played on the lower keyboard are transformed into fill notes falling within an octave below the highest melody note played on the upper keyboard.

SUMMARY OF THE INVENTION

The present invention aims at the provision of a novel fill-note generation system as incorporated in an electronic musical instrument of the type wherein individual keys to be sounded are coded into key data in accordance with what is herein termed a key code. The key code is, in fact, a combination of at least a note code and an octave code. The note code identifies the twelve note names in an octave, whereas the octave code indicates that one of the octaves which embraces the key to be sounded. Thus composed of note-coded data and octave-coded data, the key-coded key data are time-divisionally generated in response to key depression on at least a first keyboard or key group (e.g., an upper keyboard or a right half range of a single keyboard) and a second keyboard or key group (e.g., a lower keyboard or a left half range of a single keyboard).

For the creation of desired fill-note data in accordance with the invention, the note-coded data are derived from the key data representative of the keys of the second keyboard or key group. To the note-coded data of the second keyboard are added octave-coded data having a predetermined octaval relation with the octave-coded data included in the key data representative of the keys of the first keyboard or key group. There are thus obtained the key-coded fill-note data, for translation into fill tones by tone generator means.

In some preferable embodiments of the invention disclosed herein, the instrument further comprises means for detecting the lowest-note one from among a plurality of sets of key data corresponding to keys played together on the upper keyboard. The note-coded data in the key data representative of each depressed key of the lower keyboard are combined with the octave-coded data derived directly from the key data indicative of the lowest of the keys played together on the upper keyboard if the note name of the depressed lower key is below that of the lowest depressed upper key. On the other hand, if the depressed lower key is of a note name above that of the lowest depressed upper key, the note-coded data of the depressed lower key are combined with octave-coded data indicative of an octave just below that of the lowest depressed upper key. The key-coded fill-note data synthesized as above represent fill notes that invariably lie within an octave below the lowest depressed upper key at every moment.

Let it be assumed that melodies are played on the upper keyboard, and accompaniment chords on the lower keyboard, of this instrument. Then the instrument will produce fill tones that are of the same note names as the chordally related tones played on the lower keyboard but which are closer octavely to the melody tones, thereby embellishing the melody tones and enriching the harmonies.

According to a further feature of the invention, means are provided for inhibiting the production of certain undesired fill tones that are too close in pitch to the tones being generated from the upper keyboard. Such undesired fill notes may, for example, be either the same as, or a semi- or a whole-tone apart from the upper key notes. These undesired fill notes, if sounded at all, would make the tones of the depressed upper keys vague and indistinct.

It is to be understood that the invention permits the generation of fill notes not only from the notes of the upper and lower keyboards but also from those of other keyboards available. Further the fill notes may be created from a single keyboard, by dividing same into separate key groups (ranges).

For tone production through sounding channels less in number than all the keys provided to the instrument, circuitry is employed for channeling or assigning the key data representative of the depressed keys to appropriate ones of the sounding channels. The circuitry for the production of the key-coded fill-note data in accordance with the invention can be disposed either downstream (succeeding stage) or upstream (preceding stage) of the channeling circuitry. Both alternatives are embodied in the preferred forms of the instrument presented subsequently.

The above and other features and advantages of this invention and the manner of attaining them will become more apparent, and the invention itself will best be understood, from the following description of the preferred embodiments taken in connection with the attached drawings.

DESCRIPTION OF THE PREFERRED EMBODIMENTS

General

Figure 1:
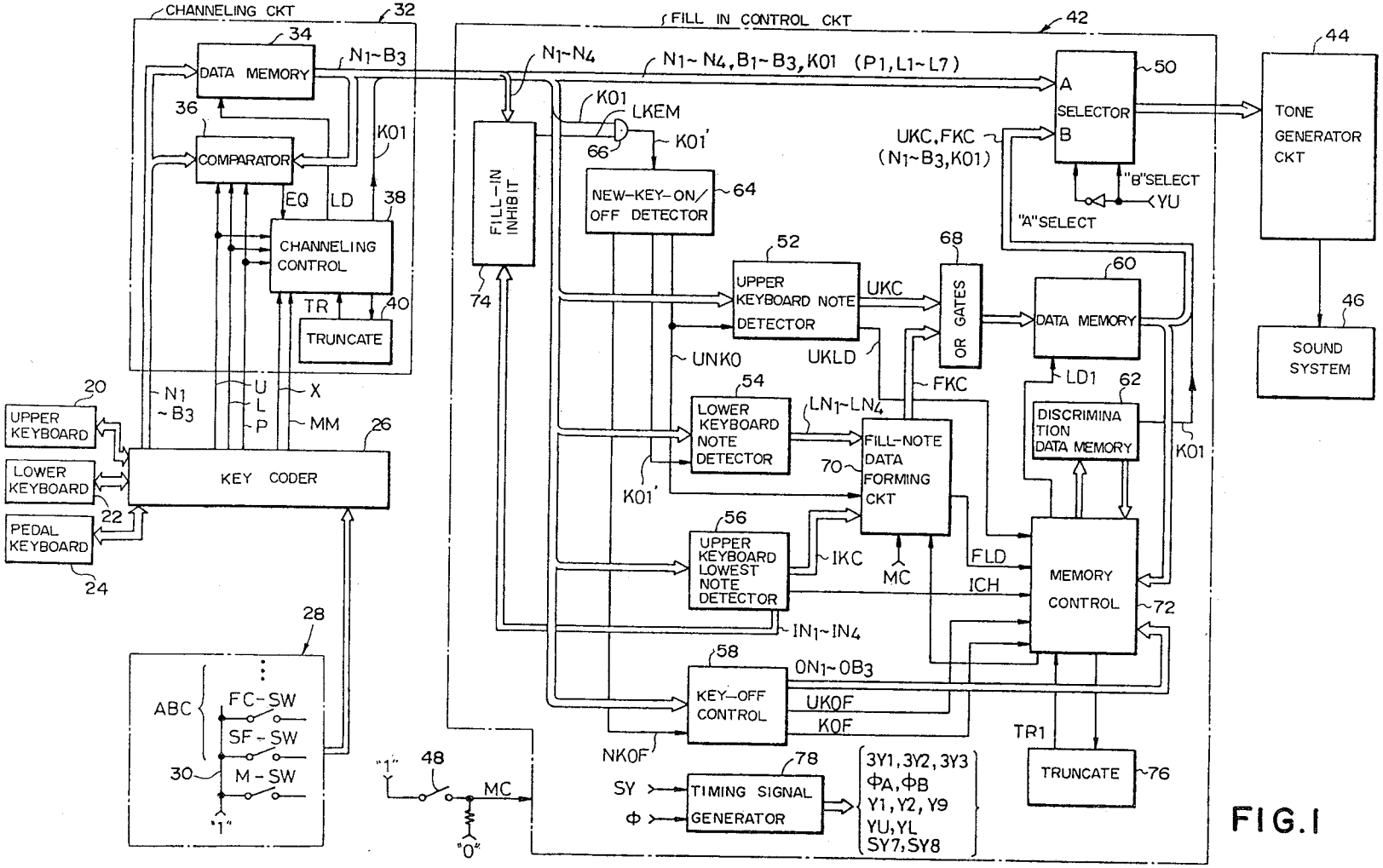
FIG. 1 is a block diagram of a preferred form of the electronic musical instrument capable of fill-note generation in accordance with the invention.

The present invention will now be described in detail as adapted specifically for a polyphonic, three-keyboard electronic musical instrument. With reference first to FIG. 1, which illustrates the general organization of the exemplified instrument, there are shown an upper keyboard or manual 20, a lower keyboard or manual 22, and a pedal keyboard or clavier 24. Operatively associated with the three keyboards 20, 22 and 24 is a key coder 26 which, in response to the depressing of keys on the keyboards, generates and time-divisionally puts out information N1–B3 (seven digits) representing the depressed keys in terms of a binary "key code". Such key-coded output information of the key coder 26 is herein termed "key data" and will be discussed in further detail subsequently.

Generally designated 28 is a set of selector switches for actuation by the performer. When actuated these switches condition the instrument for a variety of built-in modes of performance notably including automatic bass and chord accompaniments (AUTO BASS/-CHORD or, for short, ABC). FIG. 1 shows, by way of a few representative ones of such selector switches, a FINGERED CHORD switch FC-SW, a SINGLE FINGER switch SF-SW, and a MEMORY switch M-SW. The FINGERED CHORD and SINGLE FINGER represent two different modes of AUTO BASS/-CHORD performance, as is well known in the art. All these selector switches are to be closed against a member 30 carrying a binary ONE signal thereon.

The key coder 26 is also equipped to respond to the actuation of the selector switches 28, putting out signals indicative of the conditions of these switches. It is further assumed that the key coder 26 incorporates circuitry for processing signals used for AUTO BASS/-CHORD performance. Thus, when the instrument is conditioned for AUTO BASS/CHORD performance by actuation of any of the ABC switches, the key coder 26 generates the key data N1-B3 for automatic bass and chord accompaniments in response to the playing of keys.

In practice the key coder 26 with such functional features can be of the configuration disclosed in N. Tomisawa U.S. Pat. No. 4,148,017 entitled "Device for Detecting a Key Switch Operation" and dated Apr. 3, 1979, or in Y. Uchiyama et al. U.S. patent application Ser. No. 940,381 entitled "Key Code Data Generator" and filed on Sept. 7, 1978, now U.S. Pat. No. 4,228,712 issued Oct. 21, 1980, both assigned to the assignee of the instant application.

The key coder 26 of such configuration identifies the individual keys of the keyboards 20, 22 and 24 not in terms of timewise positions of pulses but of the binary-coded key data N1-B3 (plural bits). As has been mentioned, the key coder 26 time-divisionally puts out those key data which respectively indicate only the keys played on the three keyboards, as well as the data generated automatically for AUTO BASS/CHORD performance. The length of time during which the key coder 26 produces each set of key data may be, say, 48 microseconds (μs).

The key code for use with the illustrated instrument resolves itself into a four-bit note code (with bits N1, N2, N3 and N4) and a three-bit octave code (with bits B1, B2 and B3). Each set of key-coded key data N1-B3 is, therefore, of seven-bit format. The note code identifies the note name of each depressed key, whereas the octave code represents the octave to which the note of the depressed key belongs. Table 1 below gives an example of the note code.

TABLE 1

| Note Name | Note Code N4 | N3 | N2 | N1 | Equivalent Decimal Notation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1 | 1 | 15 |

The following Table 2 lists an example of the octave code.

TABLE 2

| Octave Code B3 | B2 | B1 | Octaves: Upper Keyboard | Lower Keyboard | Pedal Keyboard |
|---|---|---|---|---|---|
| 0 | 0 | 0 | C3 | C2 | C2 |
| 0 | 0 | 1 | C3#-C4 | C2#-C3 | C2#-C3 |
| 0 | 1 | 0 | C4#-C5 | C3#-C4 | C3#-C4 |
| 0 | 1 | 1 | C5#-C6 | C4#-C5 | .... |
| 1 | 0 | 0 | C6#-C7 | C5#-C6 | .... |

In synchronism with the production of each set of key data N1-B3, the key coder 26 puts out a keyboard signal U, L or P representative of that one of the three keyboards 20, 22 and 24 to which the depressed key belongs. The keyboard signal U denotes the upper keyboard 20; the keyboard signal L denotes the lower keyboard 22; and the keyboard signal P denotes the pedal keyboard 24. The pulse duration of each keyboard signal is also 48 μs.

As long as the performer holds any key depressed, the key coder 26 repeatedly generates the corresponding set of key data, as well as the corresponding keyboard pulses U, L or P, at preassigned time intervals (time slots). Such repeated production of the key data and keyboard pulses terminates when the key is released. In order to ascertain the release of the key, the key coder 26 puts out a regular succession of key-off check pulses X. The duration of each key-off check pulse X is 48 μs, as is the duration of each set of key data and each keyboard pulse generated by the key coder 26. The spacings between the successive key-off check pulses are, say, five milliseconds (ms). This is a relatively long time for digital systems in general but is too short for human perception. When some key is being depressed, the key coder 26 repeatedly produces the corresponding set of key data and associated keyboard pulses only during the spacings between the key-off check pulses. Thus, upon release of the key, a channeling circuit 32 senses the fact from the non-reception of the key data during the spacing between two consecutive key-off check pulses.

The key coder 26 further produces a memory signal MM upon actuation of the MEMORY switch M-SW by the player. The memory signal MM indicates that the data of the depressed keys be stored and used for tone production even after the release of the keys.

It has been mentioned that the closure of the SINGLE FINGER switch SF-SW conditions this instrument for AUTO BASS/CHORD performance in the SINGLE FINGER mode. Then, as the player selects the root note of a chord by depressing a single key on the lower keyboard 22 and further specifies a desired type of chord (i.e., major triad, minor triad or dominant seventh) by depressing the "white" or "black" key of the pedal keyboard 24, the key coder 26 automatically generates key-coded data representative of notes subordinate to the selected root (e.g., the third and fifth from the root) to constitute a chord. The key coder 26 puts out the data indicative of such chordally related notes along with the lower keyboard signal L. That is to say that the chords to be sounded in the AUTO BASS/CHORD performance are processed as the notes of the lower keyboard 22.

The channeling circuit 32 receives the various outputs from the key coder 26. This instrument is capable of sounding a plurality of notes simultaneously, by allotting such notes to different sounding channels. It is the role of the channeling circuit 32 to assign respective incoming sets of key data to respective available ones of the sounding channels, or to respective ones of recurrent series of time slots (time-divisional channels) constituting the sounding channels, as will become better understood as the description progresses.

The total number of the sounding channels is, say, 16, consisting of seven for the notes of the upper keyboard 20, another seven for the notes of the lower keyboard 22, one for the notes of the pedal keyboard 24, plus a spare one not used for tone production in this embodiment. The channeling circuit 32 assigns each incoming set of key data to either of such divisions of the sounding channels as dictated by either of the three keyboard signals U, L and P supplied simultaneously.

Included in the channeling circuit 32 is a key data memory 34 coupled directly to the key coder 26. The key data memory 34 has 16 storage locations corresponding to the respective sounding channels, for storing the channeled key data in the corresponding storage locations.

The channeling circuit 32 also includes a comparator 36 connected to receive the key data from the key coder 26 and the channeled key data from the key data memory 34, as well as the keyboard signals U, L and P from the key coder. The comparator 36 effects comparison between the key data from the key coder and the channeled key data from the key data memory. Upon agreement thereof the comparator 36 puts out a coincidence signal EQ, provided that both input data belong to the same keyboard (as ascertained from the keyboard signals U, L and P).

Further included in the channeling circuit 32 is a channeling control circuit 38 to which are inputted the keyboard signals U, L and P, key-off check signal X, and memory signal MM from the key coder 26, and the coincidence signal EQ from the comparator 36. On confirmation of the fact that each set of key data put out by the key coder 26 represents a note not yet channeled (assigned to the channel), the channeling control circuit 38 assigns the key data set to some sounding channel devoted to the keyboard to which the note belongs. To this end the channeling control circuit 38 delivers to the key data memory 34 a load signal LD indicative of the channel to which the key data set is to be assigned.

Another function of the channeling control circuit 38 is the production of a key-on signal KO1 indicative of whether the key whose data set has been channeled as above is being depressed or not. The key-on signal KO1 assumes a binary ONE state during the depression of the key and becomes ZERO when the channeling control circuit 38 detects the release of the key with the aid of the key-off check signal X from the key coder 26. However, if the memory signal MM from the key coder 26 is ONE, the key-on signal KO1 corresponding to the key data that have been assigned to the lower keyboard channels remains ONE even after the release of the keys. Such key data are therefore processed just as if the corresponding lower keys were held depressed.

The channeling control circuit 38 is associated with a truncate circuit 40 which functions to detect the sounding channel to which has been assigned the note of the earliest released key. On detection of such a channel the truncate circuit 40 puts out a channel truncate signal TR which suggests the channel to be truncated. The channeling control circuit 38 makes use of the channel truncate signal TR in channeling the key data issuing from the key coder 26.

For further details about the configuration and operation of the channeling circuit 32, reference is directed to E. Yamaga et al. U.S. Pat. No. 4,192,211, "Electronic Musical Instrument", dated Mar. 11, 1980, and assigned to the assignee of the present application. This patent discloses a similar circuit.

Connected downstream (i.e. to the succeeding stage) of the channeling circuit 32 is a fill-in control circuit generally labeled 42 and shown enclosed in a dot-and-dash line. The channeling circuit 32 time-divisionally delivers the channeled key data N1-B3 and the key-on signal KO1 to the fill-in control circuit 42. Prior to the discussion of the fill-in control circuit 42, the manner of time-divisional delivery of the channeled key data and key-on signal by the channeling circuit 32 will be explained in conjunction with the chart of FIG. 2.

Figure 2:
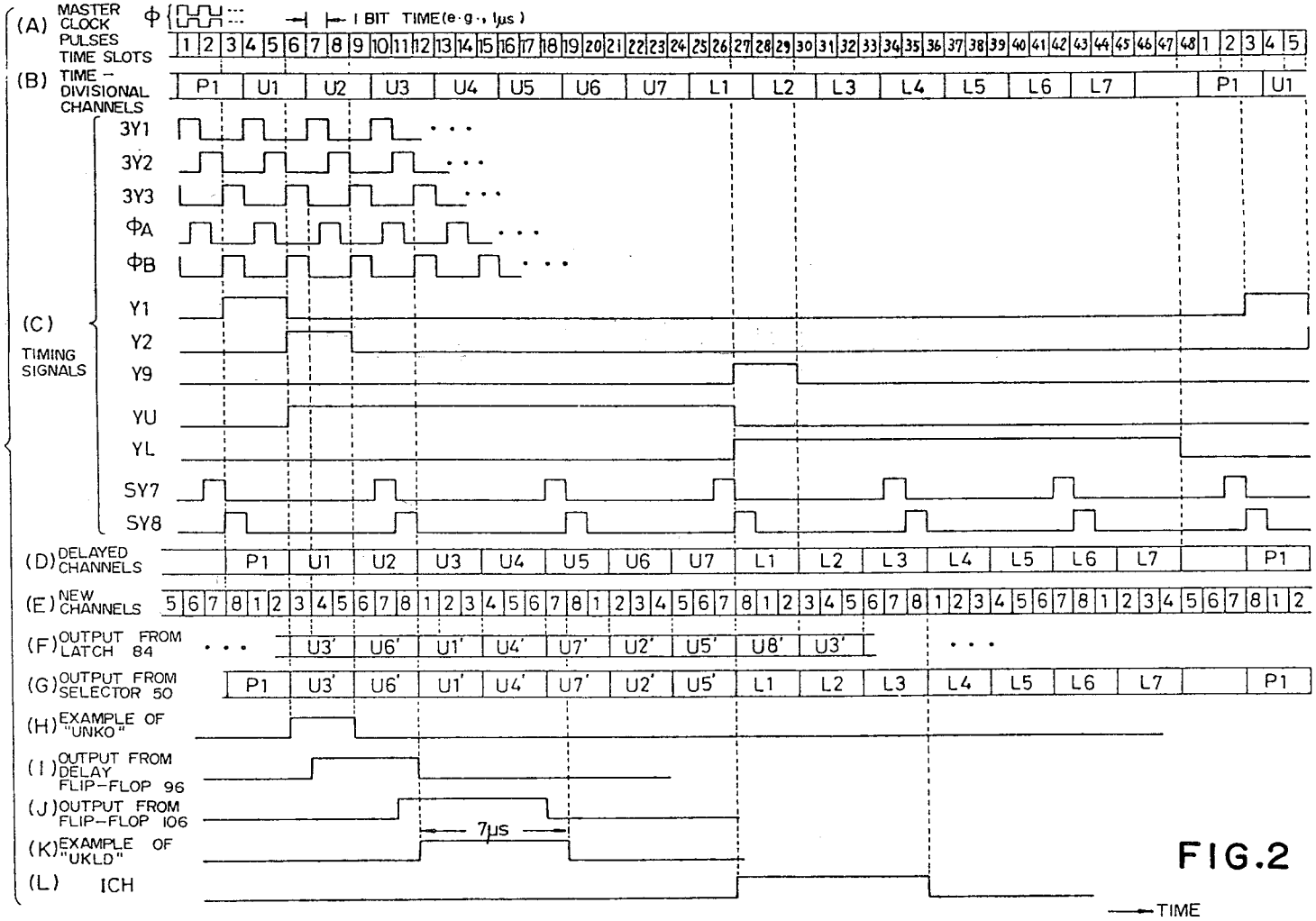
FIG. 2 is a chart of waveforms and time-divisional channels, (A) through (L), useful in explaining the operation of the instrument of FIG. 1.

At (A) in FIG. 2 are shown successive "time slots" based on a dual train of master clock pulses $\phi$. Each cycle (equal to one time slot) of the master clock pulses $\phi$ is set to be 1 $\mu$s. It takes 48 time slots for the channeling circuit 32 to put out the key data N1-B3 allotted to all the sounding channels available and the associated key-on signals KO1.

At (B) in FIG. 2, P1 indicates the time-divisional channel at which the channeling circuit 32 puts out the information (meaning both key data and key-on signal) assigned to the single sounding channel for the pedal keyboard 24. U1 through U7 indicate respective ones of the recurrent series of the time-divisional channels at which the channeling circuit 32 puts out the information assigned to the seven sounding channels for the upper keyboard 20. L1 through L7 designate respective ones of the recurrent series of the time-divisional channels at which the channeling circuit 32 puts out the information assigned to the seven sounding channels for the lower keyboard 22. Each of these time-divisional channels P1, U1 through U7, and L1 through L7 has a length of three time slots, i.e., 3 $\mu$s.

With reference back to FIG. 1 the fill-in control circuit 42 functions, as the performer plays on both upper 20 and lower 22 keyboards, to alter the octave-coded data included in the key data representative of the depressed lower keys and hence to create key-coded data indicative of notes more closely correlated with the notes of the depressed upper keys. The newly created data are assigned to the channels for the upper keyboard along with the key data representative of the depressed upper keys.

The fill-in control circuit 42 delivers its output to a multichannel tone generator circuit 44 and thence to a sounding system 46. Thus the newly created data from the fill-in control circuit 42, as well as the key data on the depressed upper, lower, and pedal keys that have journeyed therethrough, are translated into tone signals through the preassigned sounding channels in the tone generator circuit 44 and then emanated into the air as audible sounds by the sounding system 46.

The notes represented by the data newly synthesized in the fill-in control circuit 42 are sounded with the same tone color as the notes of the upper keyboard 20. Such newly synthesized notes are herein referred to as the "fill notes" or "fill tones", as the case may be, since they automatically supplement the tones generated in the normal way by playing on the upper keyboard. The new data created in the fill-in control circuit 42 are, therefore, hereinafter referred to as the fill-note data. It should be noted that such fill-note data represent fill notes in terms of the key code of Tables 1 and 2.

The fill-in control circuit 42 is shown provided with a fill-in selector switch 48. The closure of this selector switch 48, resulting in the production of a binary ONE fill-in control signal MC, conditions the fill-in control circuit 42 for the production of the key-coded fill-note data. When opened as shown, the selector switch 48 deprives the circuit 42 of its fill-in function.

In the fill-in control circuit 42 the channeled key data N1-B3 and key-on signal KO1 from the channeling circuit 32 enter a selector 50, an upper keyboard note detector circuit 52, a lower keyboard note detector circuit 54, an upper keyboard lowest note detector circuit 56, and a key-off control circuit 58.

The selector 50 has two inputs A and B. When actuated to select its input A, the selector 50 permits the passage therethrough of the key data N1-B3 that have been assigned to the lower and pedal keyboard channels P1 and L1 through L7, as well as the key-on signal KO1 accompanying such key data. The output from the selector 50 enters the tone generator circuit 44. Delivered to the other input B of the selector 50 are the key data representative of the depressed upper keys (hereinafter referred to as the upper-key data and designated UKC), the aforesaid fill-note data FKC, and the key-on signal KO1 associated with such data. The selector 50 receives these inputs from a data memory 60 and a discrimination data memory 62, both included in the fill-in control circuit 42. The input information UKC, FKC and KO1 to the selector 50 is allowed to pass therethrough on to the tone generator circuit 44 during the recurrent series of the seven time-divisional channels U1 through U7, (B) in FIG. 2, for the upper keyboard 20.

The channeling circuit 32 also feeds the key-on signal KO1 into a new-key-on/off detector circuit 64 via an AND gate 66 yet to be described. The function of this detector circuit 64 is the detection, from the key-on signal KO1, of the depression of each new upper key and of the release of each upper or lower key. The detector circuit 64 puts out a new-upper-key-on signal UNKO upon detection of the depression of each new upper key, and a new-key-off signal NKOF upon detection of the release of each upper or lower key.

On receipt of the new-upper-key-on signal UNKO from the new-key-on/off detector circuit 64, the upper keyboard note detector circuit 52 latches the channeled key data N1-B3 representative of the depressed upper keys. This circuit 52 reshapes the latched key data into those with a constant duration of, say, 7 $\mu$s and puts them out as the above defined upper-key data UKC. The upper-key data UKC travel via a network of OR gates 68 to the data memory 60 for storage therein, prior to delivery to the selector 50.

The upper keyboard lowest note detector circuit 56 detects the lowest-note one from among two or more sets of key data representative of the depressed upper keys, when such keys are played together, and stores and puts out the detected key data. The output from the detector circuit 56 is termed the lowest-depressed-upper-key data IKC. Another function of this detector circuit 56 is the detection of a change from one lowest pressed upper key to another. When such a change occurs, the detector circuit 56 produces a lowest-depressed-upper-key-change signal ICH.

The lower keyboard note detector circuit 54 successively selects, one upon lapse of each approximately constant length of time, the sets of key data N1-B3 assigned to the time-divisional channels L1 through L7, (B) in FIG. 2, for the lower keyboard 22. The circuit 54 stores and puts out only the note-coded data LN1–LN4 contained in the incoming lower-key data, for delivery to a fill-note data synthesizer circuit 70.

The fill-note data synthesizer circuit 70 receives not only the note-coded data LN1–LN4 indicative of the note names of the depressed lower keys but also the lowest-depressed-upper-key data IKC from the upper keyboard lowest note detector circuit 56. In order to provide fill notes within an octave below the lowest depressed upper key, the fill-note data forming circuit 70 combines the note-coded data LN1–LN4 with appropriate octave-coded data, thus forming the key-coded fill-note data FKC. The circuit 70 delivers the fill-note data FKC to the OR gates 68, and thence to the data memory 60, only during the receipt of the fill-in control signal MC of a binary ONE state, i.e., only during the closure of the fill-in selector switch 48. The data memory 60 stores the fill-note data FKC as dictated by a load signal LD1 from a memory control circuit 72.

Shown at 74 in FIG. 1, and also forming a part of the fill-in control circuit 42, is a fill-in inhibit circuit for inhibiting the production of fill notes that are either semi-tone or whole-tone below the note of the lowest depressed upper key at every moment. This circuit 74 has its inputs coupled to the channeling circuit 32 and to the upper keyboard lowest note detector circuit 56 for comparing the data supplied therefrom. From the channeling circuit 32 the fill-in inhibit circuit 74 receives the note-coded data N1–N4 included in those key data N1-B3 which represent the depressed lower keys. From the upper keyboard lowest note detector circuit 56, on the other hand, the fill-in inhibit circuit 74 takes in the note-coded data IN1–IN4 included in the lowest-depressed-upper-key data that have been stored therein.

The lower-key-enable signal LKEN put out by the fill-in inhibit circuit 74 becomes ZERO if the note-coded data N1–N4 represents a note name that is semi-tone or whole-tone below the note name represented by the note-coded data IN1–IN4. The lower-key-enable signal LKEN is ONE in all other cases.

Fed to the AND gate 66, the lower-key-enable signal LKEN controls the passage therethrough of the key-on signal KO1 from the channeling circuit 32 to the new-key-on/off detector circuit 64. The AND gate 66 allows the passage of the key-on signal KO1 therethrough, for application to the new-key-on/off detector circuit 64 as a key-on signal KO1′, when the lower-key-enable signal LKEN is ONE. When the signal LKEN is ZERO, on the other hand, the AND gate 66 blocks the key-on signal KO1 thereby making the key-on signal KO1′ ZERO.

The new-key-on/off detector circuit 64 delivers the incoming key-on signal KO1′ on to the lower keyboard note detector circuit 54. As the channeling circuit 32 feeds the key data N1-B3 representative of the pressed lower keys to the lower keyboard note detector circuit 54 during the lower keyboard channels L1 through L7, FIG. 2(B), the circuit 54 selectively stores only those sets of key data which are accompanied by the key-on signal KO1′ of a binary ONE state.

It has been mentioned that the key-on signal KO1′ is ZERO when the key data from the channeling circuit 32 represent the lower-key notes that are semi-tone or whole-tone below the note of the lowest depressed upper key. Consequently the lower keyboard note detector circuit 54 does not store the key data indicative of such depressed lower keys. It is thus seen that the fill-note data forming circuit 70 is prevented from the production of data representative of fill notes that are semi-tone or whole-tone below the note of the lowest depressed upper key at every moment.

The key-off control circuit 58 receives as aforesaid the channeled key data N1-B3 from the channeling circuit 32 and the new-key-off signal NKOF from the new-key-on/off detector circuit 64. From these inputs the key-off control circuit 58 stores those sets of key data which represent newly released upper and lower keys, and further delivers such key data ON1–OB3 to the memory control circuit 72. The key-off control circuit 58 also feeds a keyboard designation signal UKOF and a key-off signal KOF to the memory control circuit 72. The keyboard designation signal UKOF indicates whether the released keys, as represented by the data ON1–OB3, belong to the upper keyboard 20 or to the lower keyboard 22. The key-off signal KOF when in a ONE state of a prescribed length denotes the release of the keys.

The data memory 60 comprises at least seven storage locations corresponding respectively to the seven tone processing channels for the upper keyboard. Receiving the key-coded upper-key data UKC from the upper keyboard note detector circuit 52, and the key-coded fill-note data FKC from the fill-note data forming circuit 70, via the OR gates 68, the data memory 60 stores such data in its storage locations corresponding to the pertinent tone processing channels. The load signal LD1 from the memory control circuit 72 controls the storage of the data UKC and FKC in the data memory 60.

One of the functions of the discrimination data memory 62 is to store information as to whether the keys represented by the data UKC and FKC stored in the data memory 60 are being depressed or have been released. If the keys are being depressed, then the discrimination data memory 62 memorizes data indicative of whether the data stored in the data memory 60 represent upper keys or fill notes.

The memory control circuit 72 is also associated with a truncate circuit 76, receiving a channel truncate signal TR1 therefrom. In response to this channel truncate signal, and to the other input signals from the various components of the fill-in control circuit 42, the memory control circuit 72 controls the storage and deletion of data in and from the data memory 60 and indication data memory 62.

Further included in the fill-in control circuit 42 is a timing signal generator 78 which receives the master clock pulses $\phi$ and synchronizing pulses SY in synchronism with the time slots given at (A) in FIG. 2. In conformity with these input pulses the timing signal generator 78 generates and puts out various timing signals 3Y1, 3Y2, 3Y3, $\phi$A, $\phi$B, Y1, Y2, Y9, YU, YL, SY7 and SY8, as depicted at (C) in FIG. 2. These timing signals control the operations of the various components of the fill-in control circuit 42, in a manner that will become apparent as the description proceeds.

Fill-in Control Circuit

Figure 3:
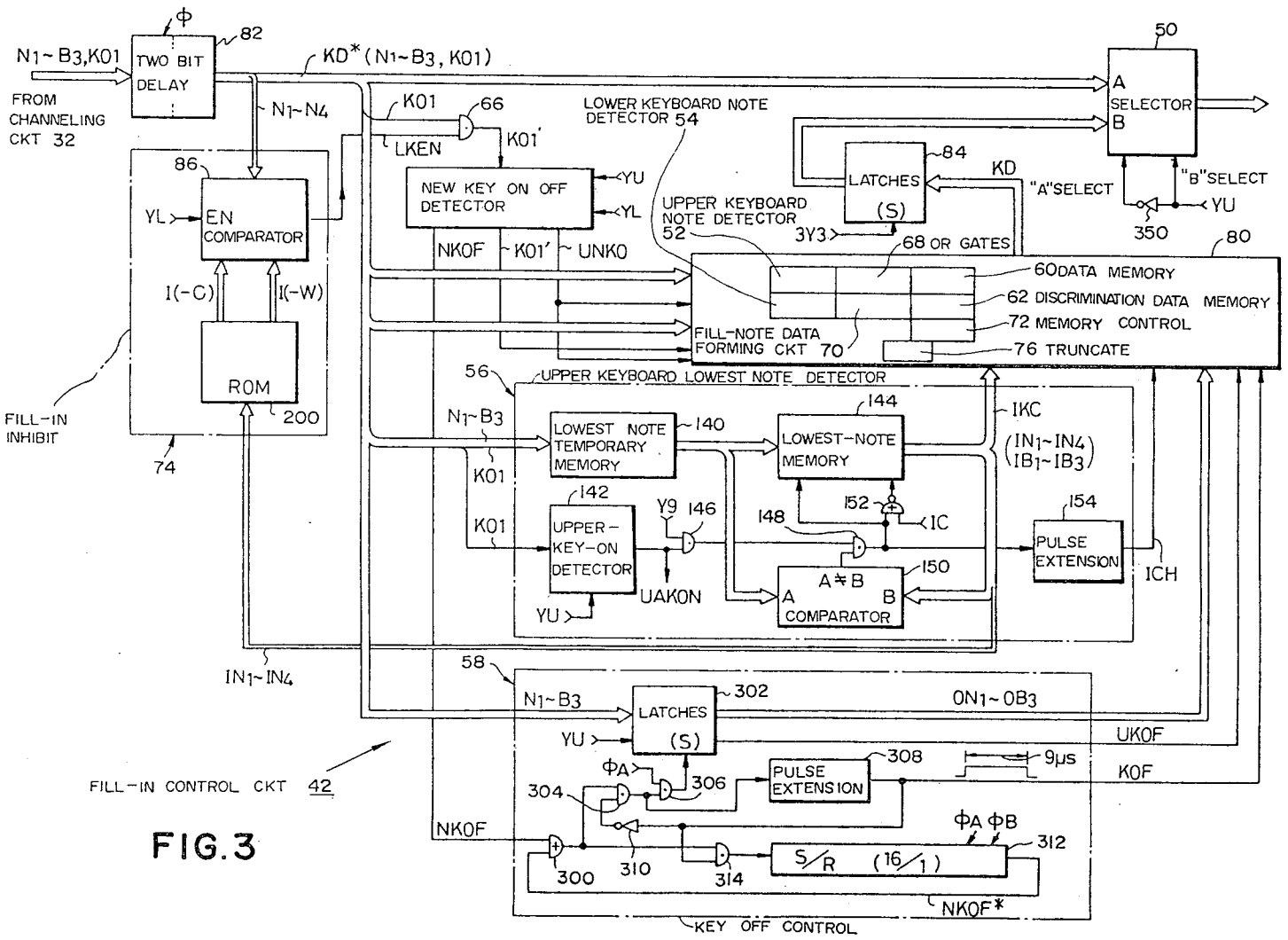
FIG. 3 is a block diagram showing in greater detail a portion of the fill-in control circuit in the instrument of FIG. 1.
Figure 4:
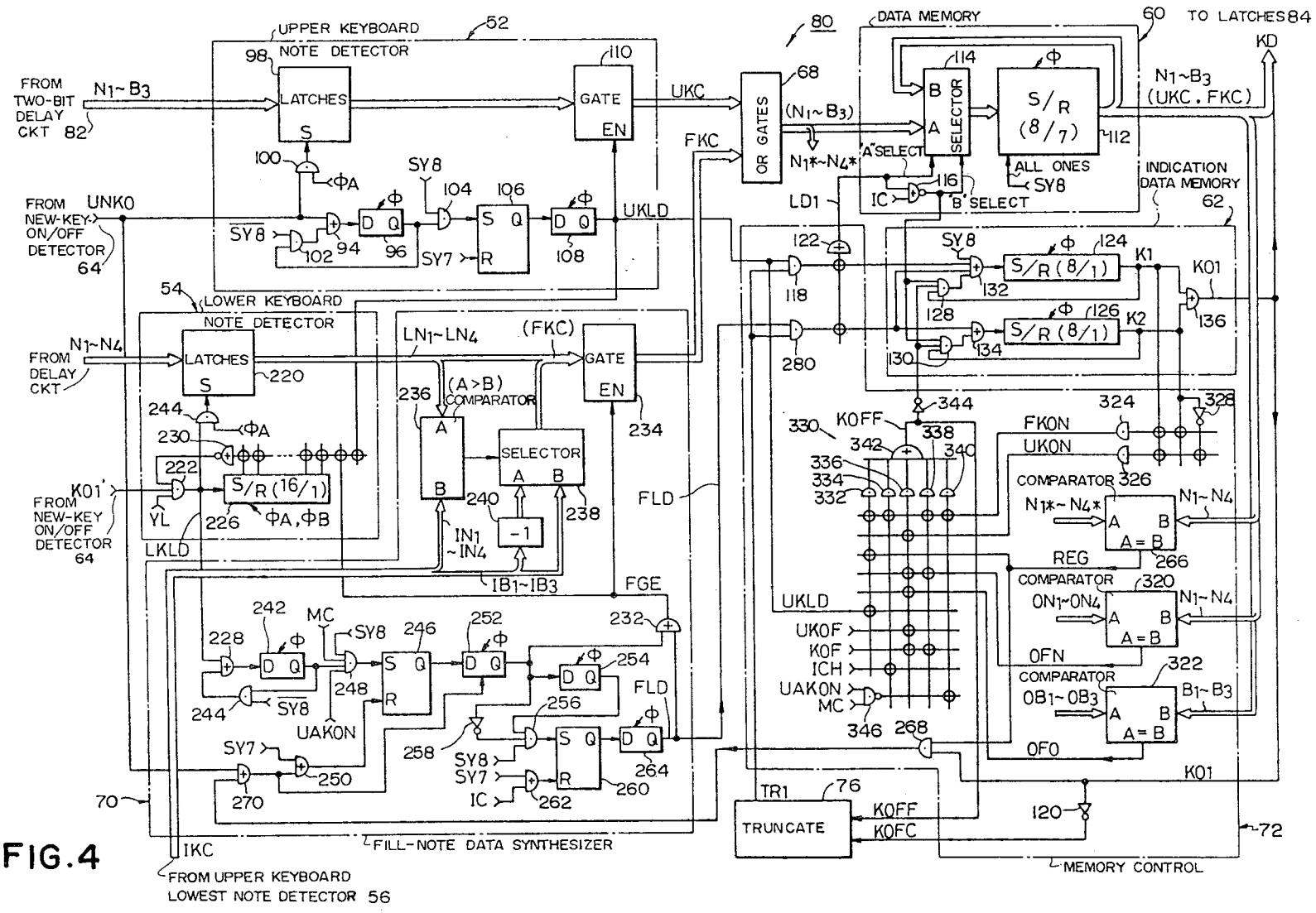
FIG. 4 is a partly block and partly schematic diagram showing in greater detail the remaining portion of the fill-in control circuit in the instrument of FIG. 1.

FIG. 3 is a more detailed representation of the fill-in control circuit 42. The block 80 in this figure comprises the upper keyboard note detector circuit 52, lower keyboard note detector circuit 54, data memory 60, discrimination data memory 62, OR gates 68, fill-note data forming circuit 70, memory control circuit 72, and truncate circuit 76. The details of these components in the block 80 are illustrated in FIG. 4.

With reference to FIG. 3 the fill-in control circuit 42 is shown to additionally include a two-bit delay circuit 82. Supplied from the channeling circuit 32, the channeled key data N1-B3 and the key-on signal KO1 first enter the two-bit delay circuit 82 and are thereby delayed by a two-bit time (i.e., two time slots or 2 $\mu$s). The delay circuit 82 delivers its delayed output KD* (consisting of the channeled key data N1-B3 and key-on signal KO1) to the input A of the selector 50, to the circuits 52 and 54 in the block 80, and to the upper keyboard lowest note detector circuit 56, key-off control circuit 58, and fill-in inhibit circuit 74.

At (D) in FIG. 2 are shown the recurrent series of time-divisional channels P1, U1 through U7 and L1 through L7 of the data KD* which have been delayed by the two-bit time. This two-bit-time delay is necessary because the application of the data KD* to the input A of the selector 50 must take place in predetermined time relation to the application, to its input B, of the upper-key data UKC and the fill-note data FKC from the data memory 60. These data UKC and FKC, by the way, are fed from the data memory 60 to the selector 50 via a latch circuit 84.

A comparison of (C) and (D) in FIG. 2 will reveal that each binary ONE state of the upper keyboard timing signal YU coincides with one of the recurrent series of delayed time-divisional channels U1 through U7 for the upper keyboard. Each ONE state of the lower keyboard timing signal YL, on the other hand, coincides with one of the recurrent series of delayed time-divisional channels L1 through L7 for the lower keyboard.

Upper Keyboard Data Processing

The following is the discussion of the way in which the fill-in control circuit 42 processes those of the key data N1-B3 which represent depressed upper keys. Let it be assumed that the delay circuit 82 is now producing, as its output data KD*, the key data N1-B3 assigned to the upper keyboard channels U1 through U7, as well as the associated key-on signal KO1. Then the timing signal generator 78, FIG. 1, delivers the upper keyboard timing signal YU of binary ONE, (C) in FIG. 2, to the selector 50 thereby causing same to select its input B. Applied to the other input A of the selector 50, the output data KD* from the delay circuit 82 are blocked from passage therethrough.

Further, during the production of the upper key data from the delay circuit 82, the timing signal generator 78 delivers the lower keyboard timing signal YL of binary ZERO to the enable input EN of a comparator circuit 86 in the fill-in inhibit circuit 74. The result is the production of the lower keyboard enable signal LKEN of binary ONE from the comparator circuit 86. Thus, during the production of the upper key data from the delay circuit 82 (U1 through U7 at (D) in FIG. 2), the AND gate 66 permits the passage therethrough of the key-on signal KO1 pertaining to the upper keys. The key-on signal that has passed the AND gate 66, now designated KO1', enters the new-key-on/off detector circuit 64.

Also fed to the new-key-on/off detector circuit 64 are the upper keyboard timing signal YU and the lower keyboard timing signal YL from the timing signal generator 78. The detector circuit 64 senses from the input signals KO1' and YU the depressing of each new key on the upper keyboard and puts out the new-upper-key-on signal UNKO. Such operation of the new-key-on/off detector circuit 64 will become better understood from the following description of FIG. 5.

Figure 5:
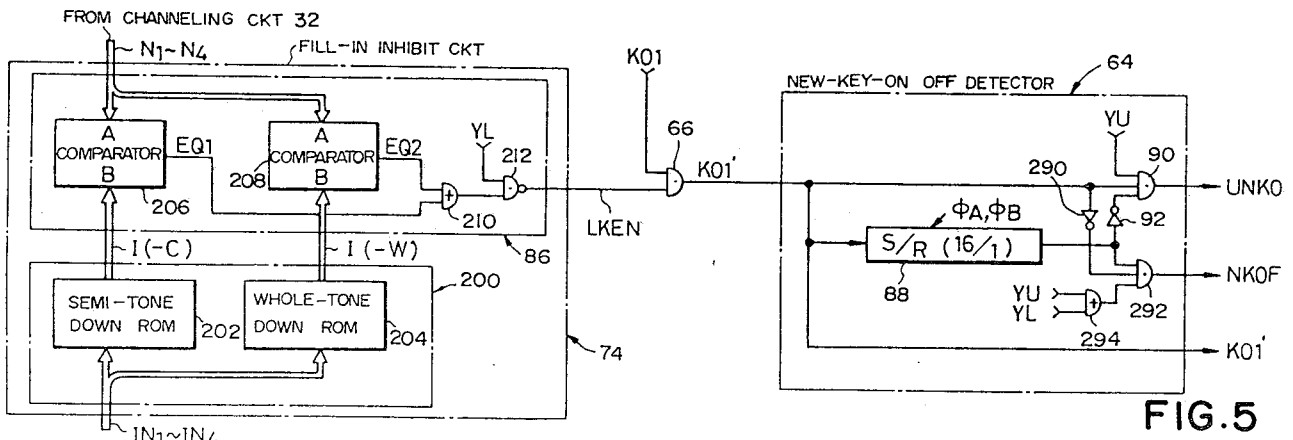
FIG. 5 is a partly block and partly schematic diagram showing in detail the fill-in inhibit circuit and new-key-on/off detector circuit of FIGS. 1 and 3.

FIG. 5 is an illustration, in partly block and partly schematic form, of a more detailed configuration of the new-key-on/off detector circuit 64 and of the fill-in inhibit circuit 74. The key-on signal KO1' from the AND gate 66 enters a 16-stage/one-bit shift register 88 and a three-input AND gate 90, both included in the new-key-on/off detector circuit 64. The two other inputs of the AND gate 90 receives the upper keyboard timing signal YU and, via an inverter 92, the output from the shift register 88.

The shift register 88 is under the shift control of the two-phase clock pulse trains $\phi$A and $\phi$B, (C) in FIG. 2, each having a cycle of a three-bit time or 3 $\mu$s (only the latter unit will be used throughout the rest of this specification). The shift register 88 puts out the input signal with a delay of 48 $\mu$s ($3\times16=48$). It will be recalled that the channeling circuit 32 repeats the production of the key data N1-B3, etc., with a cycle of 48 $\mu$s. Thus, when the shift register 88 takes in the key-on signal KO1' on a certain channel, the register simultaneously puts out a signal indicative of the binary state of the key-on signal KO1' on the same channel but during the immediately preceding cycle.

The shift register 88 produces a ZERO output if no key has been depressed. The inverter 92 inverts this ZERO input to a ONE and so enables the AND gate 90. Only when a key is newly depressed on the upper keyboard, therefore, the AND gate 90 produces a new-upper-key-on pulse UNKO having a duration of 3 $\mu$s, as shown by way of example at (H) in FIG. 2.

Fed into the upper keyboard note detector circuit 52 shown in detail in FIG. 4, the new-upper-key-on signal UNKO enters, on one hand, an OR gate 94 and thence a delay flip-flop 96 for storage therein. On the other hand the signal UNKO enters a latch circuit 98 through its strobe input S via an AND gate 100, as allowed by the pulse train $\phi$A. The latch circuit 98 also receives the key data N1-B3 included in the output KD* from the delay circuit 82, FIG. 3. Thus the key data representative of the newly depressed upper keys are latched in the latch circuit 98 as dictated by the new-upper-key-on signal UNKO.

The delay flip-flop 96, which is under the control of the dual phase master clock pulses $\phi$, has its output Q coupled to one of the two inputs of an AND gate 102 on one hand and, on the other hand, to one of the two inputs of another AND gate 104. The other input of the AND gate 102 is coupled to the timing signal generator 78, FIG. 1, via an inverter, not shown, for receiving the inverted one SY8 of the timing pulse train SY8 depicted at (C) in FIG. 2. The output of this AND gate 102 is connected back to the delay flip-flop 96 via the OR gate 94. The other input of the AND gate 104 is also coupled to the timing signal generator 78 for receiving the timing pulse train $\overline{SY8}$ therefrom. The timing pulses SY8 have a cycle of 8 $\mu$s, being timed to coincide with the time slots 3, 11, 19, . . . as in FIG. 2. The output of the AND gate 104 is coupled to the set input S of a set-reset flip-flop 106. The reset input R of this flip-flop 106 is coupled to the timing signal generator 78 for receiving the timing pulse train SY7 therefrom.

The delay flip-flop 96 is intended to store each pulse, or binary ONE state, of the new-upper-key-on signal UNKO until the occurrence of the subsequent timing pulse SY8. Upon generation of the subsequent timing pulse SY8 the new-upper-key-on pulse that has been stored in the delay flip-flop 96 is fed via the AND gate 104 to the flip-flop 106 thereby setting same.

The timing pulses SY7 applied to the reset input R of the flip-flop 106 are shown at (C) in FIG. 2. These pulses SY7 precede the respective timing pulses SY8 by just 1 $\mu$s and also have a cycle of 8 $\mu$s period. After being delayed 1 $\mu$s by a delay flip-flop 108 connected subsequently, the output from the flip-flop 106 is fed to the memory control circuit 72 as the upper keyboard load signal UKLD put out by the upper keyboard note detector circuit 52. The delayed output from the delay flip-flop 108 is also applied to the enable input EN of a gate 110 included in the upper keyboard note detector circuit 52.

As will be seen by referring again to FIG. 2, the timing pulse trains SY7 and SY8 are timed to coincide with the channels 7 and 8, respectively, of recurrent series of time-divisional upper-keyboard channels 1 through 8 newly created by the data memory 60 (channel 8 is not used). At (E) in FIG. 2, illustrates such recurrent series of new channels. The delay flip-flops 96 and 108 and flip-flop 106, included in the upper keyboard note detector circuit 52 of FIG. 4, function in combination to shape each new-upper-key-on pulse UNKO into the corresponding upper keyboard load pulse UKLD, FIG. 2(K), which coincides in time with the new upper keyboard channels 1 through 7.

Let it be assumed that the new-upper-key-on pulse UNKO, (H) in FIG. 2, has been generated which corresponds in time to the upper keyboard channel U1 formed by the channeling circuit 32 of FIG. 1. Then, as shown at (I) in FIG. 2, the output from the delay flip-flop 96 remains ONE until the decay of the next timing pulse SY8. The flip-flop 106 becomes set at the start of this timing pulse SY8 and reset at the start of the subsequent timing pulse SY7, as (J) in FIG. 2. The delay flip-flop 108 delays this output pulse of the flip-flop 106 by 1 $\mu$s. Thus, as given at (K) in FIG. 2, the upper keyboard load pulse UKLD is obtained which corresponds in time to the new upper keyboard channels 1 through 7, FIG. 2(E).

The latch circuit 98, FIG. 4, in the upper keyboard note detector circuit 52 has its output coupled to the gate 110. The latch circuit 98 latches the delayed key data N1-B3 representative of the depressed upper keys. The gate 110 permits the passage therethrough of the output from the latch circuit 98 during its reception of each upper keyboard load pulse UKLD, i.e., during the new time-divisional channels 1 through 7 of (E) in FIG. 2. The output from the gate 110 is applied as the upper-key data UKC to the data memory 60 via the OR gates 68.

The data memory 60 comprises an eight-stage/seven-bit shift register 112 and a selector 114. The shift register 112, under the control of the master clock pulses $\phi$, has eight stages corresponding to the new time-divisional channels 1 through 8 (hereinafter designated U1′ through U8′ for convenience). Each stage of this shift register is capable of storing a set of seven-bit key-coded data N1-B3.

Connected upstream of the shift register 112, the selector 114 has two inputs A and B. The input A receives from the OR gates 68 the upper-key data UKC, which represent newly depressed upper keys as aforesaid and which, therefore, must be assigned to appropriate ones of the new channels U1′ through U8′. The input B of the selector 114 receives the output from the final stage of the shift register 112. Upon receipt of each load pulse LD1 from the memory control circuit 32 the selector 114 selects its input A, thereby permitting the corresponding set of key data N1-B3 from the OR gates 68 to be stored in one stage of the shift register 112.

The load signal LD1 from the memory control circuit 32 is also impressed to one of the two inputs of a NOR gate 116. Applied to the other input of this NOR gate is an initial clear signal IC which assumes a binary ONE state for a preassigned brief length of time following the closure of the power switch, not shown, of this electronic musical instrument. Normally, therefore, the NOR gate 116 applies a ONE output to the selector 114 thereby causing same to select its input B. Thus the data memory 60 holds the data stored in the shift register 112. At the time of the closure of the unshown power switch the NOR gate 116 responds to the initial clear signal IC by inhibiting both inputs A and B of the selector 114, with the result that the shift register 112 becomes cleared.

The shift register 112 is further so configured that upon receipt of each timing pulse SY8 from the timing signal generator 78, binary ONE is set in all the bits of its first stage. As will be noted by referring back to (C) and (E) in FIG. 2, the timing pulses SY8 are timed to coincide with the successive new channels U8′, to which no data are assigned. Therefore, by causing the shift register 112 to store a binary "1-1-1-1-1-1-1" (a data set absent from the key code of Tables 1 and 2) in its stage corresponding to the new channel U8′, this channel is invalidated.

With reference further to FIG. 4 the upper keyboard note detector circuit 52 delivers the upper keyboard load signal UKLD, at (K) in FIG. 2, to one of the two inputs of an AND gate 118 included in the memory control circuit 72. The other input of this AND gate 118 receives the channel truncate signal TR1 from the truncate circuit 76.

Input to the truncate circuit 76 from the memory control circuit 72 are (1) a key-off indication signal KOFF indicative of any of the new channels U1' through U7' which should be emptied of the stored data because of the release of the key, and (2) a key-off signal KOFC (formed by inverting the key-on signal KO1 by an inverter 120) indicative of those of the new channels U1' through U7' which correspond to released keys. From these input signals KOFF and KOFC the truncate circuit 76 detects the new channel corresponding to the earliest released key. The channel truncate signal TR1 thus generated by the truncate circuit 76 indicates the successive new channels to which the key data N1-B3 should be assigned as such data are fed from the OR gates 68 to the data memory 60. The truncate circuit 76 can be of any known or suitable configuration. The output from the AND gate 118 is fed via an OR gate 122 to the selector 114 in the data memory 60 as the load signal LD1.

It is thus seen that the upper keyboard note detector circuit 52 puts out an upper keyboard load pulse UKLD, (K) in FIG. 2, with a duration of 7 $\mu$s, when each new upper key is depressed. In response to this upper keyboard load pulse UKLD, and to the channel truncate signal TR1 from the truncate circuit 76, the memory control circuit 72 delivers the load signal LD1 to the data memory 60 thereby causing same to accept the incoming set of upper-key data UKC. The data memory 60 stores this upper-key data set as assigned to that one of the new channels U1' through U7' which is designated by the channel truncate signal TR1.

The AND gate 118 in the memory control circuit 72 also delivers its output to the indication data memory 62. Included in this memory 62 is a parallel combination of two eight-stage, one-bit shift registers 124 and 126 under the shift control of the master clock pulses $\phi$, (A) in FIG. 2. The eight stages of each of these shift registers 124 and 126 correspond to the respective new channels U1' through U8' (channel U8' is not used), just like the stages of the shift register 112 in the data memory 60. The combinations of the binary states of the corresponding stages in the two shift registers 124 and 126 provide an "indication code" of two-bit (K1 and K2) format. Incorporating two AND gates 128 and 130 and two OR gates 132 and 134, the indication data memory 62 is capable of holding the indication data stored in the shift registers 124 and 126. Table 3 below shows the indication code.

TABLE 3

| Indication Code | | |
|---|---|---|
| K1 | K2 | Meaning |
| 1 | 0 | Upper key depressed. |
| 1 | 1 | Fill-note key depressed. |
| 0 | 0 | Key release. |

When the load pulse LD1 is applied to the data memory 60 for causing same to store the upper-key data UKC, the AND gate 118 delivers a binary ONE signal only to the first shift register 124 via the OR gate 132. Thus the two shift registers 124 and 126 store binary ONE and ZERO, respectively, which denote in combination the depressed state of the corresponding upper key as in Table 3. The AND gates 128 and 130 receive the output from the NOR gate 116 in the data memory 60. Consequently, like the data memory 60, the discrimination data memory 62 holds the data stored in the shift registers 124 and 126.

It is to be noted that the shift registers 124 and 126 in the discrimination data memory 62 operate in accordance with the recurrent series of new channels U1' through U8' created by the data memory 60. The OR gate 132 associated with the first shift register 124 receives the timing pulses SY8, (C) in FIG. 2, timed to coincide with the unused new channel U8'. Thus, for this unused channel, the shift registers 124 and 126 always store binary ONE and ZERO, respectively, which denote in combination the depression of an upper key, thereby preventing data assignment to the new channel U8'.

The indication data K1–K2 are delivered from the shift registers 124 and 126 to an OR gate 136, which is the final element of the discrimination data memory 62. The OR gate 136 derives the key-on signal KO1 from the indication data K1–K2. This key-on signal KO1 is directed to the latch circuit 84, FIG. 3, together with the upper-key data UKC that have been re-assigned to the new channels U1' through U7' in the data memory 60. The indicia KD in FIG. 4 generally designate the upper-key data UKC and key-on signal KO1, as well as the fill-note data FKC which are also put out by the memory 60, as detailed hereafter.

Fill-Note Data Processing

The key-coded fill-note data FKC are formed by combining the note-coded data N1–N4 derived from the key-coded data representative of depressed lower keys (or the lower keyboard notes generated automatically during performance in the SINGLE FINGER or MEMORY mode), with the octave-coded data B1–B3 such that the resulting fill notes will fall within an octave below the note of the lowest depressed upper key at the moment. How, then, the lowest pressed upper key is detected will first be described.

With reference to FIG. 3 the upper keyboard lowest note detector circuit 56 illustrated therein includes a lowest-note temporary memory 140 which receives the delayed data KD* (N1-B3 and KO1) from the two-bit delay circuit 82. The key-on signal KO1 included in the data KD* also enters an upper-key-on detector circuit 142 in the detector circuit 56. The temporary memory 140 compares with one another the successively incoming sets of key data N1-B3 assigned to the delayed upper-keyboard channels U1 through U7, (D) in FIG. 2, and temporarily stores the set of data that represents the lowest depressed upper key at every instant.

Connected next to the temporary memory 140 is a lowest-note memory 144. This memory 144 receives from the temporary memory 140 the set of key data that has been stored therein at the end of each series of upper-keyboard channels U1 through U7. This key data set stored in the memory 144 represents, therefore, the lowest of two or more notes that may be assigned to each series of upper-keyboard channels U1 through U7.

The upper-key-on detector circuit 142 stores the key-on signal KO1 supplied during the binary ONE state of the upper keyboard timing signal YU, (C) in FIG. 2, which also is delivered thereto from the timing signal generator 78. The circuit 142 transforms the key-on signal into a D.C. signal, putting it out as an any-upper-key-on signal UAKON. This signal remains ONE as long as any upper key is being pressed, and becomes ZERO when all upper keys are released.

The any-upper-key-on signal UAKON enters a two-input AND gate 146. The other input of this AND gate receives the timing signal Y9, (C) in FIG. 2, which includes a pulse generated immediately following each final upper-keyboard channel U7. The output from the AND gate 146 enters another two-input AND gate 148, to which is also input the output from a comparator 150. This comparator receives through its input A the successive sets of key data that have been temporarily stored in the temporary memory 140 and, through its input B, the lowest-note data set stored in the memory 144 at the end of each sequence of upper-key-board channels U1 through U7. The output from the comparator 150 is ONE when the two inputs are not equal ($A \neq B$).

It will be evident that during each timing pulse Y9, the temporary memory 140 stores a key data set representative of a newly detected lowest note, whereas the memory 144 stores a key data set indicative of the previously detected lowest note. Thus the comparator 150 produces a ONE output when the lowest pressed upper key of one series of upper-keyboard channels U1 through U7 differs from that of the next series of such channels. In response to this ONE output the AND gate 148 also produces a ONE output.

The ONE output from the AND gate 148 is fed directly to the load control input of the memory 144 and also, via a NOR gate 152, to its hold control input. The memory 144 is thus cleared of its data set representative of the preceding lowest pressed upper key; instead, the data set representative of the new lowest pressed upper key enters from the temporary memory 140 for storage in the memory 144. The AND gate 148 also delivers its output to a pulse extension circuit 154. In this circuit the output pulse from the AND gate 148 has its duration extended to 9 μs and then is put out as the lowest-pressed-upper-key-change signal ICH.

Figure 6:
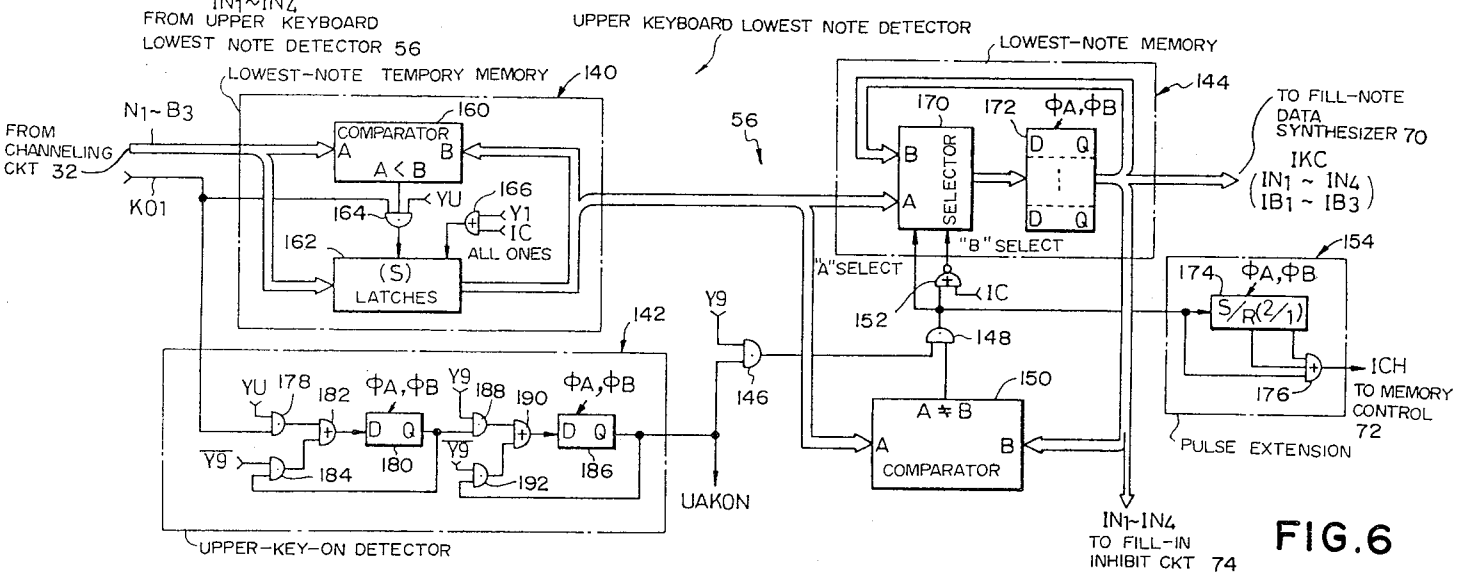
FIG. 6 is a partly block and partly schematic diagram showing in detail the upper keyboard lowest note detector circuit of FIGS. 1 and 3.

FIG. 6 is a more detailed representation, in partly block and partly schematic form, of the upper keyboard lowest note detector circuit 56. The lowest-note temporary memory 140 in this circuit 56 comprises a comparator 160, a latch circuit 162, an AND gate 164, and an OR gate 166.

The OR gate 166 receives the timing pulses Y1, (C) in FIG. 2, on one hand and, on the other hand, the aforementioned initial clear signal IC. Each timing pulse Y1 corresponds in time to the single pedal keyboard channel P1, (D) in FIG. 1, immediately preceding each series of upper-keyboard channels U1 through U7. The OR gate 166 has its output coupled to the preset input of the latch circuit 162. Thus, prior to the start of each series of upper-keyboard channels, the latch circuit 162 is preset with a data set "1-1-1-1-1-1-1" by the timing pulse Y1 applied to the OR gate 166. This is necessary to cause the latch circuit to memorize the maximum of key data preparatory to each sequence of data comparisons.

The comparator 160 receives (A) the key data N1-B3 from the two-bit delay circuit 82, FIG. 3, and (B) the output from the latch circuit 162. This latch circuit also receives the key data N1-B3 from the delay circuit 82. When its input A is less than its input B, the comparator 160 delivers a ONE output to one of the three inputs of the AND gate 164. The second input of this AND gate 164 receives the key-on signal KO1 from the delay circuit 82, and its third input receives the upper keyboard timing signal YU from the timing signal generator 78. The output from the AND gate 164 enters the strobe input S of the latch circuit 162.

Such being the configuration of the temporary memory 140, the AND gate 164 passes the output from the comparator 160 on to the strobe input S of the latch circuit 162 during those of the upper keyboard channels U1 through U7 to which there are assigned the key data representative of the upper keys being depressed. As has been stated, the latch circuit 162 has been preset with the data set of the greatest value. Therefore, during the first upper keyboard channel carrying a set of key data representative of any upper key being depressed, the input A to the comparator 160 is of course less than the input B thereto. The comparator 160 causes, via the AND gate 164, the latch circuit 162 to latch this set of key data.

Thereafter the comparator 160 compares the sets of key data assigned to the successive upper keyboard channels with the data set latched in the latch circuit 162. The latter latches a data set of smaller value, i.e., a data set representative of a lower note. Thus, after the comparison of the data set assigned to the last upper keyboard channel U7 with the one that has been latched in the latch circuit 162, there remains in the circuit 162 the data set indicative of the lowest of the notes assigned to one sequence of upper keyboard channels U1 through U7.

With reference directed further to FIG. 6 the lowest-note memory 144 in the detector circuit 56 comprises a selector 170 and a network of parallel seven-bit delay flip-flops 172, the latter being under the shift control of the timing pulses $\phi A$ and $\phi B$, (C) in FIG. 2, each having a cycle of 3 μs period. The selector 170 receives (A) the key data latched in the latch circuit 162 of the temporary memory 140, and (B) the output from the delay flip-flops 172. The selector 170 delivers its output to the flip-flops 172. The key data latched in the latch circuit 162 are also fed to the input A of the comparator 150, which further receives through its input B the output from the delay flip-flops 172.

It has been mentioned that the set of key data latched in the latch circuit 162 during the application of each timing pulse Y9 to the AND gate 146 represents the true lowest of the notes assigned to each sequence of upper keyboard channels. The AND gate 148 is enabled during the application of each timing pulse Y9 to the AND gate 146. If then the set of key data from the latch circuit 162 does not coincide with the one from the delay flip-flops 172, the comparator 150 produces a ONE output. The AND gate 148 responds to this comparator output to cause the selector 170 to select its input A. Consequently the set of key data representative of the new lowest depressed upper key is transferred from the latch circuit 162 to the delay flip-flops 172 via the selector 170, for storage in the delay flip-flops.

Upon disappearance of the timing pulse Y9 the AND gates 146 and 148 are both disabled, with the result that the NOR gate 152 delivers a ONE output to the selector 170 thereby causing same to select its input B. Thus the memory 144 holds the lowest-depressed-upper-key data that have been stored in the delay flip-flops 172, until the appearance of the next timing pulse Y9. The memory 144 continues the production of the same set of lowest-depressed-upper-key data IKC (In1–IN4 and IB1–IB3) from the second channel L2 of each series of lower keyboard channels L1 through L7, (D) in FIG. 2, to the first channel L1 of the next series, that is, for 48

μs from the time slot 30 of each sequence to the time slot 29 of the next sequence.

If the comparator 150 detects a different lowest depressed upper key at the time of the next timing pulse Y9, with the consequent production of a ONE output from the AND gate 148, then the memory 144 will accept and store the set of key data representative of this different lowest depressed upper key. If not, the memory 144 will continue the production of the same set of lowest-depressed-upper-key data IKC for another 48 μs.

The pulse extension circuit 154, also including in the upper keyboard lowest note detector circuit 56, comprises a two-stage/one-bit shift register 174 and a three-input OR gate 176. The shift register 174 is under the control of the timing pulses $\phi$A and $\phi$B. The shift register 174 and one of the three inputs of the OR gate 176 both receive from the AND gate 148 its ONE output indicative of a change from one lowest pressed upper key to another. Each output pulse from the AND gate 148 corresponds in time to one of the timing pulses Y9, (C) in FIG. 2, and has a duration of 3 μs.

The other two inputs of the OR gate 176 receive from the respective stages of the shift register 174 the pulses obtained by delaying the input pulse by 3 μs and another 3 μs respectively. The OR gate 176 provides, therefore, an output pulse with a duration of 9 μs. This output from the pulse extension circuit 154 is the lowest-depressed-upper-key-change signal ICH shown at (L) in FIG. 2. It will be seen that each pulse or ONE state of the signal ICH is created by extending the duration of the output pulse from the AND gate 148 to 9 μs, starting simultaneously with the corresponding timing pulse Y9. Fed to the memory control circuit 72 shown in detail in FIG. 4, the lowest-depressed-upper-key-change signal ICH is utilized for cancelling the stored sets of fill-note data in the event of a change from one lowest pressed upper key to another.

Further shown in FIG. 6 is the upper-key-one detector circuit 142 forming a part of the upper keyboard lowest note detector circuit 56. The circuit 142 includes an AND gate 178 receiving (1) the key-on signal KO1 from the two-bit delay circuit 82, FIG. 3, and (2) the upper keyboard timing signal YU, (C) in FIG. 2. It will be observed from (C) of FIG. 2 that the upper keyboard timing signal YU remains ONE during each sequence of upper keyboard channels U1 through U7. Thus the AND gate 178 permits the passage therethrough of the key-on signal KO1, for delivery to and storage in a delay flip-flop 180 via an OR gate 182.

Another AND gate 184 in the upper-key-on detector circuit 142 receives (1) the output from the delay flip-flop 180 and (2) the inverted one $\overline{Y9}$ of the timing signal Y9 shown at (C) in FIG. 2. The AND gate 184 becomes disabled, therefore, immediately after each final upper keyboard channel U7, with the consequent cancellation of the information stored in the delay flip-flop 180.

Thereupon the key-on signal that has been stored in the flip-flop 180 is transferred to and stored in another delay flip-flop 186 via AND gate 188 and OR gate 190. The output of this second delay flip-flop 186 is coupled to one of the two inputs of another AND gate 192, the output of which is connected back to the flip-flop 186 via the OR gate 190. The other input of the AND gate 192 receives the inverted timing signal Y9. The second delay flip-flop 186 is therefore capable of holding the input key-on signal KO1 until the next timing pulse Y9.

In this manner the second delay flip-flop 186, or the upper-key-on detector circuit 142, puts out a ONE output as long as any key is being depressed on the upper keyboard. This output from the circuit 142 is termed the any-upper-key-on signal UAKON, intended for delivery to the AND gate 68 and to the memory control circuit 72 shown in detail in FIG. 4.

The lowest-pressed-upper-key data IKC, produced by the upper keyboard lowest note detector circuit 56 of FIG. 6, enter the fill-note data synthesizer circuit 70 shown in detail in FIG. 4. Further, as indicated in FIG. 3, the note-coded portions IN1–IN4 of these lowest-depressed-upper-key data IKC are fed to the fill-in inhibit circuit 74, or to a note data read-only memory circuit 200 (hereinafter referred to as the note ROM circuit) included therein. The note ROM circuit 200 generates (1) note-coded data I(−C) indicative of a note that is semi-tone below the note represented by each incoming set of note-coded data IN1–IN4, and (2) note-coded data I(−W) indicative of a note that is whole-tone below the note represented by each incoming set of note-coded data.

FIG. 5 shows the fill-in inhibit circuit 74 in more detail. The note ROM circuit 200 comprises a semi-tone ROM 202 and a whole-tone ROM 204. The semi-tone ROM 202 generates the note-coded data I(−C) representative of a note a semi-tone below each input note, whereas the whole-tone ROM 204 puts out the note-coded data I(−W) representative of a note a whole-tone below each input note.

A reference back to Table 1 will reveal that the note code used in this embodiment of the invention does not include values equivalent to decimal "4", "8", "12" and "16(0)". If the input sets of note-coded data IN1–IN4 represent the note names C♯, E, G, and A♯, therefore, the semi-tone ROM 202 puts out the desired sets of note-coded data I(−C) by subtracting two from each input data set. For the input note-coded data sets representative of the other note names, the semi-tone ROM 202 produces the output data sets I(−C) by subtracting one from each input data set. The whole-tone ROM 204, on the other hand, subtracts two from each input note-coded data set if it represents the note name D♯, F♯, A, or C. For the input data sets representative of the other note names, the whole-tone ROM 204 subtracts three.

The comparator circuit 86 in the fill-in inhibit circuit 74 comprises two comparators 206 and 208. Both comparators receive through their inputs A the note-coded data N1–N4 from the two-bit delay circuit 82, FIG. 3. The comparator 206 receives through its input B the note-coded data I(−C) representative of a note which is a half-tone below the note of the lowest pressed upper key at every instant, from the semi-tone ROM 202. The other comparator 208 accepts through its input B the note-coded data I(−W) indicative of a note which is a whole-tone below the note of the lowest depressed upper key, from the whole-tone ROM 204.

It will be recalled that the note-coded data fed into the comparators 206 and 208 through their inputs A have been assigned to the delayed time-divisional channels P1, U1 through U7, and L1 through L7 given at (D) in FIG. 2. Upon agreement of the note-coded data set I(−C) or I(−W) with any of the successively incoming sets of the note-coded data N1–N4 assigned to the FIG. 2(D) channels, the comparator 206 or 208 puts out a coincidence pulse EQ1 or EQ2 at a moment in time corresponding to the channel carrying the set of data N1–N4 in question. The comparators 206 and 208 deliver the coincidence pulses EQ1 and EQ2 to the respective inputs of an OR gate 210 and thence to one of the two inputs of a NAND gate 212.

Applied to the other input of the NAND gate 212 is the lower keyboard timing signal YL, FIG. 2(C), so that the NAND gate allows the passage therethrough of only those of the coincidence pulses EQ1 and EQ2 which pertain to the lower keyboard. The timing signal YL is of course ZERO during the pedal keyboard channel P1 and upper keyboard channels U1 through U7. The output signal LKEN of the NAND gate 212 is therefore always ONE during these pedal keyboard and upper keyboard channels. Since the timing signal YL is ONE during the lower keyboard channels L1 through L7, the output signal LKEN of the NAND gate 212 is ZERO during those of the lower keyboard channels when the coincidence pulses EQ1 or EQ2 are generated, and ONE during the other lower key-board channels.

The output signal LKEN of the NAND gate 212 is fed to the AND gate 66 for gating the key-on signal KO1. The AND gate 66 blocks the passage of the key-on signal therethrough only in cases where the depressed lower keys are of note names that are a semi-tone or a whole-tone below the note name of the lowest depressed upper key. In the other cases the key-on signal KO1 passes the AND gate 66 and enters the new-key-on/off detector circuit 64 as the key-on signal KO1'.

As will be detailed subsequently, the fill-note data forming circuit 70 creates the key-coded fill-note data FKC from the note-coded portions of the lower key data latched in the lower keyboard note detector circuit 54 shown in detail in FIG. 4. The detector circuit 54 is unable, however, to latch the lower key note data unless it receives the key-on signal KO1' from the AND gate 66 via the new-key-on/off detector circuit 64. Thus, as the fill-in inhibit circuit 74 blocks the delivery of the key-on signal to the lower keyboard note detector circuit 54 as above, the fill-note data synthesizer circuit 70 is prevented from the production of the data FKC representative of fill notes that are a semi-tone or a whole-tone below the note of the lowest pressed upper key at every moment.

The reason for this is that, should upper keyboard notes be sounded together with the fill notes bearing too close tonal relations thereto, the resulting sounds would be vague and indistinct. For the same reason the production of fill notes that are the same as the notes of lowest depressed upper keys is prevented by means included in the memory control circuit 72, as will be presently explained in detail.

The illustrated embodiment provides for confining fill notes within an octave below successive lowest depressed upper keys. It is possible, however, to modify the circuitry of the instrument so as to generate fill notes higher than the lowest pressed upper keys. The fill-in inhibit circuit 74 may then be modified to inhibit the production of fill notes that are semi-tone or whole-tone above the note of each lowest pressed upper key. Such modifications of the fill-in inhibit circuit are believed apparent to the specialists.

Next to be referred to is the lower keyboard note detector circuit 54 shown in detail in FIG. 4. This circuit includes a latch circuit 220 receiving the note-coded data N1–N4 included in the output KD* from the two-bit delay circuit 82, FIG. 3. Delivered from the AND gate 66 via the new-key-on/off detector circuit 64, FIGS. 3 and 5, the key-on signal KO1' enters one of the three inputs of an AND gate 222. The second input of the AND gate 222 receives the lower keyboard timing signal YL, (C) in FIG. 2, which enables the AND gate to select only those parts of the key-on signal KO1' which pertain to the lower keyboard. The output from the AND gate 222 enters, as a lower keyboard load signal LKLD, (1) one of the two inputs of another AND gate 224, (2) a 16-stage/1-bit shift register 226, and (3) a two-input OR gate 228 in the fill-note data synthesizer circuit 70.

The other input of the AND gate 224 receives the timing pulse train $\phi$A, (C) in FIG. 2. During the ONE state of the lower keyboard load signal LKLD from the AND gate 222, therefore, the AND gate 224 functions to deliver pulses to the strobe input S of the latch circuit 220 in synchronism with the timing pulses $\phi$A. In response to the strobe pulses the latch circuit 220 latches the incoming sets of lower keyboard note data LN1–LN4.

Under the control of the 3-$\mu$s-cycle timing pulses $\phi$A and $\phi$B the shift register 226 delays the input lower keyboard load signal LKLD by 48 $\mu$s. The outputs from all the 16 stages of this shift register enter the separate inputs of an 18-input NOR gate 230. The other two inputs of the NOR gate 230 receive (1) the upper keyboard load signal UKLD from the delay flip-flop 108 in the upper keyboard note detector circuit 52 and (2) a fill-note gate signal FGE from an OR gate 232 in the fill-note data synthesizer circuit 70. The output from the NOR gate 230 enters the third input of the AND gate 222 to control the production of the lower keyboard load signal LKLD therefrom.

It is thus seen that the upper keyboard load signal UKLD or the fill-note gate signal FGE has priority over the lower keyboard load signal LKLD. Once a lower keyboard load pulse LKLD is generated, moreover, the next pulse is not produced for at least 48 $\mu$s; that is, the latch circuit 220 holds the same lower keyboard note data LN1–LN4 for at least 48 $\mu$s.

The upper keyboard load signal UKLD has priority over the lower keyboard load signal LKLD, as aforesaid, in order to prevent the lower keyboard load signal from becoming ONE while the memory control circuit 72 is assigning the upper-key data UKC to the new channels U1' through U7' in response to the upper keyboard load signal. Should the lower keyboard load signal become ONE during the ONE state of the upper keyboard load signal UKLD, fill-note data FKC might be generated in response to the lower keyboard load signal, resulting in errors due to the simultaneous processing of the upper-key data UKC and fill-note data FKC.

The fill-note gate signal FGE also has priority over the lower keyboard load signal LKLD, as stated above. This is to prevent a change in the data latched in the latch circuit 220 while the gate signal FGE is being applied to a gate 234 in the fill-note data forming circuit 70 to cause conduction therethrough.

Figure 7:
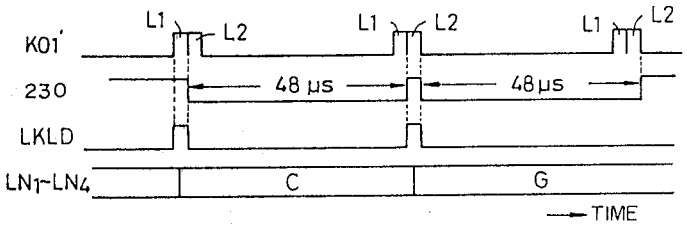
FIG. 7 is a chart of waveforms appearing at various stages in the lower keyboard note detector circuit shown in detail in FIG. 4.

Since the shift register 226 and NOR gate 230 coact as above to introduce the pulse intervals of at least 48 $\mu$s into the lower keyboard load signal LKLD, the latch circuit 220 latches the successive sets of lower keyboard note data LN1–LN4 at intervals of 48 $\mu$s or more. FIG. 7 is an illustration of such intermittent latching operation, plotted on the assumption that the sets of lower keyboard note data LN1–LN4 representative of the note names C and G have been assigned to the lower keyboard channels L1 and L2, respectively, and that the corresponding key-on signal KO1' is being fed from the AND gate 66 via the new-key-on/off detector circuit 64. The lower keyboard note detector circuit 54 of FIG. 4 operates as follows in response to these inputs.

On receipt of the first half, corresponding to the first lower keyboard channel L1, of the first pulse of the key-on signal KO1', the AND gate 222 puts out a corresponding lower keyboard load pulse LKLD. The latch circuit 220 responds to this load pulse to latch the incoming note data set LN1–LN4 representative of the note name C. The output from the NOR gate 230 remains ZERO during the 48-μs period from the start of the second lower keyboard channel L2 to the end of the first lower keyboard channel L1 of the next cycle of such timedivisional channels. The output from the NOR gate 230 becomes ONE at the same time with the second lower keyboard channel L2 of the next cycle. Thereupon the AND gate 222 puts out another LKLD pulse in response to the key-on pulse KO1' corresponding to the channel L2, with the result that the latch circuit 220 latches the incoming note data set LN1–LN4 representative of the note name G. The successive incoming sets of lower keyboard note data LN1–LN4 are thus latched sequentially at intervals of at least 48 μs.

Referring again to FIG. 4, the lower keyboard note detector circuit 54 delivers the successively latched sets of lower keyboard note data LN1–LN4 to the gate 234 and the input A of a comparator 236, both included in the fill-note data forming circuit 70. The input B of the comparator 236 receives the note-coded data IN1–IN4 contained in the lowest-depressed-upper-key data IKC from the upper keyboard lowest note detector circuit 56 shown in detail in FIG. 6. The octave-coded data IB-1–IB3 included in the lowest-depressed-upper-key data IKC are directed to the input A of a selector 238 via a subtracter 240 and also directly to its input B. The subtracter functions to subtract one from each input set of octave-coded data and hence to provide an octave-coded data set representative of an octave just below the one represented by the input data set. The selector 238 receives the output from the comparator 236 through its control input.

The comparator 236 produces a ONE output when the note name represented by each set of lower keyboard note data LN1–LN4 is above that of the corresponding lowest depressed upper key represented by the note-coded data IN1–IN4 of the lowest-depressed-upper-key data IKC. Applied to the control input of the selector 238, the ONE output from the comparator 236 causes the selector to select its input A, i.e., the octave-coded data indicative of the octave just below that embracing the lowest depressed upper key.

The comparator 236 produces a ZERO output when the note name represented by each set of lower keyboard note data LN1–LN4 is equal to, or lower than, that of the lowest depressed upper key. The ZERO output from the comparator 236 allows the selector 238 to select its input B, i.e., the octave-coded data indicative of the octave to which the lowest depressed upper key belongs. It should be pointed out at this juncture that the high-low relationship of the twelve note names in each octave is assumed in this disclosure to conform to the order of such note names given in Table 1, with C# taken as the lowest and C as the highest.

Selectively put out by the selector 238, the octave-coded data combine with the note-coded data LN1–LN4 from the lower keyboard note detector circuit 54 to create the desired key-coded fill-note data FKC. It will have been understood, then, that each set of fill-note data FKC is formed by shifting the note of each depressed lower key to an octave such that the resulting fill note will fall within an octave below the lowest depressed upper key.

The fill-note data FKC enter the gate 234, which also has the fill-note gate signal FGE fed to its enable input EN from the OR gate 232. Gated as dictated by the fill-note gate signal FGE, the fill-note data FKC travel from fill-note data forming circuit 70 to data memory 60 via OR gates 68.

It is also among the functions of the fill-note data forming circuit 70 to create the fill-note gate signal FGE from the lower keyboard load signal LKLD, an example of this signal LKLD being given in FIG. 7. Put out by the lower keyboard note detector circuit 54, the lower keyboard load signal LKLD enters a first input of the OR gate 228. The output of this OR gate is coupled to a delay flip-flop 242, the output of which is coupled to a first input of an AND gate 244 and thence to a second input of the OR gate 228. A second input of the AND gate 244 receives the inverted timing pulses $\overline{SY8}$.

Fed to the delay flip-flop 242, therefore, each lower keyboard load pulse LKLD is temporarily stored therein, prior to delivery to the set input S of a flip-flop 246 via a four-input AND gate 248. The other three inputs of the AND gate 248 receive (1) the timing pulses SY8, (2) the fill-in control signal MC generated upon closure of the fill-in selector switch 48, FIG. 1, and (3) the any-upper-key-on signal UAKON from the upper keyboard lowest note detector circuit 56, FIGS. 3 and 6.

Thus the AND gate 248 does not permit the passage of the lower keyboard load signal LKLD therethrough when the fill-in selector switch 48 is open, and/or when no upper key is being depressed. In such cases the fill-note gate signal FGE remains ZERO, preventing the delivery of the fill-note data FKC to the subsequent stages. If the fill-in control signal MC and any-upper-key-on signal UAKON are both ONE, on the other hand, then the lower keyboard load signal LKLD passes the AND gate 248 as allowed by the timing pulses SY8.

The flip-flop 246 has the timing pulses SY7 applied to its reset input R via an OR gate 250. As will be seen be referring to (C) in FIG. 2, therefore, the output from the flip-flop 246 in ONE for each 7 μs from one of the timing pulses SY8 to the subsequent timing pulse SY7. After being delayed 1 μs by a delay flip-flop 252, the output from the flip-flop 246 enters the OR gote 232, to be thereby put out as the fill-note gate signal FGE.

Figure 8:
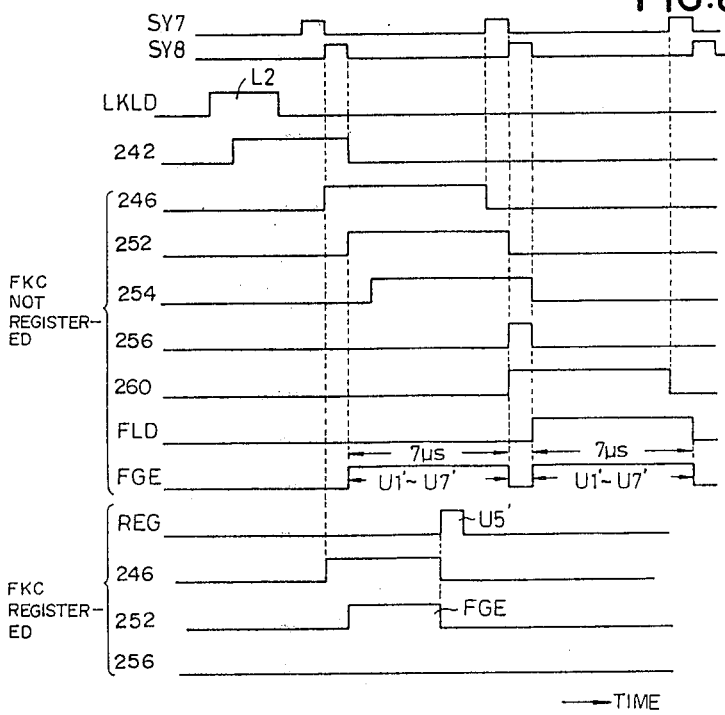
FIG. 8 is a chart of waveforms appearing at various stages in the fill-note data forming circuit shown in detail in FIG. 4.

FIG. 8 shows the waveforms of the outputs from the various components of the fill-note data forming circuit 70, plotted on the assumption that the lower keyboard load signal LKLD contains a pulse corresponding, by way of example only, to the lower keyboard channel L2 of (D) in FIG. 2. The following continued discussion of the fill-note data forming circuit 70, FIG. 4, may be taken in conjunction with the waveform chart of FIG. 8. It should be noted, first of all, that the fill-note gate signal FGE produced from the OR gate 232 has a pulse duration of 7 μs, which is equal to the length of each new series of time-divisional channels U1' through U7' created by the data memory 60.

Besides being fed to the OR gate 232, the output from the delay flip-flop 252 enters another delay flip-flop 254 on one hand and, on the other hand, a three-input AND gate 256 via an inverter 258. The delay flip-flop 254 delays the input by 1 μs and delivers the resulting output to another input of the AND gate 256. Still another input of the AND gate 256 receives the timing pulses SY8. The delay flip-flop 254, AND gate 256, and inverter 258 form in combination a decay differentiating circuit: the simultaneous application of ONE signals to all the three inputs of the AND gate 256 takes place only when the output pulse of the delay flip-flop 252 decays at the rise of one of the timing pulses SY8 upon disappearance of the preceding timing pulse SY7. Thereupon the AND gate 256 produces a ONE output in synchronism with the timing pulse SY8.

The AND gate 256 delivers its ONE output to the set input S of a flip-flop 260 for setting same. The flip-flop 260 is reset when the next timing pulse SY7 is impressed to its reset input R via an OR gate 262. The output from the flip-flop 260 is therefore ONE for 7 μs from the rise of one timing pulse SY8 to the rise of the subsequent timing pulse SY7.

After being delayed 1 μs by a delay flip-flop 264, the output from the flip-flop 260 is delivered to the OR gate 232 and also, as the fill-note load signal FLD, to the memory control circuit 72. The output from the OR gate 232 is the fill-note gate signal FGE. As will be seen from FIG. 8, both the fill-note load signal FLD and the fill-note gate signal FGE have a pulse duration of 7 μs, equal to the length of each new series of channels U1′ through U7′ formed by the data memory 60.

It should be noted that the fill-note data forming circuit 70 does not necessarily generate the fill-note load pulses FLD for all the formed sets of fill-note data FKC. The load pulses FLD are produced only when a data set representative of the same note name as each set of fill-note data being fed from the gate 234 to the data memory 60 via the OR gates 68 is registered on either of the new channels U1′ through U7′. Such selective production of the fill-note load pulses FLD will become apparent from the following description of the memory control circuit 72, FIG. 4, in relation with the fill-note data synthesizer circuit 70.

The memory control circuit 72 includes a comparator 266 which receives through its input A the note-coded data N1*–N4* included in the key-coded data N1–B3 (UKC or FKC) fed from the OR gates 68 to the data memory 60. The comparator 266 receives through its input B the note-coded data N1–N4 included in the key-coded output data from the data memory 60. The output data from the data memory 60 are of course registered on the new channels U1′ through U7′. The comparators 266 produces a ONE output upon coincidence of its two inputs, i.e., upon detection of the fact that each set of note data N1*–N4* represents a note name already registered on either of the new channels U1′ through U7′. The output from this comparator 266 will therefore be hereinafter referred to as the "registered" signal REG.

As the OR gate 232 of the fill-note data forming circuit 70 puts out a fill-note gate pulse FGE in response to the output from the delay flip-flop 252 as aforesaid, the forming circuit 70 continuously delivers one set of fill-note data FKC to the data memory 60 during one series of new channels U1′ through U7′. The comparator 266 compares the note-coded data N1*–N4* in this set of fill-note data FKC with the note-coded data N1–N4 in the successive sets of key-coded data on the channels U1′ through U7′ which are time-divisionally produced by the shift register 112 in the data memory 60.

Let it be assumed for example that the set of note-coded data N1*–N4* in question represents a note name already registered on new channel U5′. Then the "registered" signal REG from the comparator 266 will become ONE at a time corresponding to a new channel U5′. FIG. 8 shows the "registered" signal REG with such a pulse indicative of the fact that the note-coded data set N1*–N4* represents the same note name as that already registered on new channel U5′.

The comparator 266 delivers the "registered" signal REG to one of the two inputs of an AND gate 268. The other input of this AND gate receives the key-on signal KO1 from the discrimination data memory 62. Thus, upon receipt of the "registered" signal REG of a ONE state, the AND gate 268 produces a ONE output if the key corresponding to the note registered on new channel U5′ is being pressed. The ONE output from the AND gate 268 enters an OR gate 270 in the fill-note data former circuit 70. The corresponding ONE output from the OR gate 270 is applied, via the OR gate 250, to the flip-flop 246 for setting same and also directly to the delay flip-flop 252 for resetting same.

As represented in FIG. 8, therefore, the outputs from the flip-flop 246 and delay flip-flop 252 both become ZERO before the appearance of the next timing pulse SY7 corresponding to the final channel U7′. Since the fill-note gate signal FGE derives its ONE state from the output from the delay flip-flop 252, the ONE state of the signal FGE is cut short before the lapse of 7 μs. It will also be apparent that the AND gate 256 does not produce a ONE output on receipt of the subsequent timing pulse SY8, thereby failing to set the flip-flop 260. Thus the fill-note load signal FLD remains ZERO.

The foregoing discussion will have made clear that the fill-note data synthesizer circuit 70 puts out no fill-note load pulse FLD if any outgoing set of fill-note data FKC represents a note bearing the same name as that already registered or stored in the data memory 60. This holds true regardless of whether the registered note is a fill note or that of a pressed upper key. It will therefore be appreciated that the same set of fill-note data is not to be registered on two or more of each new series of channels U1′ through U7′. Also avoided is the registration of a fill note bearing the same name as the note of a pressed upper key.

It will have been noted that the ONE output from the OR gate 270 is used for resetting not only the flip-flop 246 but also the delay flip-flop 252. This is because the OR gate 270 may produce the ONE output at a time corresponding to the last new channel U7′ (hence to one of the timing pulses SY7). In this case, should only the flip-flop 246 be reset by the ONE output from the OR gate 270, the delay flip-flop 252 would produce a pulse of the normal 7-μs duration. The result, then, would be the production of an undesired fill-note load pulse FLD from the delay flip-flop 264.

Also applied to the OR gate 270 is the new-upper-key-on signal UNKO from the new-key-on/off detector circuit 64. It has been stated that the signal UNKO also enters the upper keyboard note detector circuit 52, causing same to put out the upper keyboard load signal UKLD. During each ONE state of the signal UNKO, therefore, the flip-flop 246 and delay flip-flop 252 in the fill-note data forming circuit 70 are both reset by the output from the OR gate 270, so that no fill-note load pulse FLD is to be produced during each such time.

If each set of fill-note data FKC issuing from the fill-note data forming circuit 70 represents a note name not yet registered in the data memory 60, the "registered" signal from the comparator 266 in the memory control circuit 72 remains ZERO. Then the AND gate 268 produces no ONE output. Although the "registered" signal becomes ONE when the fill-note data set FKC represents a note name already registered in the data memory, the AND gate 268 does not produce a ONE output, either, if the key corresponding to the registered note name has been released. In such cases the delay flip-flop 252 in the fill-note data forming circuit 70 is not reset by the output from the OR gate 270, nor is the flip-flop 110 reset until the subsequent timing pulse SY7. Consequently the fill-note data forming circuit 70 puts out the fill-note load signal FLD in the normal manner set forth above.

The fill-note load signal FLD is delivered to one of the two inputs of an AND gate 280 in the memory control circuit 72. Fed to the other input of this AND gate is the channel truncate signal TR1 from the truncate circuit 76. Thus, during the receipt of the fill-note load signal FLD of a ONE state, the AND gate 280 produces a ONE output at a time corresponding to either of the new channels U1′ through U7′ indicated by the truncate signal TR1. This ONE output from the AND gate 280 is supplied via the OR gate 122 to the data memory 60 as the load signal LD1. The data memory 60 responds to the load signal by registering the incoming set of fill-note data FKC on the channel indicated by the truncate signal TR1.

Further directed into the discrimination data memory 62, the ONE output from the AND gate 280 is stored in its two shift registers 124 and 126 via the respective OR gates 132 and 134. Thus the discrimination data memory 62 stores the discrimination data set "1-1", indicative of the "key-on" state of the fill note represented by the fill-note data set FKC in question, in their stages corresponding to that one of the new channels U1′ through U7′ on which the fill-note data set is registered in the data memory 60.

Data Processing on Key Release

Reference is now directed to the new-key-on/off detector circuit shown in detail in FIG. 5. In addition to the parts previously set forth, the detector circuit 64 includes an inverter 290 for inverting the key-on signal K01′ from the AND gate 66. The inverter 290 delivers its output to one of the three inputs of an AND gate 292. The second input of this AND gate receives the output from the shift register 88, produced by delaying the key-on signal KO1′ by 48 μs, and its third input receives the output from an OR gate 294. The OR gate 294 receives the upper keyboard timing signal YU and lower keyboard timing signal YL, both shown at (C) in FIG. 2. Thus the AND gate 292 puts out a new-key-off signal NKOF of a ONE state when the key-on signal KO1′ changes from a ONE to ZERO state during any of the upper keyboard and lower keyboard channels U1 through U7 and L1 through L7, that is, when an upper or lower key is newly released.

The new-key-on/off detector circuit 64 delivers the new-key-off signal NKOF to the key-off control circuit 58 shown in detail in FIG. 3, or more specifically to an OR gate 300 included therein. The OR gate 300 delivers its output to the strobe input S of a latch circuit 302 via two successive AND gates 304 and 306. Another input of the AND gate 304 receives the output from a pulse extension circuit 308 via an inverter 310.

When each new-key-off pulse NKOF enters the key-off control circuit 58, the output from the pulse extension circuit 308 is ZERO, so that the AND gate 304 allows the passage of the new-key-off pulse therethrough. The pulse extension circuit 308 receives this new-key-off pulse, which has a duration of 3 μs, and extends its duration to 9 μs. The resulting output from the pulse extension circuit 308 is the key-off signal KOF, indicative of the release of any key on the upper and lower keyboards. Each key-off pulse KOF has a duration of 9 μs, as above, in order to cover one complete sequence of new channels U1′ through U7′. The pulse extension circuit 308 can be of the type including a shift register, like the pulse extension circuit 154 shown in FIG. 6.

The OR gate 300 delivers its output to a shift register 312 via an AND gate 314, which also receives the output from the pulse extension circuit 308. Under the control of the timing pulses $\phi$A and $\phi$B, each with a cycle of 3 μs, the shift register 312 is of 16-stage/1 bit design, intended to temporarily store the successive new-key-off pulses NKOF.

In this particular embodiment, as has been set forth in connection with FIG. 1, the channeling circuit 32 detects the release of the keys altogether for each complete sequence of channels P1, U1 through U7, and L1 through L7, with the aid of the key-off check pulses X. It is therefore likely that a plurality of new-key-off pulses NKOF be delivered consecutively from the new-key-on/off detector circuit 64 during one complete sequence of channels (lasting 48 μs from channel P1 to channel L7 at (B) or (D) in FIG. 2). In order to process such a rapid succession of incoming new-key-off pulses one by one, the unprocessed pulses must be held in temporary storage. The shift register 312 serves this purpose.

Figure 9:
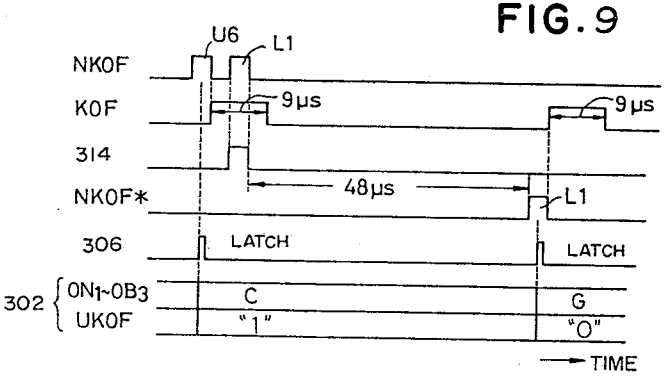
FIG. 9 is a chart of waveforms appearing at various stages in the key-off control circuit shown in detail in FIG. 3.

FIG. 9 is illustrative of the operation of the key-off control circuit 58, on the hypothesis that two new-key-off pulses NKOF have been generated on channels U6 and L1 during one complete sequence of such channels. In response to the first new-key-off pulse NKOF on channel U6 the OR gate 300 applies a strobe pulse to the latch circuit 302 via the AND gates 304 and 306. The output (KOF) from the pulse extension circuit 308 is still ZERO at this moment. Thus the AND gate 314 prevents the passage of the first new-key-off pulse therethrough and, therefore, its storage in the shift register 312.

Immediately after channel U6, the pulse extension circuit 308 puts out the corresponding key-off pulse KOF of 9 μs duration thereby disabling the AND gate 304 and enabling the AND gate 314. The second new-key-off pulse NKOF on channel L1 is therefore blocked from passage through the AND gate 304 but allowed to pass the AND gate 314. The shift register 312 stores this second new-key-off pulse and, after 48 μs, puts it out as a pending-new-key-off pulse NKOF*, for delivery to both AND gates 304 and 314 via the OR gate 300. By this time the output from the pulse extension circuit 308 has become ZERO. The AND gate 304 permits the delivery of the pending-new-key-off pulse NKOF* to the AND gate 306 and also to the pulse extension circuit 308. The AND gate 306 applies to the latch circuit 302 a strobe pulse corresponding to channel L1. In response to the pending-new-key-off pulse NKOF* the pulse extension circuit 308 puts out another key-off pulse KOF indicative of the release of the key on channel L1.

The latch circuit 302 receives the key data N1-B3 from the two-bit delay circuit 83, as well as the upper keyboard timing signal YU from the timing signal generator 78. In response to the strobe pulses from the AND gate 306, therefore, the latch circuit 302 latches those sets of key data N1-B3 which represent the newly released keys, and those fractions of the upper keyboard timing signal YU which indicate the keyboards to which the released keys belong. The key data and upper keyboard timing signal fractions latched in the latch circuit 302 are thence delivered to the memory control circuit 72, FIG. 4, as key-coded new-key-off data ON1-OB3 and as a new-key-off keyboard signal UKOF.

The new-key-off keyboard signal UKOF designates the upper keyboard when in a ONE state, and the lower keyboard when in a ZERO state. Let it be assumed that the note name C has been assigned to upper keyboard channel U6, and the note name G to lower keyboard channel L1, in FIG. 9. Then, as shown in the same figure, the latch circuit 302 successively latches those sets of key data N1-B3 (or ON1-OB3) which represent the note names C and G, respectively, as well as the ONE state of the timing signal YU, indicative of the upper keyboard to which the note name C belongs, and the ZERO state of the timing signal YU, indicative of the lower keyboard to which the note name G belongs.

The key-off information from the key-off control circuit 58 is processed as follows by the memory control circuit 72 shown in detail in FIG. 4. The memory control circuit 72 includes two comparators 320 and 322, in addition to the comparator 266 explained already in connection with the fill-note data forming circuit 70. The comparator 320 receives (1) the note-coded data ON1–ON4 included in the new-key-off data ON1–OB3 from the key-off control circuit 58 and (2) the note-coded data N1–N4 included in the key-coded data registered on the new channels U1' through U7', (E) of FIG. 2, from the data memory 60. The other comparator 322 receives (A) the octave-coded data OB1–OB3 included in the new-key-off data ON1–OB3 from the key-off control circuit 58 and (B) the octave-coded data B1–B3 included in the key-coded data from the data memory 60.

Receiving the two inputs ON1–ON4 and N1–N4, the comparator 320 functions to detect any of the channels U1' through U7' on which there may be registered the same note name as that of each newly released key. The comparator 320 puts out a key-off note detection pulse OFN at a time corresponding to the channel carrying the same set of note-coded data N1–N4 as the note-coded data ON1–ON4 in each set of new-key-off data ON1–OB3. The other comparator 322 has it as an object to detect any channel on which there may be registered the same set of octave-coded data B1–B3 as the octave-coded data OB1–OB3 in each set of new-key-off data ON1–OB3. The comparator 322 puts out a key-off octave detection pulse OFO upon detection of such a channel and at a time corresponding to that channel.

Also included in the memory control circuit 72 are two AND gates 324 and 326 for decoding the successive sets of discrimination-coded data K1–K2 traveling out of the discrimination data memory 62 in synchronism with the respective new channels. The AND gate 324 directly receives the discrimination-coded data K1–K2 from the memory 62, whereas the other AND gate 326 receives them with the bit K2 inverted by an inverter 328. Decoding the discrimination-coded data, the AND gate 324 provides a fill-note key-on signal FKON, and the AND gate 326 provides an upper-key-on signal UKON, as will be understood by referring back to the indication code given in Table 3.

The memory control circuit 72 further comprises a logic circuit, generally labeled 330, composed of five AND gates 332, 334, 336, 338 and 340 and an OR gate 342. In response to the various inputs hereinafter set forth, the logic 330 delivers a key-off command signal KOFF to the discrimination data memory 62 via an inverter 344. The key-off command signal KOFF becomes ONE in five different cases explained subsequently, in order to forcibly register the discrimination-coded data set "0–0", representative of key release, in the indication data memory 62.

In response to the key-off command pulse KOFF the inverter 344 applies a ZERO output to the two AND gates 128 and 130 in the discrimination data memory 62. These AND gates 128 and 130, as may be recalled, are intended to perform a data holding function in the memory 62. Upon application of the ZERO output from the inverter 344 to the AND gates 128 and 130, therefore, the memory 62 is forced to register the discrimination-coded data set "0–0" on the new channel indicated by the key-off command pulse KOFF.

What follows is the discussion of the aforesaid five different cases where the key-off command signal KOFF from the logic 330 becomes ONE.

1. Deletion of a fill note bearing the same name as that of a pressed upper key:

The AND gate 332 of the logic 330 receives (1) the fill-note key-on signal FKON from the AND gate 324, (2) the "registered" signal REG from the comparator 266, and (3) the upper keyboard load signal UKLD from the upper keyboard note detector circuit 52. Thus the AND gate 332 produces a ONE output when a set of upper-key data UKC, representative of a new pressed upper key, is about to be registered on either of the new channels U1' through U7' (the upper keyboard load signal UKLD in a ONE state), if a key-coded data set representative of the same note name as the pressed upper key has already been registered (the "registered" signal in a ONE state), and if the registered key-coded data set represents a fill note in a key-on state (the fill-note key-on signal in a ONE state).

The AND gate 332 delivers its ONE output to the OR gate 342 thereby causing same to put out a key-off command pulse KOFF. The memory 62 responds, as has been stated by registering the discrimination-coded data set "0–0" on the channel where the fill-note data set representative of the same note name as the pressed upper key is registered. Consequently the key-on signal KO1 from the OR gate 136 becomes ZERO at a time corresponding to the channel where the fill-note data set in question is registered, preventing the tone production of the fill note at the tone generator circuit 44, FIG. 1.

2. Deletion of all fill notes in the event of a change from one lowest depressed upper key to another:

The AND gate 334 of the logic 330 receives (1) the fill-note key-on signal FKON from the AND gate 324 and (2) the lowest-depressed-upper-key-change signal ICH from the upper keyboard lowest note detector circuit 56 shown in detail in FIGS. 3 and 6. Each lowest-depressed-upper-key-change pulse ICH has a duration of 9 μs. Therefore, when a different lowest depressed upper key is detected, the AND gate 334 produces a ONE output for any of the new channels U1′ through U7′ carrying a fill note in a key-on state (as exhibited by the ONE state of the fill-note key-on signal FKON). The corresponding key-off command signal KOFF from the OR gate 342 causes the indication data memory 62 to register the indication-coded data set "0—0" on all the pertinent channels and hence to cancel the fill notes.

Thereafter, in conformity with the new lowest depressed upper key, different key-coded fill-note data FKC are synthesized in the fill-note data synthesizer circuit 70. Such new fill-note data are re-registered on the new channels U1′ through U7′ in accordance with the above explained procedure.

3. Deletion of an upper-key note upon release of the key:

Directed to the AND gate 336 of the logic 330 are (1) the upper-key-on signal UKON from the AND gate 326, (2) the key-off note detection signal OFN from the comparator 320, (3) the key-off octave detection signal OFO from the comparator 322, (4) the new-key-off keyboard signal UKOF from the key-off control circuit 58, FIG. 3, and (5) the key-off signal KOF from the key-off control circuit 58.

Thus, when a key is released on the upper keyboard (the new-key-off keyboard signal UKOF in a ONE state and the key-off signal KOF in a ONE state for 9 μs), the AND gate 336 produces a ONE output for the channel on which has been registered the key-coded data set ON1-OB3 corresponding to the released key (as indicated by the ONE state of the key-off note detection signal OFN and of the key-off octave detection signal OFO), provided that the "key-on" data set has been registered on that channel (the upper keyboard key-on signal in a ONE state). The result is the change to "0—0" of the indication-coded data set K1–K2 corresponding to the released upper key.

4. Deletion of a fill note upon release of the corresponding lower key:

The AND gate 338 of the logic 330 receives (1) the fill-note key-on signal FKON from the AND gate 324, (2) the key-off note detection signal OFN from the comparator 320, and (3) the key-off signal KOF from the key-off control circuit 58. Upon release of a key on the upper or lower keyboard, the key-off control circuit 58 of FIG. 3 puts out a key-off pulse KOF having a duration of 9 μs. The comparator 320 produces a key-off note detection pulse OFN at a time corresponding to the channel on which is registered the same note name as that represented by the key-coded data set ON1–OB3 of the released key. If then a fill-note key-on pulse FKON is produced simultaneously, it is seen that the released key belongs to the lower keyboard.

This is because the memory 60 does not store a fill note of the same name as a pressed upper key. The key-off note detection pulse OFN is produced at the same time with the fill-note key-on pulse FKON only when some lower key is released. Thus, upon release of a lower key, the AND gate 338 produces a ONE output at a time corresponding to the channel carrying the fill note derived from the released lower key. In response to this ONE input the OR gate 342 delivers a key-off command pulse KOFF to the memory 62 via the inverter 344, thereby causing the undesired fill note to be deleted.

5. Deletion of all fill notes when all upper keys are released or when the fill-in selector switch is opened:

Delivered to the AND gate 340 of the logic 330 are (1) the fill-note key-on signal FKON from the AND gate 324 and (2) the output from a NAND gate 346. This NAND gate receives (1) the any-upper-key-on signal UAKON from the upper keyboard lowest note detector circuit 56, FIG. 3 or 6, and (2) the fill-in control signal MC from the fill-in selector switch 48, FIG. 1. Consequently, when all the upper keys are released (the any-upper-key-on signal UAKON in a ZERO state), or when the fill-in selector switch 48 is opened (the fill-in control signal MC in a ZERO state), the AND gate 340 generates a ONE output in synchronism with any of the channels U1′ through U7′ on which a fill note has been registered (the fill-note key-on signal FKON in a ONE state). The result, of course, is the deletion of all the fill notes which have been in storage.

Selection between Data KD and Data KD*

Chart (E) of FIG. 2 represents the recurrent series of new time-divisional channels U1′ through U7′ to which there are assigned the key-coded data N1-B3 (consisting of the upper-key data UKC and fill-note data FKC) and key-on signal KO1 issuing from the memories 60 and 62, respectively. These key-coded data N1-B3 and key-on signal KO1, combinedly designated KD, enter the latch circuit 84, FIG. 3.

Applied to the strobe input S of the latch circuit 84 are the timing pulse train 3Y3, (C) in FIG. 2, having a cycle of 3 μs. A comparison of FIGS. 2(C) and 2(E) will demonstrate that the timing pulses 3Y3 are timed to coincide with the new channels 3(U3′), 6(U6′), 1(U1′), 4(U4′), 7(U7′), 2(U2′), 5(U5′), and 8(U8′), in that order and repeatedly. Therefore, as indicated at (F) in FIG. 2, the latch circuit 84 sequentially latches the incoming information KD on the new channels U3′, U6′, U1′, U4′, U7′, U2′, U5′, and U8′, at intervals of 3 μs.

The latch circuit 84 delivers its output to the input B of the selector 50. Applied to the input A of this selector is the information KD*, also comprising the key-coded key data N1-B3 and key-on signal KO1, from the two-bit delay circuit 82. It will now be seen that the latch circuit 84 serves the purpose of adjusting the new channels U1′ through U7′, (E) in FIG. 2, of the information KD to the original channels, (D) in FIG. 2, of the information KD*.

The selector 50 permits selective passage therethrough of its two inputs A and B depending upon the binary states of the upper keyboard timing signal YU, (C) in FIG. 2. The timing signal YU when in a ONE state causes the selector 50 to select its input B by being applied directly thereto. When in a ZERO state, on the other hand, the timing signal YU causes the selector 50 to select its input A by being impressed thereto via an inverter 350.

Thus, during each ONE state of the upper keyboard timing signal YU, the output from the latch circuit 84 passes the selector 50 on its way toward the tone generator circuit 44. The output from the latch circuit 84 during each ONE state of the timing signal YU is, as explained above, the information KD on the new channels that have been rearranged into the order of U3′, U6′, U1′, U4′, U7′, U2′, and U5′. Chart (G) of FIG. 2 represents such channels of information KD traveling from the latch circuit 84 into and through the selector 50. It will be noted that the output from the selector 50 does not include the unused new channel U8′. This is because the ONE state of the timing signal YU terminates just before this channel U8', causing the selector 50 to block the unnecessary data on that channel.

When the timing signal YU subsequently becomes ZERO, the selector 50 selects its input A, allowing the passage therethrough of the output information KD* from the two-bit delay circuit 82. During this ZERO state of the timing signal YU the delay circuit 82 puts out the information KD* on the lower keyboard channels L1 through L7 and on the pedal keyboard channel P1. This output information KD* during each ZERO state of the timing signal YU comprises, in other words, (1) the sets of key-coded key data N1-B3 which represent pressed lower keys and which have been assigned to the lower keyboard channels L1 through L7, as well as the corresponding part of the key-on signal KO1, and (2) the set of key-coded key data N1-B3 which represent a depressed pedal key and which has been assigned to the pedal keyboard channel P1, together with the corresponding part of the key-on signal KO1. Such output information KD* passes the selector 50 toward the tone generator circuit 44.

It will have been seen, therefore, that the selector 50 blocks, during the ZERO state of the timing signal YU, the key data and key-on signal assigned to the upper keyboard channels U1 through U7 and traveling directly from the two-bit delay circuit 82. This presents no problem, however, since the key data representative of pressed upper keys have been registered on the new channels U1' through U7' and are allowed to pass the selector 50 during the ONE state of the timing signal YU.

Tone Generator Circuit

Figure 10:
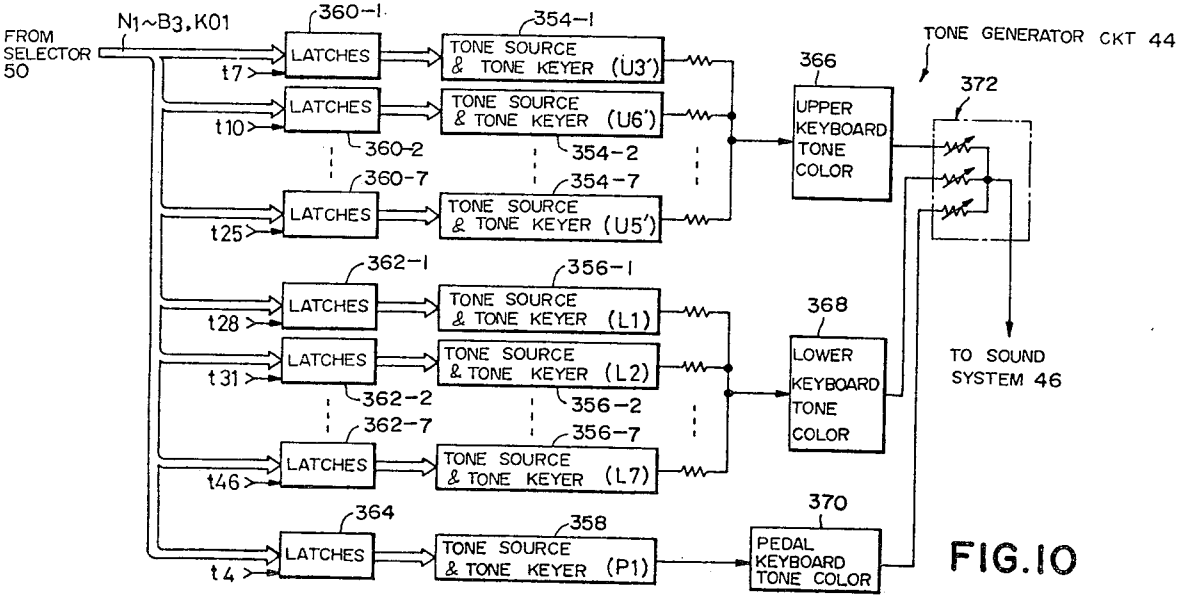
FIG. 10 is a block diagram showing the tone generator circuit of FIG. 1 in greater detail.

FIG. 10 is a block diagram showing in detail a preferable configuration of the tone generator circuit 44, time-divisionally receiving the information KD and KD* from the fill-in control circuit 42 set forth hereinabove. The tone generator circuit 44 is of multi-channel design, comprising a group of seven tone source and tone keyer circuits 354-1 through 354-7 corresponding respectively to the new series of time-divisional channels U3', U6', . . . U5' for the upper keyboard, another group of seven tone source and switching circuits 356-1 through 356-7 corresponding respectively for the original series of time-divisional channels L1, L2, . . . L7 for the lower keyboard, and an additional tone source and switching circuit 358 corresponding to the original time-divisional channel P1 for the pedal keyboard.

Connected in the preceding stages of the tone source and tone keyer circuits 354-1 through 354-7, 356-1 through 356-7 and 358 are latch circuits 360-1 through 360-7, 362-1 through 362-7 and 364, respectively. These latch circuits receive from the selector 50, FIG. 1 or 3, the information KD and KD*, i.e., the key-coded data N1-B3 and key-on signal KO1 on the recurring channels U3' through U5', L1 through L7, and P1, as such data are supplied in accordance with the channel sequence of (G) in FIG. 2.

The latch circuits 360-1 through 360-7, 362-1 through 362-7, and 364 also receive strobe pulses t7, t10, t13, t16, t19, t22, t25, t28, t31, t34, t37, t40, t43, t46 and t4, respectively. These strobe pulses are timed to coincide respectively with the time-divisional channels U3', U6', U1', U4', U7', U2', U5', L1, L2, L3, L4, L5, L6, L7, and P1, of FIG. 2(G). Each strobe pulse train has a cycle of 48 μs and a pulse duration of 1 μs. The numerals suffixed to the letter t to denote the respective strobe pulses refer to the time slots of (A) in FIG. 2 at which the pulses appear.

In response to these strobe pulses the latch circuits 360-1 through 360-7, 362-1 through 362-7, and 364 latch the corresponding channels of key data N1-B3 and key-on signal KO1 and transform them into D.C. format. The latch circuits deliver their D.C. outputs, both N1-B3 and KO1, to the corresponding tone source and switching circuits 354-1 through 354-7, 356-1 through 356-7, and 358. In these latter circuits the D.C. data sets are converted into tone source signals of required pitches and put out under the switching control of the key-on signal KO1.

After being mixed together, the tone source signals from the first group of tone source and tone keyer circuits 354-1 through 354-7 enter a tone color circuit 366 for the tones of the upper keyboard. The tone color circuit 366 imparts to the mixed tone source signals a tone color or timbre that has been chosen by the performer for the tones of the upper keyboard. How this is done is not disclosed here because it falls outside the purview of this invention.

The tone source signals from the second group of tone source and tone keyer circuits 356-1 through 356-7 are likewise mixed together and then enter another tone color circuit 368 for the tones of the lower keyboard. The tone color circuit 368 also adds to the mixed tone source signals a tone color that has been selected by the player for the tones of the lower keyboard. The tone source signal from the tone source and tone keyer circuit 358 directly enters a pedal keyboard tone color circuit 370, where a desired tone color is imparted to the signal. The output tone signals from the three tone color circuits 366, 368 and 370 are again mixed together by a volume control 372 and then are directed into the audio output system 46 thereby to be translated into audible sound in the well known manner.

Second Form

Figure 11:
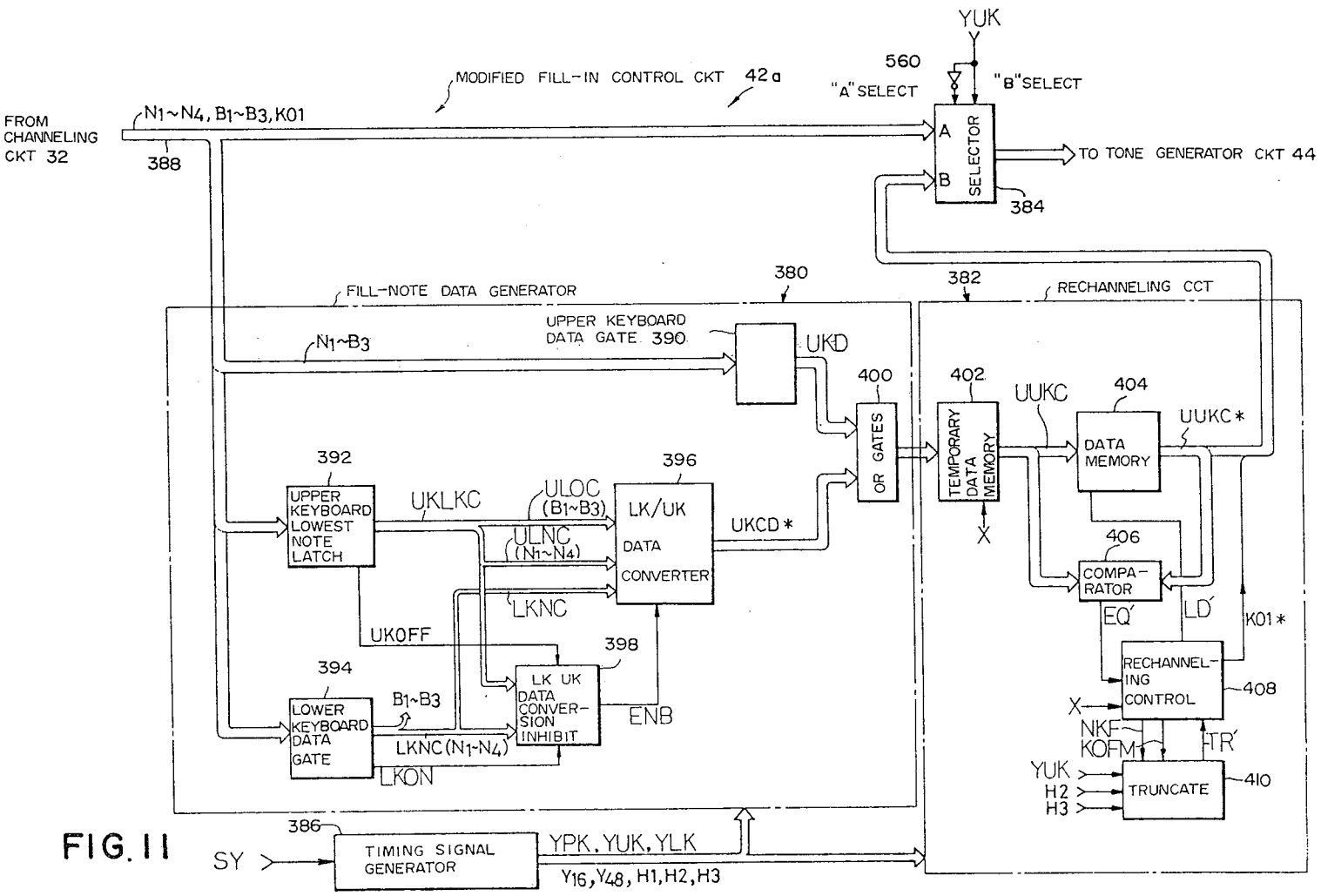
FIG. 11 is a block diagram of a modification of the fill-in control circuit in the instrument of FIG. 1.

Another preferable embodiment of the invention features a modified fill-in control circuit **42*a* of FIG. 11, which may be substituted for the fill-in control circuit 42 in the instrument of FIG. 1. The modified fill-in control circuit 42*a* broadly comprises a fill-note data generator circuit 380, a rechanneling circuit 382, a selector 384, and a timing signal generator 386. The fill-note data generator circuit 380 is so named because its organization and functions are dissimilar from those of the fill-note data forming circuit 70 of the FIGS. 1 through 7** embodiment. As the description progresses, however, it will be appreciated that this and the preceding embodiments are based on exactly the same concept of fill-tone production.

Leading to the fill-note data generator circuit 380 and selector 384 from the channeling circuit 32 of FIG. 1, a bus 388 is for the time-divisional transmission of the channeled key data and key-on signal KO1. By the channeled key data are meant, of course, the successive sets of key-coded key data N1–N4 and B1–B3 that have been assigned to the recurrent series of time-divisional channels comprising a single pedal keyboard channel P1, seven upper keyboard channels U1 through U7, and seven lower keyboard channels L1 through L7. In this modified fill-in control circuit **42*a*, however, the length of each channel (or the duration of each set of key data) need not be 3 μs as (B) in FIG. 2 but 1 μs as (B) in FIG. 12**.

Figure 12:
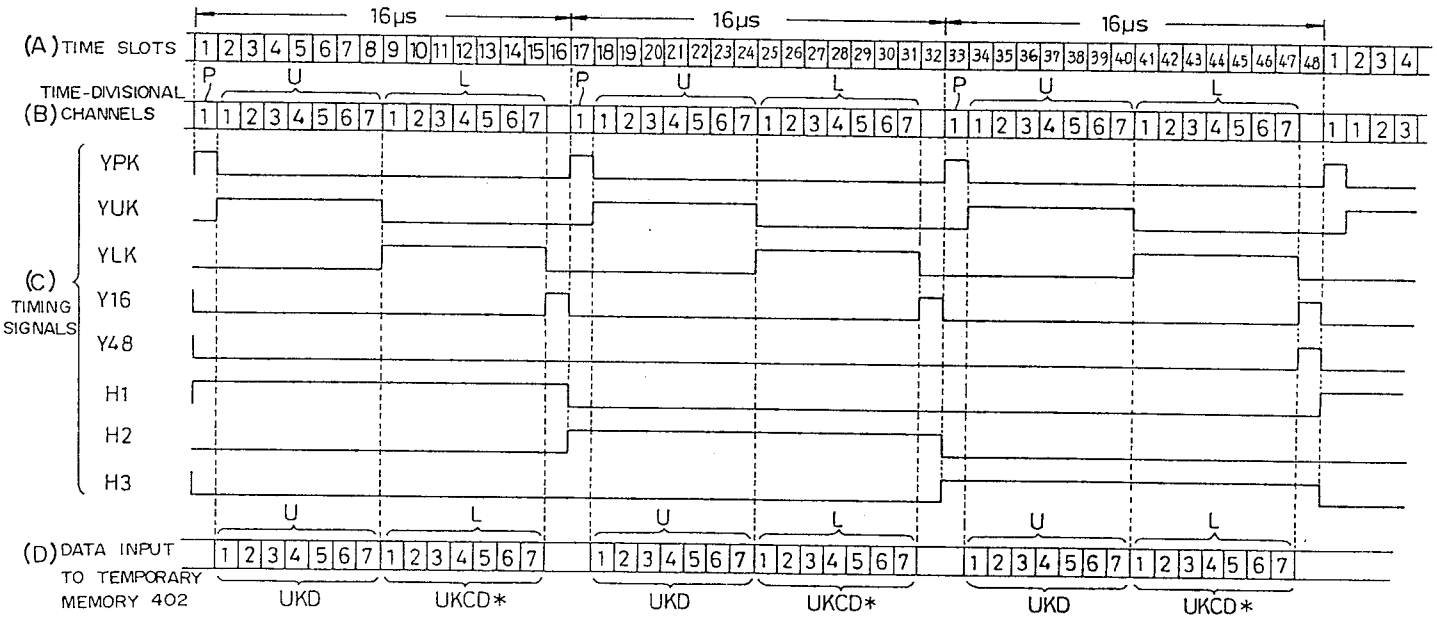
FIG. 12, (A) through (D), is a chart of waveforms and time-divisional channels useful in explaining the operation of the modified fill-in control circuit of FIG. 11.

Chart (A) of FIG. 12, like (A) of FIG. 2, represents one complete sequence of time slots 1 through 48 forming each processing cycle of 48 μs in the channeling circuit 32 of FIG. 1. Chart (B) in FIG. 12 indicates that the complete cycle of interlaced pedal keyboard channel P1, upper keyboard channels U1 through U7, and lower keyboard channels L1 through L7 recurs, with each cycle lasting 16 μs. Chart (C) of FIG. 12 is a time chart of various timing signals YPK, YUK, YLK, Y16, Y48, H1, H2 and H3 generated by the timing signal generator 386. This generator produces these timing signals in response to a train of pulses SY having a cycle of 48 μs, each pulse SY being timed to coincide with the time slot 1.

Referring again to FIG. 11, the fill-note data generator circuit 380 functions to shift the note names of pressed lower keys to different octaves so that the resulting notes may be within an octave below the lowest upper key being pressed at the moment. By so doing the generator circuit 380 puts out key-coded fill-note data representative of fill notes. Receiving the fill-note data from the generator circuit 380, the rechanneling circuit 382 re-assigns the fill-note data to the upper keyboard channels along with the key data representative of the depressed upper keys.

The output from the rechanneling circuit 382, then, represents the key-coded data indicative of both depressed upper keys and fill notes that have been assigned to the upper keyboard channels. The rechanneling circuit 382 delivers this output to the selector 384, through its input B, and thence to the tone generator circuit 44 of FIG. 1 or 10. As has been explained in connection with FIG. 10, the tone generator circuit 44 has the set of sounding channels (tone processing channels) for the notes of the upper keyboard. Not only the notes of the depressed upper keys but also the fill notes are transformed into tone signals through the set of upper keyboard sounding channels in the tone generator circuit 44.

Admitted directly into the selector 384 through its input A, on the other hand, are those sets of key data N1-B3 which have been assigned to the lower keyboard and pedal keyboard channels, as well as the associated key-on signal KO1. The selector 384 also delivers such information to the tone generator circuit 44, which converts the key data representative of the depressed lower and pedal keys into tone signals through the sounding channels for the lower and pedal keyboards.

FIG. 11 further shows the general configuration of the fill-note data generator circuit 380 and of the rechanneling circuit 382. Included in the fill-note data generator circuit 380 is an upper keyboard data gate 390 receiving only the key data N1-B3 from the channeling circuit 32. An upper keyboard lowest note latch circuit 392 and a lower keyboard data gate 394 accept both the key data N1-B3 and the key-on signal KO1 from the channeling circuit 32.

The upper keyboard data gate 390 permits the passage therethrough of only those sets of key data N1-B3 which have been assigned to the upper keyboard channels U1 through U7, FIG. 12(B), and which, therefore, represent the depressed upper keys. The upperkey data thus obtained are designated UKD.

On receipt of two or more sets of key data N1-B3 during each series of upper keyboard channels U1 through U7, the upper keyboard lowest note latch circuit 392 detects the lowest note one of the pressed upper keys and stores, and puts out, that set of input key data which corresponds to the lowest depressed upper key. The output from this latch circuit 392 is termed the lowest-depressed-upper-key data and designated UKLKC.

It will be seen that the lowest-depressed-upper-key data UKLKC put out by the latch circuit 392 consist of octave-coded data ULOC (the bits B1–B3), indicative of the octave to which each lowest depressed upper key belongs, and note-coded data ULNC (the bits N1–N4) indicative of the note name of the lowest depressed upper key. Such octave-coded data ULOC and note-coded data ULNC are separately admitted into an LK/UK data converter circuit 396.

The lower keyboard data gate 394 allows the passage therethrough of only those sets of key data N1-B3 which have been assigned to the lower keyboard channels L1 through L7 and which, therefore, represent the depressed lower keys, as well as of the associated key-on signal KO1. The note-coded data LKNC (the bits N1–N4) included in the output from the lower keyboard data gate 394 enter both the LK/UK data converter circuit 396 and an LK/UK data conversion inhibit circuit 398.

The LK/UK data converter circuit 396 has it as an object to alter the octave-coded data of each depressed lower key so that the resulting note may fall within an octave below the lowest depressed upper key at the moment. The converter circuit 396 thus creates key-coded fill-note data, labeled UKCD*, representative of desired fill notes. To this end the converter circuit 396 makes comparison between the note-coded data LKNC of each depressed lower key and the note-coded data ULNC of the lowest depressed upper key. If the lowest pressed upper key is of a note name higher than that of the pressed lower key, the converter circuit 396 puts out a set of fill-note data UKCD* by adding the octave-coded data set ULOC of the lowest depressed upper key to the note-coded data set LKNC of the depressed lower key. The lowest depressed upper key may be of a note name the same as, or lower than, that of the depressed lower key. In such cases the converter circuit 396 produces a set of fill-note data UKCD* by adding to the note-coded data set LKNC of the pressed lower key an octave-coded data set (ULOC-1) indicative of an octave just below the one to which the lowest depressed upper key belongs.

It is undesirable, however, to sound the fill notes if they are the same as, or a semi-tone or a whole-tone below, the note of the lowest depressed upper key. The LK/UK data conversion inhibit circuit 398 functions in such cases to prevent the converter circuit 396 from generating the fill-note data representative of the undesired fill notes. Like the converter circuit 396 the inhibit circuit 398 effects comparison between the note-coded data set LKNC of each depressed lower key and the note-coded data set ULNC of the lowest depressed upper key. When the note name of the depressed lower key is the same as, or a semi-tone or a whole-tone below, the note name of the lowest depressed upper key, an enable signal ENB delivered from the inhibit circuit 398 to the converter circuit 396 becomes binary ZERO. The converter circuit 396 is thus prevented from the production of the fill-note data set corresponding to the depressed lower key.

The inhibit circuit 398 also receives an all-upper-key-off signal UKOFF from the upper keyboard lowest note latch circuit 392. The all-upper-key-off signal UKOFF is ONE when no key is being depressed on the upper keyboard. In response to this ONE state of the signal UKOFF the enable signal ENB from the inhibit circuit 398 becomes ZERO thereby inhibiting the production of fill-note data UKCD* by the converter circuit 396.

Further applied to the inhibit circuit 398 is a lower-key-on signal LKON from the lower keyboard data gate 394. This signal LKON is ZERO when no key is being depressed on the lower keyboard. The inhibit circuit 398 responds to this ZERO state of the lower-key-on signal LKON by making ZERO its output signal ENB. Thus the converter circuit 396 puts out no fill-note data when no lower key is being pressed, as when no upper key is being depressed.

The fill-note data generator circuit 380 further includes a network of OR gates 400, through which the fill-note data UKCD* from the converter circuit 396 travel on to the rechanneling circuit 382. The upper-key data UKD from the upper keyboard data gate 390 are also fed through the OR gates 400 to the rechanneling circuit 382. As will be detailed presently, the fill-note data UKCD* are assigned to the lower keyboard channels L1 through L7, whereas the upper-key data UKD are of course allotted to the upper keyboard channels U1 through U7. Consequently the OR gates 400 timedivisionally pass the fill-note data UKCD* and upper-key data UKD therethrough, for delivery from the fill-note data generator circuit 380 to the rechanneling circuit 382.

The rechanneling circuit 382 re-assigns the input fill-note data UKCD* and upper-key data UKD to the upper keyboard channels. Included in this circuit 382 is a temporary data memory 402 for alteration of the duration of each incoming set of key-coded fill-note data UKCD* and upper-key data UKD into that (e.g., approximately 48 μs) required for subsequent rechanneling of such data. To this end the temporary memory 402 temporarily stores the successively incoming sets of data UKCD* and UKD and puts them out, one by one, over the periods of time required for their subsequent processing. The output data UKCD* and UKD from the temporary memory 402 are combinedly designated UUKC.

The output data UUKC from the temporary memory 402 enter both a data memory 404 and a comparator circuit 406. The memory 404 has at least seven storage locations corresponding to the respective upper keyboard channels U1 through U7. The data sets assigned to these channels U1 through U7 are stored in the corresponding storage locations. The data UUKC thus rechanneled and stored in the memory 404 are designated UUKC*.

The comparator circuit 406 compares the data UUKC being put out by the temporary memory 402, with the rechanneled data UUKC* being fed from the memory 404. Upon coincidence of the data UUKC and UUKC* the comparator circuit 406 delivers a coincidence pulse EQ' to a rechanneling control circuit 408. If each data set UUKC put out by the temporary memory 402 has been registered on neither of the channels U1 through U7, the control circuit 408 applies to the memory 404 a load pulse LD' indicative of a blank (empty, available) channel (i.e., a channel on which no data UUKC* are registered) or of a channel to be truncated. On receipt of the load pulse LD' the memory 404 stores the data set UUKC in its storage location corresponding to the channel indicated by the load pulse. The control circuit 408 also produces a key-on signal KO1* representative of whether the keys of the rechanneled data UUKC* are being depressed or not.

Also applied to the temporary memory 402 and the control circuit 408 are the key-off check pulses X which, as has been described in connection with FIG. 1, are generated by the key coder 26 in order to ascertain key release. The temporary memory 402 suspends the production of the data UUKC during the receipt of each key-off check pulse X. During each such time the control circuit 408 operates to detect key release from the non-delivery, from the fill-note data generator circuit 380, of the data UKD and UKCD* that have been delivered therefrom.

A truncate circuit 410 is for the detection of that one of the channels U1 through U7 to which has been assigned the data set corresponding to the earliest released key. The channel truncate signal TR' put out by this circuit 410 indicates such a channel. The control circuit 408 produces the load pulse LD' indicative of the channel specified by the channel truncate signal TR'.

It is now clear that the output from th rechanneling circuit 382 comprises the rechanneled data UUKC* (composed of both upper-key data UKD and fill-note data UKCD*) and the key-on signal KO1*. This output from the rechanneling circuit 382 is directed to the input B of the selector 384.

Delivered to the two control inputs of the selector 384 is the upper keyboard timing signal YUK, FIG. 12(C), from the timing signal generator 386. As is apparent from FIG. 12, this timing signal YUK is ONE during the upper keyboard channels U1 through U7 and ZERO during the lower keyboard channels L1 through L7 and pedal keyboard channel P1. The selector 384 selects its input B during the ONE state of the timing signal YUK, so that the channeled data UUKC* and the corresponding key-on signal KO1* from the rechanneling circuit 382 travel through the selector toward the tone generator circuit 44.

During the ZERO state of the timing signal YUK, on the other hand, the selector 384 selects its input A, permitting the passage therethrough of the key data N1-B3 and key-on signal KO1 from the channeling circuit 32, FIG. 1. The timing signal YUK is ZERO, as aforesaid, during each series of lower keyboard channels L1 through L7 and the subsequent pedal keyboard channel P1. Thus the selector 384 allows the passage therethrough of only those sets of key data N1-B3 which have been assigned to the channels L1 through L7 and P1 and which, therefore, represent pressed lower and pedal keys, as well as the key-on signal KO1 accompanying such data.

Fill-Note Data Generator

Figure 13:
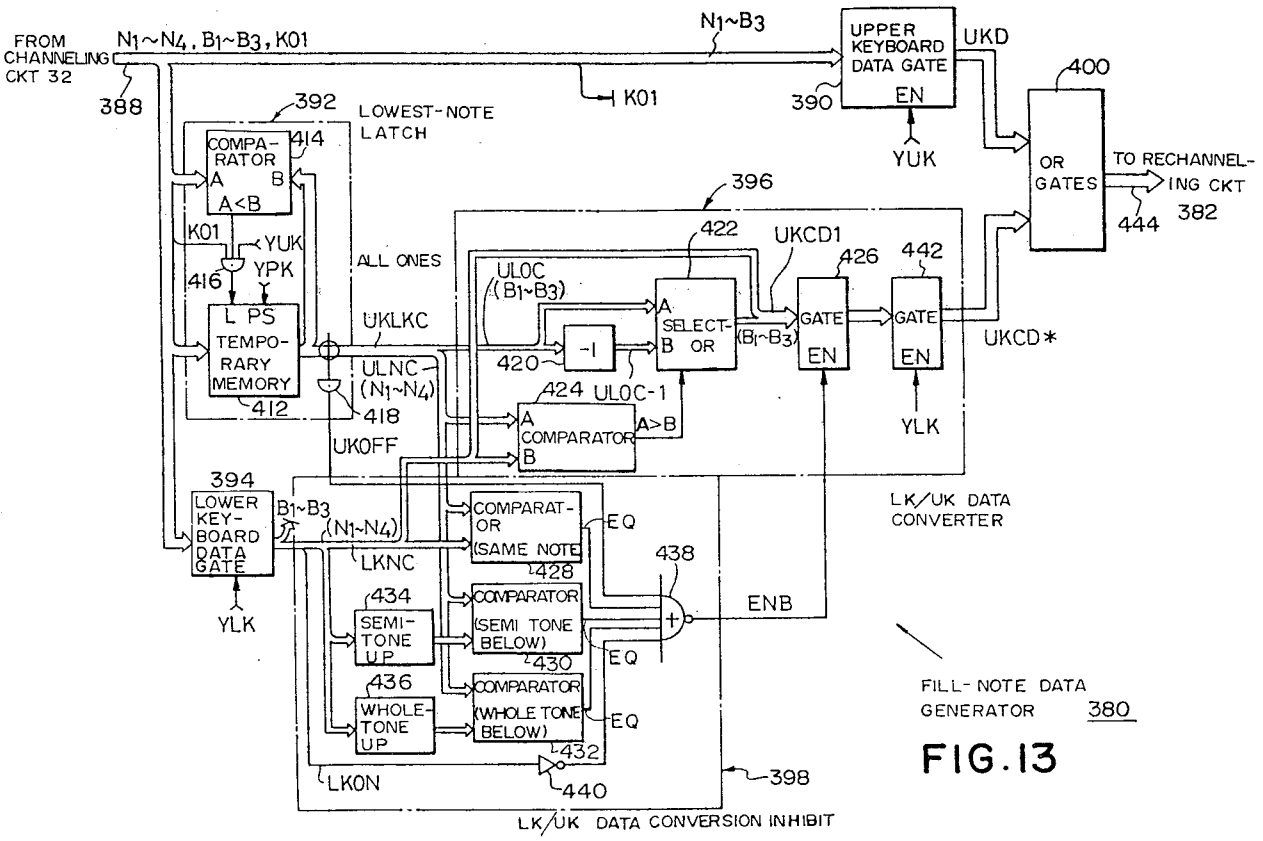
FIG. 13 is a partly block and partly schematic diagram showing in greater detail the fill-note data forming circuit in the modified fill-in control circuit of FIG. 11.

FIG. 13 is a partly block and partly schematic diagram showing in further detail the fill-note data generator circuit 380 in the modified fill-in control circuit 42*a* of FIG. 11. It will be observed, first of all, that the upper keyboard timing signal YUK enters the enable input EN of the upper keyboard data gate 390. The binary state of this upper keyboard timing signal YUK has been explained in connection with the selector 384 of FIG. 11. It is therefore apparent that the gate 390 allows the passage therethrough of only those sets of key data N1-B3 on the bus 388 which have been assigned to the upper keyboard channels U1 through U7.

The upper keyboard lowest note latch circuit 392 comprises a temporary memory circuit 412, a comparator circuit 414, and AND gates 416 and 418. Receiving the key data N1-B3 by way of the bus 388, the temporary memory circuit 412 stores and puts out the key-coded lowest-depressed-upper-key data UKLKC. The comparator circuit 414 accepts (A) the key data N1-B3 from the bus 388 and (B) the lowest-depressed-upper-key data UKLKC from the temporary memory circuit 412. Comparing these inputs A and B, the comparator circuit 414 produces a ONE output when each incoming set of key data N1-B3 is less than the set of data UKLKC stored in the memory circuit 412, i.e., when the key data set N1-B3 represents a note lower than the note of the lowest pressed upper key in storage.

The comparator circuit 414 delivers its output to one of the three inputs of the AND gate 416. Directed to the other two inputs of the AND gate 416 are the key-on signal KO1 on the bus 388 and the upper keyboard timing signal YUK, FIG. 12(C). The output from the AND gate 416 enters the read control input L of the temporary memory circuit 412.

Since the upper keyboard timing signal YUK is input to the AND gate 416, the read control input L of the temporary memory circuit 412 receives from the comparator circuit 414 only the results of comparison of the notes of pressed upper keys with the note of the lowest pressed upper key in storage. Further, as the key-on signal KO1 is also input to the AND gate 416, the read control input of the temporary memory circuit receives only the results of comparison of the notes of the keys being pressed, with the note of the lowest depressed upper key in storage. The inputting of the key-on signal to the AND gate 416 is necessary because the comparator circuit 414 produces a ONE output when, for example, all the bits of a key data set applied to its input A are ZERO. The AND gate 416 prevents the delivery of this ONE output from the comparator circuit 414 to the temporary memory circuit 412, since then the key-on signal KO1 is ZERO.

The temporary memory circuit 412 has a preset input PS. On receipt of a ONE signal through this preset input PS the temporary memory circuit 412 is preset with a data set consisting of ONEs only. Applied to the preset input PS of the temporary memory circuit 412 is the pedal keyboard timing signal YPK, FIG. 12(C), from the timing signal generator 386. The pedal keyboard timing signal YPK is in a ONE state only during the pedal keyboard channel P1 which precedes each series of upper keyboard channels U1 through U7. The temporary memory circuit 412 is therefore preset with a data set of all ONEs immediately before it receives the key data N1-B3 assigned to each series of upper keyboard channels U1 through U7.

Thus, during each series of upper keyboard channels U1 through U7, the data set introduced into the input B of the comparator circuit 414 from the temporary memory circuit 412 is unfailingly greater than the first set of key data N1-B3 which enters its input A and which represents an upper key being depressed. The AND gate 416 permits the delivery of the resulting ONE output from the comparator circuit 414 to the read control input L of the temporary memory circuit 412. The temporary memory circuit responds by storing the first set of key data representative of the upper key being pressed.

Thereafter the comparator circuit 414 compares this first set of key data, in storage in the temporary memory circuit 412, with the next key data set representative of another upper key being depressed. If this second key data set represents a note lower than that of the first, the comparator circuit 414 causes the temporary memory circuit 412 to store the second set. The key data set in storage in the temporary memory circuit 412 at the end of each series of upper keyboard channels U1 through U7, then, represents the lowest of all the upper key notes represented by the data sets incoming during the series of channels.

The output produced by the temporary memory circuit 412, or by the upper keyboard lowest note latch circuit 392, at the end of each series of upper keyboard channels U1 through U7 is, therefore, the desired lowest-depressed-upper-key data UKLKC. The latch circuit 392 continues the production of the same set of lowest-depressed-upper-key data UKLKC during the subsequent series of lower keyboard channels L1 through L7.

When no upper key is being depressed, the AND gate 416 functions as aforesaid to prevent the delivery of the output from the comparator circuit 414 to the temporary memory circuit 412. The temporary memory circuit 412 holds the preset data set of all ONEs. The AND gate 418 inputs all the bits of the output data set from the temporary memory circuit 412. Therefore, when the output data set from the temporary memory circuit 412 is of all ONEs, the AND gate 418 puts out an all-upper-key-off signal UKOFF of a ONE state, indicative of the fact that no upper key is being depressed.

The lower keyboard data gate 394 is under the gating control of the lower keyboard timing signal YLK, FIG. 12(C), which is in a ONE state only during each series of lower keyboard channels L1 through L7. The gate 394 allows the passage therethrough of only those sets of key data N1-B3 which have been assigned to the lower keyboard channels, and of the corresponding key-on signal KO1. It is to be noted that the fill-note data generator circuit 380 makes no use of the octave-coded data B1-B3 included in the output from the gate 394. Only the note-coded data N1-N4 of pressed lower keys enter both the LK/UK data converter circuit 396 and the LK/UK data conversion inhibit circuit 398. Such lower-key-note data are designated LKNC.

In the LK/UK data converter circuit 396 of FIG. 13, the octave-coded portions ULOC (the bits B1-B3) of the lowest-depressed-upper-key data UKLKC from the latch circuit 392 enter a subtracter 420 and the input A of a selector 422. On receipt of each set of octave-coded data ULOC, indicative of the octave embracing the lowest depressed upper key at the moment, the subtracter 420 creates a set of octave-coded data ULOC-1 representative of the octave just below that of the lowest depressed upper key. The octave-coded data ULOC-1 are fed to the input B of the selector 422.

A comparator 424 included in the converter circuit 396 receives (A) the note-coded portions ULNC (the bits N1-N4) of the lowest-depressed-upper-key data UKLKC from the latch circuit 392 and (B) the lower-key-note data LKNC from the lower keyboard data gate 394. The output from the comparator 424 enters the control input of the selector 422. The comparator 434 produces a ONE output when $A > B$, and a ZERO output when $A \leqq B$. The selector 422 selects its input A in response to the ONE output from the comparator 424, and its input B in response to the ZERO output from the comparator.

What follows is the discussion, in more concrete terms of the above outlined functions of the selector 422 and comparator 424. The comparator 424 judges whether or note the name of each depressed lower key, as represented by the lower-key-note data LKNC from the gate 394, is lower than the note name of the lowest depressed upper key as represented by the lowest-depressed-upper-key-note data ULNC from the latch circuit 392. The comparator 424 produces a ONE output when the depressed lower key is of a note name lower than that of the lowest depressed upper key. In response to this ONE output from the comparator 424 the selector 422 selects its input A, permitting the passage therethrough of the octave-coded data ULOC representative of the octave to which the lowest depressed upper key belongs.

On the other hand, when the depressed lower key bears a note name the same as, or higher than, that of the lowest depressed upper key, the comparator 424 produces a ZERO output. This ZERO output causes the selector 422 to select its input B. Consequently there passes through the selector 422 the octave-coded data ULOC-1 representative of the octave just below the one to which the lowest depressed upper key belongs.

In this manner the selector 422 selectively puts out the octave-coded data ULOC or ULOC-1. In FIG. 13 such selector output is designated B1–B3 since the designation applies to both ULOC and ULOC-1. On emerging from the selector 422 the octave-coded data B1–B3 combine with the lower-key-note data LKNC from the gate 394, thereby forming key-coded data UKCD1 representative of fill notes falling within an octave below the lowest depressed upper key at every moment.

The key-coded data UKCD1 subsequently enter a gate 426 in the converter circuit 396. Applied to the enable input EN of the gate 426 is an enable signal ENB from the LK/UK data conversion inhibit circuit 398 for gating the key-coded data UKCD1.

The inhibit circuit 398 includes three comparators 428, 430 and 432. All these comparators receive, each through one of the two inputs, the lowest-depressed-upper-key-note data ULNC from the latch circuit 392. The other input of the comparator 428 takes in the lower-key-note data LKNC directly from the gate 394. The other inputs of the comparators 430 and 432 receive the lower-key-note data LKNC via a semi-tone up circuit 434 and a whole-tone up 436, respectively. The semi-tone up circuit 434 functions to alter each incoming set of lower-key-note data LKNC into that indicative of a note semi-tone above that represented by the original data set. The whole-tone up circuit 436 likewise functions to transform each incoming set of lower-key-note data LKNC into that indicative of a note whole-tone above that of the original data set.

As has been already explained in conjunction with Table 1, the note code for use in the practice of this invention does not include equivalents to decimal "4", "8", "12" and "16(0)". Thus, for obtaining sets of note-coded data representative of notes that are a semi-tone above D♯, F♯, A and C, two may be added to the data sets representative of these note names. For the other note names, one may be added to their data sets in order to obtain notes a semi-tone above. Further, for obtaining data sets representative of notes that are whole-tone above C♯, E, G and A♯, two may be added to the data sets representative of these note names. Three may be added to the data sets representative of the other note names in order to provide notes whole-tone above.

The comparator 428 produces a ONE output EQ upon coincidence of the note name of the lowest depressed upper key with that of each depressed lower key. The comparator 430 produces a ONE input EQ when the note name of the lowest depressed upper key is a semi-tone above that of each depressed lower key. The comparator 432 produces a ONE output EQ when the note name of the lowest depresssed upper key is a whole-tone above that of each depressed lower key.

All these outputs EQ from the comparators 428, 430 and 432 enter a NOR gate 438 included in the inhibit circuit 398. The NOR gate 438 delivers an enable signal ENB to the enable input EN of the gate 426 in the converter circuit 396. The enable signal ENB becomes ZERO in response to the ONE output EQ from either of the three comparators 428, 430 and 432, thereby blocking the passage of the key-coded data UKCD1 through the gate 426.

It is thus seen that the comparator 428 is effective to prevent the passage of the data UKCD1 through the gate 426 upon agreement of the lowest-depressed-upper-key-note data ULNC and the lower-key-note data LKNC. In this case, as has been pointed out in connection with the converter circuit 396, the output from the comparator 424 is ZERO, causing the selector 422 to select the octave-coded data ULOC-1. The set of key-coded data UKCD1 at this time represents, therefore, a note that bears the same name as the lowest depressed upper key but which is an octave below. The comparator 428 prevents this set of data UKCD1 from passing the gate 426.

The comparator 430 functions to prevent the further processing of the data UKCD1 when the lowest-depressed-upper-key-note data ULNC agree with the data indicative of a note name that is a semi-tone above that represented by the lower-key-note data LKNC. Since then the note name of the depressed lower key in question is a semi-tone below that of the lowest depressed upper key, the output from the comparator 424 is ONE, causing the selector 422 to select the octave-coded data ULOC. The resulting set of data UKCD1 represents, therefore, the note that is a semi-tone below that of the lowest depressed upper key. The comparator 430 causes the gate 426 to block the passage of this data set UKCD1 therethrough.

The comparator 432 serves the purpose of detecting coincidence between the lowest-depressed-upper-key-note data ULNC and the data indicative of a note name that is a whole-tone above that represented by the lower-key-note data LKNC. Then the note name of the depressed lower key in question is a whole-tone below that of the lowest depressed upper key, so that the output from the comparator 424 is also ONE , causing the selector 422 to select the octave-coded data ULOC. The resulting set of data UKCD1 represents the note that is a whole-tone below that of the lowest depressed upper key. The comparator 432 causes the gate 426 to block the passage of this data set UKCD1 therethrough.

In addition to the outputs EQ from the comparators 428, 430 and 432, the NOR gate 438 receives (1) the all-upper-key-off signal UKOFF from the AND gate 418 in the upper keyboard lowest note latch circuit 392, and (2) the output from an inverter 440 to which is input the lower-key-on signal LKON selected by the lower keyboard data gate 394. The enable signal ENB from the NOR gate 438 is also ZERO, therefore, when no upper key is being depressed (the all-upper-key-off signal UKOFF in a ONE state), and when no lower key is being depressed (the lower-key-on signal LKON in a ZERO state). The gate 426 of course becomes nonconductive in response to this ZERO output from the NOR gate 438.

In the LK/UK data converter circuit 396 the key-coded data UKCD1 that have been gated through the gate 426 as above subsequently enter another gate 442. Applied to the enable input EN of this gate 442 is the lower keyboard timing signal YLK, FIG. 12(C), which is in a ONE state during each series of lower keyboard channels L1 through L7. As is apparent from the foregoing, the data UKCD1 are created by adding the octave-coded data ULOC or ULOC-1 to the lower-key-note data LKLC in real time as the latter data LKNC are supplied time-divisionally during each series of lower keyboard channels L1 through L7. Enabled by the lower keyboard tming signal YLK, the gate 442 passes in real time the data UKCD1 on to the OR gates 400 as the desired key-coded fill-note data UKCD*. Thus the converter circuit 396 puts out the fill-note data UKCD* during each series of lower keyboard channels L1 through L7.

Rechanneling Circuit

Figure 14:
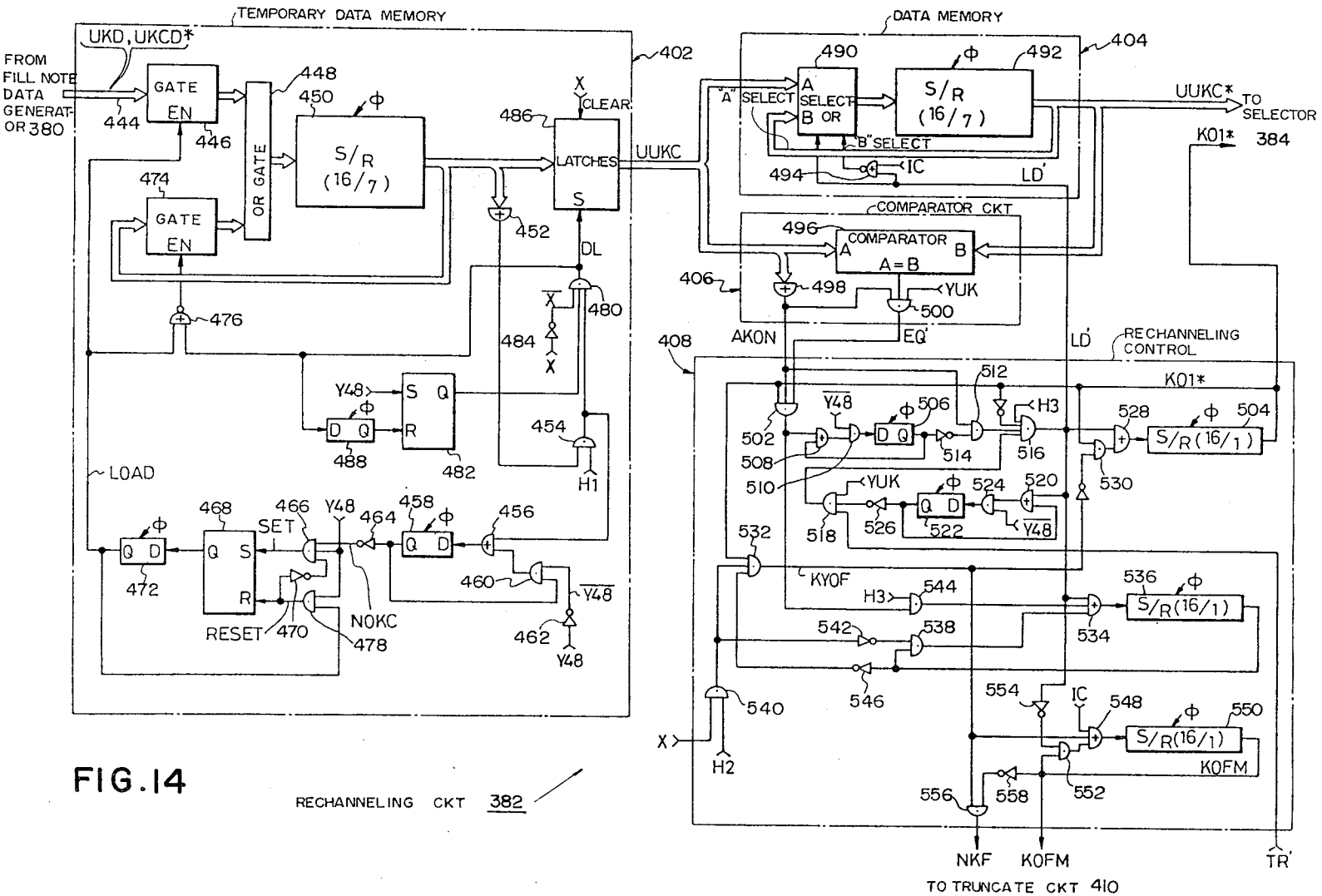
FIG. 14 is a partly block and partly schematic diagram showing in greater detail the rechanneling circuit in the modified fill-in control circuit of FIG. 11.

FIG. 14 is a detailed diagram of the rechanneling circuit 382, or more specifically of its temporary data memory 402, data memory 404, comparator circuit 406, and rechanneling control circuit 408. The upper-key data UKD and fill-note data UKCD* travel from the OR gates 400, FIG. 13, through a base 444 and, on reaching the rechanneling circuit 382, first enter a gate 446 in the temporary memory 402.

Before proceeding further with the discussion of the rechanneling circuit 382, the timing of the incoming upper-key data UKD and fill-note data UKCD* will be briefly explained with reference to FIG. 12(D). It will be noted that the upper-key data UKD are supplied during each series of upper keyboard channels U1 through U7, and the fill-note data UKCD* during each series of lower keyboard channels L1 through L7. Each set of data UKD or UKCD* has a duration of 1 μs. These data UKD and UKCD*, moreover, are fed repeatedly with a cycle of 16 μs. The temporary memory 402 has it as an object to extend the 1-μs duration of each incoming set of data into approximately 48 μs, in order to make possible the subsequent rechanneling of such data.

With reference back to FIG. 14 the data UKD and UKCD* travel from the gate 446 to a network of OR gates 448 and thence to a 16-stage/7-bit shift register 450 for storage therein. Under the shift control of the clock pulses $\phi$ having cycle of 1 μs, the shift register 450 stores and feeds out the data UKD and UKCD* in the following manner and with the aid of the following means.

Receiving the output from the shift register 450, an OR gate 452 delivers its output to one of the two inputs of an AND gate 454. Applied to the other input of this AND gate is the timing signal H1, (C) in FIG. 12, from the timing signal generator 386. The timing signal H1 remains ONE during the first 16 μs of each 48-μs processing cycle. The output from the AND gate 454 is ZERO, therefore, during the first 16 μs of each processing cycle if the shift register 450 has no data stored in its 16 stages.

The output from the AND gate 454 enters an OR gate 456 via its first input and thence a delay flip-flop 458. The second input of the OR gate 456 receives the output from an AND gate 460. Fed to one of the two inputs of this AND gate 460 is the output from the delay flip-flop 458, so that this flip-flop holds its output through the OR gate 456 and AND gate 460 connected in circuit therewith. The other input of the AND gate 460 receives the signal $\overline{Y48}$ obtained by inverting, by an inverter 462, the timing signal Y48, FIG. 12(C), from the timing signal generator 386. The timing signal Y48, before being inverted, is ONE only during the last 48th time slot of each processing cycle, so that the holding circuit is opened at each 48th time slot. Since, as aforesaid, the AND gate 454 produces no ONE output as long as the shift register 450 has no data stored therein, the output from the delay flip-flop 458 also remains ZERO.

Besides being fed back to the AND gate 460, the output from the delay flip-flop 458 is delivered to an inverter 464 thereby to be inverted. It will be evident that if the output from the inverter 464 is ONE at each 48th time slot, no data UKD or UKCD* have been stored in the shift register 450. This output from the inverter 464 is designated NOKC, suggesting, when in a ONE state, the storage of no data in the shift register 450.

The output NOKC from the inverter 464 enters a three-input AND gate 466. Another input of this AND gate receives the timing signal Y48, and still another input thereof receives, via an inverter 470, the input to the reset input R of a flip-flop 468. The AND gate 466 delivers its output to the set input S of the flip-flop 468. Thus, if the output NOKC from the inverter 464 is ONE when the flip-flop 468 is in a reset condition, the AND gate 466 produces a ONE output at every 48th time slot, thereby setting the flip-flop 468.

Figure 15:
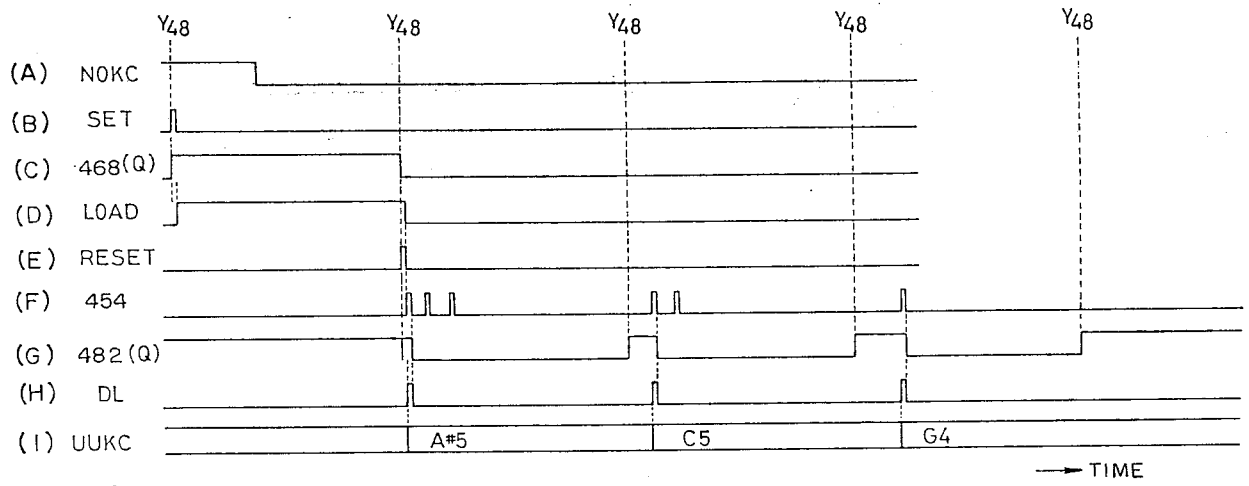
FIG. 15, (A) through (I), is a chart of waveforms appearing at various stages in the temporary data memory shown in detail in FIG. 14.

FIG. 15 is illustrative of such operation of the inverter 464, AND gate 466, flip-flop 468, etc. In this FIGURE, (A) represents an example of the output NOKC from the inverter 464, (B) the corresponding set signal SET and the AND gate 466, and (C) the corresponding output state of the flip-flop 468.

The output Q from the flip-flop 468 enters a delay flip-flop 472, thereby to be delayed by 1 μs. The delay flip-flop 472 delivers its output to (1) the enable input EN of the gate 446 as a load signal LOAD, (2) the enable input EN of another gate 474 via a NOR gate 476 as a load signal, and (3) one of the two inputs of an AND gate 478. The output LOAD from the delay flip-flop 472 is given at (D) in FIG. 15.

Applied to the other input of the AND gate 478 is the timing signal Y48 set forth already. Thus, if the flip-flop 468 has been in a set condition for 48 μs, the timing pulse Y48 generated upon lapse of this 48 μs causes the AND gate 478 to apply a reset pulse RESET, (E) in FIG. 15, to the flip-flop 468 thereby resetting same. The AND gate 478 has its output coupled also to the AND gate 466 via the inverter 470, so that the reset pulse RESET makes the AND gate 466 nonresponsive to the other inputs. The reset signal has priority over the set signal. Thus the flip-flop 468 is forcibly reset upon lapse of 48 μs, limiting the duration of the load pulse LOAD to the same length of time.

The load signal LOAD from the delay flip-flop 472 is fed directly to the enable input EN of the gate 446 and, via the NOR gate 476, to the enable input EN of the other gate 474. Connected between shift register 450 and OR gates 448, the gate 474 serves the purpose of holding the data stored in the shift register. The gate 446 is conductive, and the other gate 474 nonconductive, during the ONE state of the load signal. It is thus seen that the shift register 450 accepts and stores the upper-key data UKD and fill-note data UKCD* from the fill-note data generator circuit 380 during the ONE state of the load signal LOAD.

When the key-coded data UKD or UKCD* stored in the shift register 450 emerge from its final stage, the output from the OR gate 452 becomes ONE. This ONE output from the OR gate 452 is allowed to pass the AND gate 454 during the ONE state of the timing signal H1, i.e., during the first 16 μs of each 48-μs processing cyle. The output from the AND gate 454 is plotted in FIG. 15(F) on the assumption that three sets of data have been stored in the shift register 450.

The output from the AND gate 195 enters one of the three inputs of an AND gate 480, in addition to the OR gate 456. Another input of the AND gate 480 receives the output from a flip-flop 482, and still another input of the AND gate receives a signal $\overline{X}$ formed by inverting the key-off check signal $\overline{X}$ by an inverter 484. The flip-flop 482 has the timing signal Y48 fed to its set input S and is thereby set periodically at each 48th time slot. The output from this flip-flip 482 is therefore ONE at other times. The signal X is also ONE when the key coder 26, FIG. 1, does not put out the key-off check pulses.

On receipt of the first output pulse from the AND gate 454, therefore, the AND gate 480 puts out a corresponding pulse, termed a data latch pulse DL, shown at (H) in FIG. 15. The data latch pulse DL enters, on one hand, the strobe input S of a latch circuit 486 receiving the output data from the shift register 450. In response to the data latch pulse DL the latch circuit 486 latches one set of data incoming from the shift register 450. The data latch pulse DL enters, on the other hand, the NOR gate 476 thereby making its output ZERO. With the gate 474 thus disabled, the shift register 913 is cleared of the data set latched by the latch circuit 486.

The data latch pulse DL is intended to attain an additional object of making the AND gate 480 nonresponsive to the output from the AND gate 454 after its production from the AND gate 480. Toward this end the data latch pulse DL is directed to a delay flip-flop 488, thereby to be delayed for a preset brief period of time, and thence to the reset input R of the flip-flop 482. As the output from this flip-flop 482 becomes ZERO as in FIG. 15(G), the AND gate 480 becomes nonresponsive to the output from the AND gate 454. Thus, during the initial 16 μs of each 48-μs processing period, the AND gate 480 puts out only one data latch pulse DL.

With the generation of one data latch pulse DL as above, one set of data becomes latched in the latch circuit 486 and deleted from the shift register 450. During the next ONE state of the timing signal H1, therefore, the AND gate 454 puts out two pulses, as shown at (F) in FIG. 15. The AND gate 480 produces a second data latch pulse DL in response to the first of these two pulses, as represented at (H) in FIG. 15. This second data latch pulse also causes the latch circuit 486 to latch the second data set, and the shift register 450 is cleared of this second data set.

During the next ONE state of the timing signal H1 the AND gate 454 puts out only one pulse. The AND gate 480 responds to this pulse by producing a corresponding data latch pulse DL. Then the latch circuit 486 latches the third data set, and this last data set also becomes deleted from the shift register 450.

As long as the shift register 450 has data stored therein, the above process is repeated during the successive periods of 48 μs as in FIG. 15. When the shift register 450 becomes thoroughly unloaded, the load signal LOAD from the delay flip-flop 472 is held in a ONE state for 48 μs, as has been explained, during which fresh sets of upper-key data UKD and fill-note data UKCD* are fed from the fill-note data generator circuit 380 to the shift register 450.

Chart (I) of FIG. 15 shows by way of example three successive sets of key-coded data, generally labeled UUKC in FIG. 14, put out by the latch circuit 486 or by the temporary memory 402. It will be noted that each of these data sets, representative of A#5, C5 and G4 respectively, has an extended duration of approximately 48 μs from one timing pulse Y48 to the next. The last data set, representative of G4, is held latched until the production of the subsequent data latch pulse DL. This presents no problem. All that is necessary is that the duration of each data set be no less than a preassigned minimum (approximately 32 μs covering the two consecutive ONE states of the timing signals H2 and H3 in this particular embodiment) necessary for the subsequent rechanneling operation.

In order to make possible the detection of key release in the subsequent rechanneling operation, the inversion $\overline{X}$ of the key-off check signal X enters the AND gate 480. The key-off check signal X is further utilized to clear the latch circuit 486. During the ONE state of the key-off check signal X, therefore, the AND gate 480 is prevented from the production of data latch pulses DL, and the latch circuit 486 is also restrained from the production of the data UUKC of the extended duration.

The data UUKC from the temporary memory 402 enter both the data memory 404 and the comparator circuit 406. The data memory 404 comprises a selector 490 receiving the input data UUKC through its input A, and a 16-stage/7-bit shift register 492 for storing the data UUKC as they are allowed to pass the selector 490. The input B of this selector receives the output from the shift register 492, enabling the memory 404 to hold the data UUKC.

The selector 490 selects its input A during the ONE state of the load signal LD′ from the rechanneling control circuit 408. The load signal LD′ also enters a first input of a NOR gate 494, whose second input receives the initial clear signal IC. The selector 490 selects its input B during the ONE state of the output from the NOR gate 494. As has been mentioned, the initial clear signal IC is ONE only during a brief length of time immediately following the closure of the power switch, not shown, of the instrument. Normally, therefore, and during the ZERO state of the load signal LD′, the selector 490 selects its input B for holding the data stored in the shift register 492.

In the comparator circuit 406 the data UUKC from the temporary memory 402 enter both the input A of a comparator 496 and all the inputs of an OR gate 498. The input B of the comparator 496 receives the output from the shift register 492 of the memory 404. The comparator 496 produces a ONE output when A=B, i.e., when any set of data UUKC from the temporary memory 402 is the same as one already stored in the memory 404.

Also included in the comparator circuit 406 is a three-input AND gate 500 to which are input (1) the output from the comparator 496, (2) the output from the OR gate 498, and (3) the upper keyboard timing signal YUK, FIG. 12(C), from the timing signal generator 386. The output AKON from the OR gate 498 is ONE when any set of data UUKC is incoming. The AND gate 500 puts out a coincidence pulse EQ', therefore, if the ONE output from the comparator 496 is based on the data UUKC that are assigned to the upper keyboard channels and which are not of all ZEROs.

The shift register 492 in the memory 404 is under the shift control of the clock pulses $\phi$. Thus the comparator 496 completes comparison between the data UUKC and rechanneled data UUKC* of the same channels before each ONE state of the timing signal H3, (C) in FIG. 12.

The comparator circuit 406 directs both the coincidence signal EQ' and data detection signal AKON into the rechanneling control circuit 408. In this circuit 408 the signals EQ' and AKON both enter a three-input AND gate 502. The other one input of the AND gate 502 receives the key-on signal KO1* from a 16-stage/1-bit shift register 504 functioning as a "key-on" memory. If the three inputs to the AND gate 502 are all ONEs during some upper keyboard channel, the resulting ONE output from the AND gate is indicative of the fact that the set of data UUKC being fed at that time is the same as one already assigned to that channel. The load LD' must be ZERO in that instance.

The AND gate 502 delivers its output to a delay flip-flop 506 via an OR gate 508 and AND gate 510. The other input of the OR gate 508 receives the output from the delay flip-flop 506. The other input of the AND gate 510 receives the inversion $\overline{Y48}$ of the timing signal Y48, (C) in FIG. 12. The delay flip-flop 506 also applies its output to one of the two inputs of an AND gate 512 via an inverter 514. The other input of the AND gate 512 receives the data detection signal AKON from the OR gage 498. The output from the AND gate 512 enters one of the four inputs of an AND gate 516, the output from which serves as the load signal LD'. The other three inputs of the AND gate 516 receives (1) the timing signal H3, (2) the inversion of the key-on signal KO1* from the shift register 504, and (3) the channel truncate signal TR' from an AND gate 518.

Each ONE output from the AND gate 502 enters the delay flipflop 506 and is held stored therein until the timing signal Y48, applied to the AND gate 510 as above, becomes ONE at each 48th time slot as (C) in FIG. 12. During such storage of the ONE output from the AND gate 502 in the delay flip-flop 506, the inverter 514 prevents, via the AND gate 512, the other AND gate 516 from producing the load signal LD' of a ONE state.

If an incoming set of data UUKC is unlike any of those already assigned to the upper keyboard channels, the output from the AND gate 502 is of course ZERO. Since then the output from the delay flip-flop 506 is also ZERO, the output from the inverter 514 is ONE. Thus, during the ONE state of the timing signal H3, (C) in FIG. 12, the AND gate 516 puts out one load pulse LD' corresponding to that of the upper keyboard channels U1 through U7 on which the key has been released (KO* in a ZERO state) and which must be truncated.

The channel that should be truncated is indicated by the channel truncate signal TR' from the trancate circuit 410, FIG. 11. The channel truncate signal TR' attains a ONE state in synchronism with the channel to which has been assigned that one of the channeled upper key notes (including fill notes) which corresponds to the earliest released key. Although fill notes do not directly represent the depressed keys, nevertheless they are treated just like ordinary notes when the key-on signal KO1* become ZERO on release of the keys.

Fed to the AND gate 516 via the AND gate 518, the channel truncate signal TR' causes same to put out the aforesaid load pulses LD' in timed relation with the desired upper keyboard channel. The AND gate 516 delivers the load pulse LD' not only to the memory 404 but also to one of the two inputs of an OR gate 520. The output from the OR gate 520 enters a delay flip-flop 522 via an AND gate 524. This AND gate 524 has another input for receiving the inversion $\overline{Y48}$ of the timing signal Y48. The delay flip-flop 522 delivers its output to the AND gate 518 via an inverter 526 on one hand and, on the other hand, to the other input of the OR gate 520.

The delay flip-flop 228 stores the load pulse LD' received from the AND gate 516 via the OR gate 520 and AND gate 525. In response to the corresponding output from the delay flip-flop 228, the inverter 526 makes the AND gate 518, and therefore the AND gate 516, nonresponsive to the other inputs. Consequently the AND gate 516 puts out only one load pulse for the desired one upper keyboard channel. The memory 404 responds as aforesaid to the load pulse LD' by causing the shift register 492 to store the incoming set of data UUKC. The assignment of the data set UUKC to an appropriate one of the upper keyboard channels U1 through U7 is now completed.

The load pulse LD' from the AND gate 516 further enters, via an OR gate 528, the shift register 504 for storage therein as a key-on pulse. The OR gate 528 has another input receiving the output from an AND gate 530. This AND gate 530 receives (1) the output key-on signal KO1* from the shift register 504 and (2) the inversion of a key-off signal KYOF from an AND gate 532. Thus the shift register 504 is capable of holding the ONE state of the key-on signal KO1* via the OR gate 528 and AND gate 530, until the key-off signal KYOF from the AND gate 532 becomes ONE.

Stil further the load pulse LD' from the AND gate 516 enters, via a three-input OR gate 534, another 16-stage/1-bit shift register 536 intended to function as a temporary "key-on" memory. Another input of the OR gate 534 receives the output from an AND gate 538, which in turn receives (1) the output from the shift register 536 and (2) the output from an AND gate 540 via an inverter 542. Input to the AND gate 540 are the key-off check signal X and the timing signal H2, (C) in FIG. 12. When these two inputs to the AND gate 540 are both ONE, the resulting ONE output therefrom opens the self-holding loop of the shift register 536. The shift register 536 is thus cleared of all the data stored in its 16 stages each time the key-off check signal X becomes ONE during the ONE state of the timing signal H2.

The third input of the OR gate 534 receives the output from the AND gate 502 via an AND gate 544, to which is also input the timing signal H3, (C) in FIG. 12. If the memory 404 or comparator circuit 406 subsequently receives, before the next ONE state of the key-off check signal X, the same set of data UUKC as the rechanneled data UUKC*, the resulting ONE output from the AND gate 502 is stored in the shift register 536 via the AND gate 544 and OR gate 534. The ONE input to the shift register 536 means that the key is still being depressed.

A set of data UUKC corresponding to any released key is not supplied again, however, so that the stage of the shift register 536 corresponding to the channel to which the data set has been assigned is held cleared. Therefore, when the key-off check signal X becomes ONE the next time, the shift register 536 produces a ZERO output for the channel in question. In response to this ZERO output an inverter 546 applies a ONE input to the AND gate 532. This AND gate 532 also receives the key-on signal KO1* from the shift register 504, in addition to the output from the AND gate 540. The key-off signal KYOF from the AND gate 532 becomes ONE if the key-on signal KO1* is ONE in spite of the release of the pertinent key.

The key-off signal KYOF from the AND gate 532 enters, via a three-input OR gate 548, still another 16-stage, 1-bit shift register 550 functioning as a "key-off" memory. Fed to the other two inputs of the OR gate 548 are the initial clear signal IC and the output from an AND gate 552. The two inputs of this AND gate 552 receive the output from the shift register 550 and, via an inverter 554, the load signal LD' from the AND gate 516. The key-off signal KYOF also enters one of the two inputs of an AND gate 556, the other input of which receives the output from the shift register 550 via an inverter 558.

Thus, in response to the key-off signal KYOF from the AND gate 532, the shift register 550 puts out a key-off storage signal KOFM, holding this signal via the AND gate 552 and OR gate 548. The shift register 550 is cleared of its output signal KOFM, however, when the AND gate 552 receives the load pulse LD' via the inverter 554. When the key-off signal KYOF becomes ONE, the AND 244 puts out a new-key-off signal NKF of a ONE state, provided that the key-off storage signal KOFM has been ZERO on the channel in question.

Reference is now directed back to FIG. 11 in order to briefly describe the function of the truncate circuit 410. This truncate circuit receives the key-off storage signal KOFM and new-key-off signal NKF from the rechanneling control circuit 408, as well as the timing signals YUK, H2 and H3 from the timing signal generator 386. It will be seen from (C) in FIG. 12 that the timing signal YUK is ONE during each series of upper keyboard channels U1 through U7. The timing signals H2 and H3 are ONE during the second and third 16-μs divisions of each 48-μs processing cycle.

The truncate circuit 410 counts the number of incoming new-key-off pulses, during the ONE state of the upper keyboard timing signal YUK, on each of the upper keyboard channels U1 through U7 where the key-off storage signal KOFM is ONE. The truncate circuit 410 is further equipped to compare, during the ONE state of the timing signal H2, the total numbers of the new-key-off pulses on the respective channels. The maximum of these numbers indicates the earliest release of the key on the channel. The truncate circuit 410 puts out a channel truncate pulse TR' in synchronism with that channel during the ONE state of the timing signal H3.

The rechanneling circuit 382 of the foregoing configuration and operation puts out the key-coded data UUKC* that have been re-assigned to the upper keyboard channels U1 through U7, as well as the key-on signal KO1*. The data UUKC* represent both pressed upper keys and fill notes, as will be recalled upon consideration of the fill-note data generator circuit 380 of FIG. 11 or 13. These outputs from the rechanneling circuit 382 enter the input B of the selector 384.

The selector 384 has a first control input for receiving the upper keyboard timing signal YUK via an inverter 560, and a second control input for directly receiving the signal YUK. On receipt of the inverted upper keyboard timing signal YUK through its first control input the selector 384 selects its input A, during the lower keyboard channels L1 through L7 and the pedal keyboard channel P1. Thus the key data N1-B3, representative of pressed lower and pedal keys, and the key-on signal KO1 travel from the channeling circuit 32, FIG. 1, to the tone generator circuit 44 through the selector 384, thereby essentially bypassing the fill-in control circuit 42*a*.

During the ONE state of the upper keyboard timing signal YUK, on the other hand, the selector 384 selects its input B, allowing the outputs from the rechanneling circuit 382 to pass therethrough. The fill-note and upper-key data UUKC* and key-on signal KO1* travel through the selector 384 during the upper keyboard channels U1 through U7.

The tone generator circuit 44 for use with the modified fill-in control circuit 42*a* of FIG. 11 can be largely of the type shown in FIG. 10. However, the strobe pulses applied to the latch circuits 360-1 through 360-7, 362-1 through 362-7, and 364 in the tone generator circuit 44 must be of different timing from that of the pulses t4, t7, t10, etc., used in FIG. 10. While the strobe pulses of FIG. 10 have been assumed to occur with a recurrent cycle of 3 μs, those for use with the modified fill-in control circuit 42*a* must be timed to coincide with the successive channels P1, U1 through U7, and L1 through L7 of (B) in FIG. 12, each lasting 1 μs.

THIRD FORM

Figure 16:
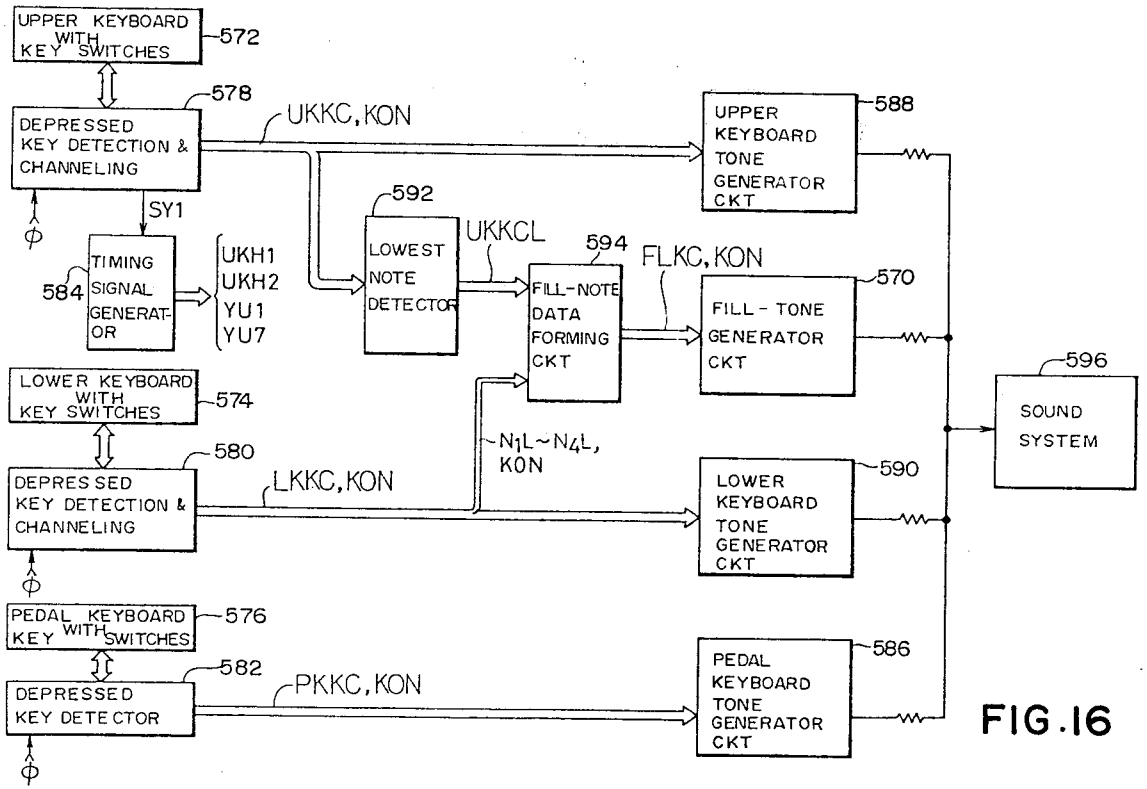
FIG. 16 is a block diagram of another preferred form of the electronic musical instrument in accordance with the invention.

FIG. 16 is a block diagram of still another preferable form of the electronic musical instrument in accordance with this invention. One of the most pronounced features of this embodiment resides in the provision of a tone generator circuit 570 devoted exclusively to the generation of fill tones (hereinafter referred to as the fill-tone generator circuit). By contrast, in the embodiments of FIGS. 1 through 10 and FIGS. 11 through 15, fill-note data were assigned to the upper keyboard channels and voiced through the sounding channels (i.e., the tone source and tone keyer circuits 354-1 through 354-7 of FIG. 10) for the upper keyboard notes.

The modified instrument of FIG. 16 comprises an upper keyboard with its key switches 572 (hereinafter referred to as the upper key switches), a lower keyboard with its key switches 574 (lower key switches), and a pedal keyboard with its key switches 576 (pedal key switches). The upper key switches 572 and the lower key switches 574 are provided with their own depressed key detection and channeling circuits 578 and 580, respectively. The pedal key switches 576 have their own depressed key detector circuit 582.

Functionally, then, the depressed key detector and channeling circuit 578 senses the depression and release of the keys on the upper keyboard from the on/off states of the upper key switches 572. The circuit 578 further functions to assign the notes of the pressed upper keys to selected ones of seven time-divisional channels corresponding to seven sounding channels available for the upper keyboard notes. Thus the channeled key data UKKC representative of pressed upper keys, and the associated key-on signal KON, are put out in step with the successive time-divisional channels.

Figure 17:
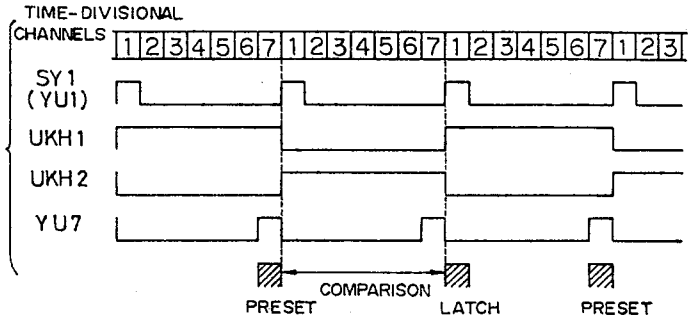
FIG. 17 is a chart of waveforms and time-divisional channels useful in explaining the operation of the instrument of FIG. 16.

FIG. 17 is a representation of the recurrent series of such time-divisional channels, each series consisting of seven channels 1 through 7. Each time-divisional channel is 1 μs long, as determined by the master clock pulses $\phi$ input to the depressed key detection and channeling circuit 578.

An additional function of the depressed key detection and channeling circuit 578 is to generate a train of pulses SY1 in synchronism with the recurring first channels 1. Receiving the pulse train SY1 from the circuit 578, a timing signal generator 584 generates and puts out four timing signals UKH1, UKH2, YU1 and YU7 for various purposes hereinafter set forth. As will be noted from FIG. 17, each of the timing signals UKH1 and UKH2 consists of a train of pulses each having a duration of 7 $\mu$s, equal to one series of time-divisional channels 1 through 7. These timing pulse trains UKH1 and UKH2 alternate, moreover, so that each has a cycle of 14 $\mu$s. The timing signal YU1 consists of a train of pulses timed to synchronize with the recurring first channels 1, like the pulses SY1. The timing signal YU7 consists of a train of pulses timed to coincide with the recurring seventh channel 7.

The other depressed key detection and channeling circuit 580 functions analogously, sensing the depression and release of the keys on the lower keyboard from the on/off states of the lower key switches 574. Further, as in the circuit 578, the notes of the depressed lower keys are assigned to selected ones of each series of seven time-divisional channels corresponding to the sounding channels available for the lower keyboard notes. The circuit 580 puts out the channeled key data LKKC representative of the depressed lower keys, and the associated key-on signal KON, in synchronism with the successive time-divisional channels. The recurrent series of time-divisional channels for the lower keyboard notes are identical with those shown in FIG. 17.

Only one tone can be sounded at one time from the pedal keyboard of this instrument. As any one pedal key is depressed, therefore, the depressed key detector circuit 582 senses the fact from the closure of the corresponding one of the pedal key switches 576 and assigns the note to the single sounding channel. The output key data PKKC from this keying detector circuit 582, representative of a single depressed pedal key at one time, as well as the corresponding key-on signal KON, enter a pedal keyboard tone generator circuit 586 thereby to be translated into a tone signal.

The upper keyboard has its own tone generator circuit 588, and the lower keyboard also has its own tone generator circuit 590. Each of these tone generator circuits 588 and 590 has seven sounding channels for concurrent generation of as many tone signals. In response to the channeled key data UKKC and LKKC and associated key-on signals from the depressed key detection and channeling circuits 578 and 580, the tone generator circuits 588 and 590 produce the tone signals corresponding to the pressed upper and lower keys, respectively.

The depressed key detection and channeling circuit 578 associated with the upper keyboard delivers the channeled upper-key data UKKC and key-on signal KON not only to the tone generator circuit 588 but also to a lowest-note detector circuit 592. This circuit 592 detects, stores, and puts out key-coded data UKKCL indicative of the lowest of the notes of the depressed upper keys represented by the sets of channeled upper-key data UKKC incoming during each series of channels 1 through 7.

The key-coded lowest-pressed-upper-key data UKKCL from the lowest-note detector circuit 592 enter a fill-note data forming circuit 594. Also fed to the fill-note data forming circuit 594, from the keying detector and channeling circuit 580 for the lower keyboard, is the note-coded data N1L-N4L included in the channeled lower-key data LKKC, as well as the key-on signal KON accompanying the lower-key data. The fill-note data forming circuit 594 adds an appropriate set of octave-coded data to each incoming set of note-coded data N1L-N4L in order that the thus-synthesized key-coded fill-note data may represent a fill note falling within an octave below the lowest depressed upper key represented by the corresponding set of lowest-depressed-upper-key data UKKCL. Each set of key-coded fill-note data thus created in the circuit 594 is designated FLKC. Since there are seven sounding channels available for the lower keyboard, the fill-note data forming circuit 594 is equipped to generate seven sets of fill-note data FLKC, representative of the same number of different fill notes, at the maximum.

Thus formed by the circuit 594, the fill-note data FLKC enter the fill-tone generator circuit 570 thereby to be converted into fill-tone signals. The fill-tone generator circuit 570 has, of course, seven sounding channels in anticipation of the maximum possible number of different fill tones that may be sounded at one time.

The four tone generator circuits 570, 586, 588 and 590 deliver their output tone signals to a sounding system 596 for conversion into audible sounds. The fill-tone generator circuit 570 may be interrelated, as desired, with the upper keyboard tone generator circuit 588 to impart the same tone color to the fill tones and upper key tones. It is also possible, however, to apply different tone colors to the fill tones and upper key tones.

Figure 18:
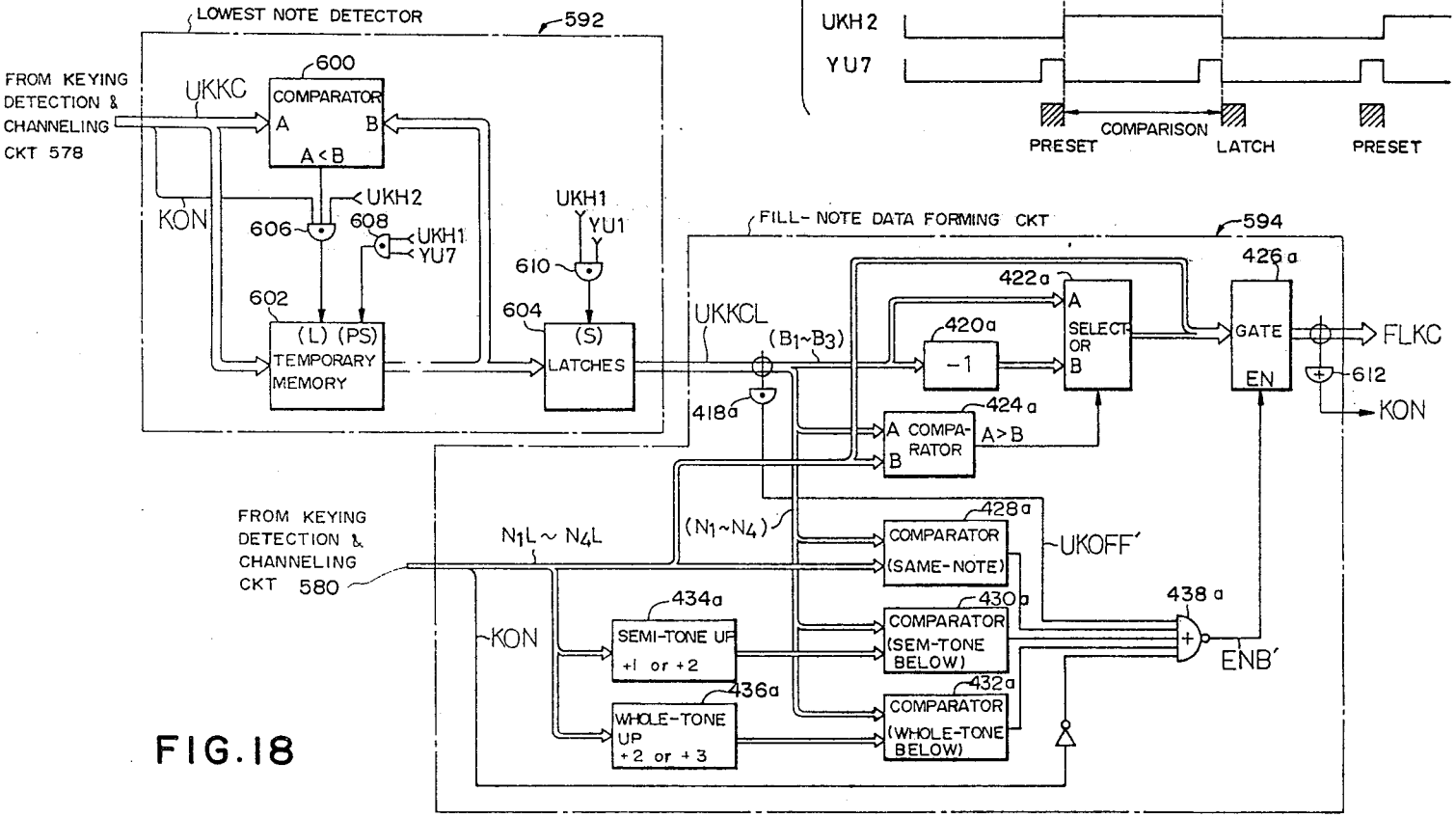
FIG. 18 is a partly block and partly schematic diagram showing in greater detail the lowest-note detector circuit and fill-note data forming circuit in the instrument of FIG. 16.

FIG. 18 is a more detailed representation in block diagrammatic form of the lowest-note detector circuit 592 and of the fill-note data forming circuit 594. The lowest-note detector circuit 592 broadly comprises a comparator 600, a temporary memory circuit 602, and a latch circuit 604. Time-divisionally put out by the keying detection and channeling circuit 578 for the upper keyboard, the channeled upper-key data UKKC enter both the input A of the comparator 600 and the data input of the temporary memory circuit 602. The key-on signal KON from the circuit 578 is directed into one of the three inputs of an AND gate 606.

Intended for temporary storage of a data set indicative of the lowest depressed upper key at every moment, the temporary memory circuit 602 delivers its output to the input B of the comparator 600. The comparator 600 impresses a ONE output to one of the other two inputs of the AND gate 606 when $A<B$, i.e., when each incoming set of upper-key data UKKC represents a lower note than that represented by the output data set from the temporary memory ciruit 602. The remaining one input of the three-input AND gate 606 receives the timing signal UKH2, FIG. 17, which is in a ONE state during every second series of time-divisional channels 1 through 7. The AND gate 606 supplies its output to the storage control input L of the temporary memory ciruit 602.

Thus, in coaction with the temporary memory circuit 602, the comparator 600 successively compares the incoming sets of channeled upper-key data UKKC during each ONE state of the timing signal UKH2, causing the temporary memory circuit to store any data set that represents a lower note. Consequently the data set stored in the temporary memory circuit 602 upon completion of data comparisons for one sequence of channels 1 through 7 represents the true lowest of the notes supplied during that channel sequence. Such data are termed the lowest-depressed-upper-key data and labeled UKKCL.

Applied to the preset input PS of the temporary memory circuit 602 is the output from an AND gate 608, to which are input the timing signals UKH1 and YU7, FIG. 17. When the ONE states of these timing signals UKH1 and YU7 overlap, i.e., during the last channel 7 of each sequence of channels during which the timing signal UKH1 is ONE, the AND gate 608 presets ONEs in all the storage locations of the temporary memory circuit 602. This is necessary to maximize the data set stored in the temporary memory circuit 602 prior to each series of data comparisons to be performed thereby during the ONE state of the timing signal UKH2.

The lowest-note detector circuit 592 further includes an AND gate 610 to which are input the timing signals UKH1 and YU1. The output from this AND gate 610 enters the strobe input S of the latch circuit 604 receiving the output from the temporary memory circuit 602. The AND gate 610 produces a ONE output when the ONE states of its two input signals UKH1 and YU1 overlap, namely during the first channel 1 immediately following each series of data comparisons by the comparator 600. In response to this ONE output from the AND gate 610 the latch circuit 604 latches the set of lowest-depressed-upper-key data UKKCL delivered from the temporary memory circuit 602. The latch circuit 604 continuously puts out the thus-obtained set of lowest-depressed-upper-key data UKKCL, until the appearance of the next strobe pulse. FIG. 17 is also explanatory of the timing for presetting the temporary memory circuit 602, for comparing data in the comparator 600, and for latching the data UKKCL in the latch circuit 604.

A comparison of FIG. 18 with FIG. 13 will prove that the fill-note data forming circuit 594 is essentially identical in configuration with the combination of the LK/UK data converter circuit 396 and LK/UK data conversion inhibit circuit 398 in the preceding embodiment.

By way of confirmation of this similarity it may well be mentioned that the fill-note data forming circuit 594 comprises: a subtractor 420*a* for creation of octave-coded data indicative of an octave just below the one to which the lowest depressed upper key belongs; a selector 422*a;* a comparator circuit 424*a* for comparison of the note-coded data of the lowest pressed upper key and the note-coded data of each depressed lower key; a comparator circuit 428*a* for preventing the production of a fill note bearing the same name as the note of the lowest depressed upper key; a comparator circuit 430*a* for preventing the production of a fill note that is a semi-tone below the lowest pressed upper key; a comparator circuit 432*a* for preventing the production of a fill note that is a whole-tone below the lowest depressed upper key; a semi-tone up circuit 434*a* for converting each incoming set of lower-key note data N1L–N4L into that indicative of a note which is a semi-tone above; a whole-tone up circuit 436*a* for converting each incoming set of lower-key note data N1L–N4L into that indicative of a note whole-tone above; a NOR gate 438*a* for the production of an enable signal ENB'; and a gate 426*a* for blocking the passage of the undesired fill-note data in response to the enable signal ENB'.

All the above enumerated components of the fill-note data forming circuit 594 have their corresponding parts in the circuits 396 and 398 of FIG. 13. Such components have therefore been identified by suffixing the letter a to the numerals used to designate the corresponding parts of FIG. 13.

It will be also seen that an AND gate 418*a* in the fill-note data forming circuit 594 puts out an all-upper-key-off signal UKOFF' in response to the lowest-depressed-upper-key data UKKCL from the lowest-note detector circuit 592. Thus, if each incoming set of lower-key note data N1L–N4L represents a note name below that represented by the note-coded portion N1–N4 of the lowest-depressed-upper-key data UKKCL, the fill-note data forming circuit 594 adds the octave-coded portion B1–B3 of the data UKKCL to the note data N1L–N4L, thereby creating a set of key-coded fill-note data FLKC.

If, on the other hand, an incoming set of lower-key note data N1L–N4L represents a note name above that of the lowest depressed upper key, then the circuit 594 combines the note data N1L–N4L with a set of octave-coded data indicative of an octave just below that of the lowest depressed upper key. The thus-formed set of key-coded fill-note data FLKC also represents a fill note within an octave below the lowest depressed upper key. Provision is also made in the fill-note data forming circuit 594 for inhibiting the production of fill notes that are either the same as, or a semi-tone or a whole-tone below, the note of the lowest depressed upper key.

Allowed to pass the gate 426*a,* the proper fill-note data FLKC enter the fill-tone generator circuit 570, FIG. 16, thereby to be translated into the fill-tone signals. The fill-note data forming circuit 594 additionally includes an OR gate 612 also receiving the output from the AND gate 426*a.* When any set of fill-note data FLKC emerges from the gate 426*a,* the output from the OR gate 612 becomes ONE. This output from the OR gate 612 serves as the key-on signal KON for delivery to the fill-tone generator circuit 570.

FOURTH FORM

Although key-coded fill-note data are formed after the channeling of key data in all the foregoing embodiments, such data can also be generated prior to channeling operation within the scope of this invention. The arrangement of FIG. 19 embodies this alternative concept, by incorporating a fill-note data channeling circuit 620 immediately upstream of a fill-tone generator circuit 570*a.*

Figure 19:
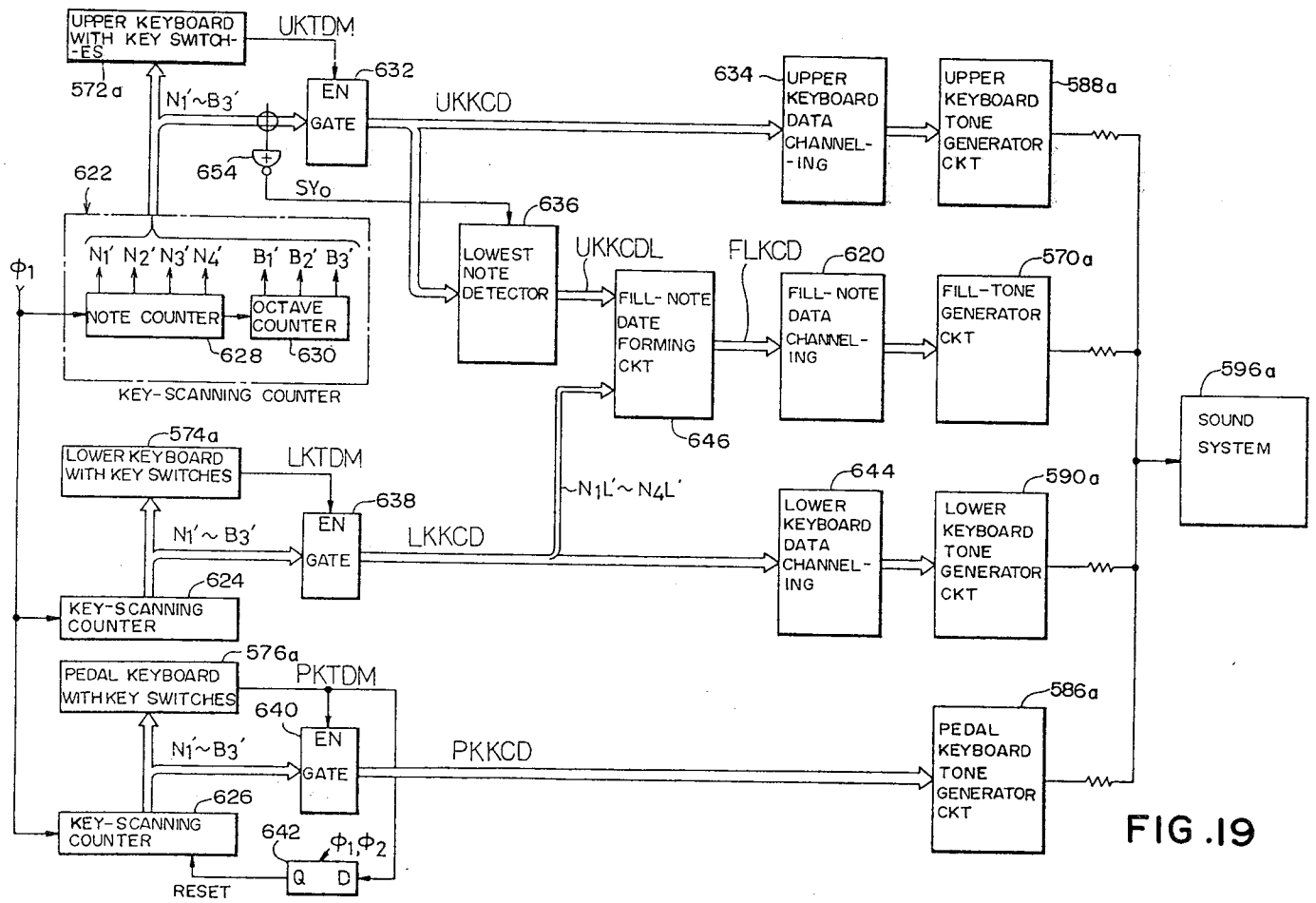
FIG. 19 is a block diagram of still another preferred form of the electronic musical instrument in accordance with the invention.

The electronic musical instrument of FIG. 19 also comprises an upper keyboard with its key switches 572*a,* a lower keyboard with its key switches 574*a,* and a pedal keyboard with its key switches 576*a.* Associated with the respective circuits of these upper, lower and pedal key switches 572*a,* 574*a* and 576*a* are key-scanning counters 622, 624 and 626. All these counters 622, 624 and 626 can be of identical make, so that only the counter 622 for the upper key switches 572*a* will be described in detail, it being understood that the same description applies to the other counters 624 and 626.

The representative key-scanning counter 622 comprises a note counter 628 in the form of a modulo-12, 4-bit binary counter, and an octave counter 630 in the form of a 3-bit binary counter. Counting the input master clock pulses $\phi$1, the note counter 628 puts out 12 different sets of note-coded data N1', N2', N3' and N4', from "0001" to "1100". The note counter 628 generates a carry pulse each time it counts up to 12. The octave counter 630 counts the carry pulses and produces the 3-bit octave-coded data B1', B2' and B3'. The output note-coded data N1'–N4' from the key-scanning counter 622 are used for scanning the note lines or rows of the arrayed upper-key switches 572*a*, whereas the octave-coded data B1'–B3' from the octave counter 630 are used for scanning the octave lines or columns of the arrayed upper-key switches.

As a result of such scanning, the circuit of upper-key switches 572*a* puts out a multiplex, time-divisional upper-key-on signal UKTDM, such that the individual upper keys correspond to the successive time slots, with a ONE pulse appearing at any time slot representative of a pressed key. The upper-key-on signal UKTDM enters the enable input EN of a gate 632 for gating the keycoded data N1'–N3' delivered thereto from the key-scanning counter 622. The upper-key-on signal UKTDM of multiplex, time-divisional format is in synchronism with the successive sets of key data N1'–B3', so that the gate 632 allows the passage therethrough of only those sets of key data which correspond to pressed upper keys. The upper-key data UKKCD travel from the gate 632 to a channeling circuit 634 for the upper keyboard on one hand and, on the other hand, a lowest-note detector circuit 636.

It has been mentioned that the key-scanning counters 624 and 626 for the lower and pedal keyboards are identical in configuration with the above described counter 622. The circuits of lower-key switches 574*a* and pedal-key switches 576*a* deliver multiplex, time-divisional lower-key-on signal LKTDM and pedal-key-on signal PKTDM to the enable inputs of gates 638 and 640, respectively. As in the case of the upper keyboard, these signals LKTDM and PKTDM are used for gating the key-coded data N1'–B3' delivered to the gates 638 and 640 from the counters 624 and 626, respectively. The gates 638 and 640 put out the lower-key data UKKCD and pedal-key data PKKCD.

Since the pedal keyboard has a single sounding channel, the pedal-key-on signal PKTDM is further directed into a delay flip-flop 642. After being delayed by 1 μs in this delay flip-flop, the signal PKTDM enters the reset input of the key-scanning counter 626. Consequently, when the pedal-key-on signal PKTDM becomes ONE for the first time during each scanning cycle, the corresponding output from the delay flip-flop 642 resets the key-scanning counter 626 thereby preventing the same from the production of any further ONE output during that scanning cycle.

Representing only one depressed pedal key during each scanning cycle, the pedal-key data PKKCD issuing from the gate 640 enter the tone generator circuit 586*a* for the pedal keyboard, thereby to be converted into a pedal tone signal. The lower-key data LKKCD from the gate 638 travel to a channeling circuit 644 for the lower keyboard.

The channeling circuits 634 and 644 for the upper and lower keyboards are intended to assign the incoming sets of upper-key data UKKCD and lower-key data LKKCD to the seven sounding channels in the tone generator circuit 588*a* and to the seven sounding channels in the tone generator circuit 590*a*. The sets of upper-key data UKKCD and lower-key data LKKCD enter the channeling circuits 634 and 644, respectively, in step with the corresponding time slots as the counters 622 and 624 repeatedly scan the upper and lower key switches 572*a* and 574*a* in the above described manner.

For further details about the configuration and operation of the channeling circuits 634 and 644, reference is directed to N. Tomisawa et al. U.S. Pat. No. 3,844,379, "Electronic Musical Instrument with Key Coding in a Key Address Memory", dated Oct. 29, 1974, and assigned to the assignee of this application. The fill-note data channeling circuit 620 can be of similar design.

On issuing from the channeling circuits 634 and 644 the channeled upper and lower key data UKKCD and LKKCD enter the tone generator circuits 588*a* and 590*a*, respectively, for translation into tone signals. These tone signals are subsequently transformed into audible sounds by the audio output system 596*a*.

The upper-key data UKKCD from the gate 632 are further introduced into the lowest-note detector circuit 636, as has been stated, for the detection of the lowest of upper keys played together. The detector circuit 636 delivers the key-coded lowest-depressed-upper-key data UKKCDL to a fill-note data forming circuit 646. Also fed to this circuit 646, from the gate 638, are the note-coded data N1L'–N4L' included in the lower-key data LKKCD. The forming circuit 646 combines each incoming set of note-coded data N1L'–N4L' with an appropriate set of octave-coded data so that the resulting fill note may fall within an octave below the lowest depressed upper key at the moment. The key-coded fill-note data thus created by the forming circuit 646 are designated FLKCD.

Figure 20:
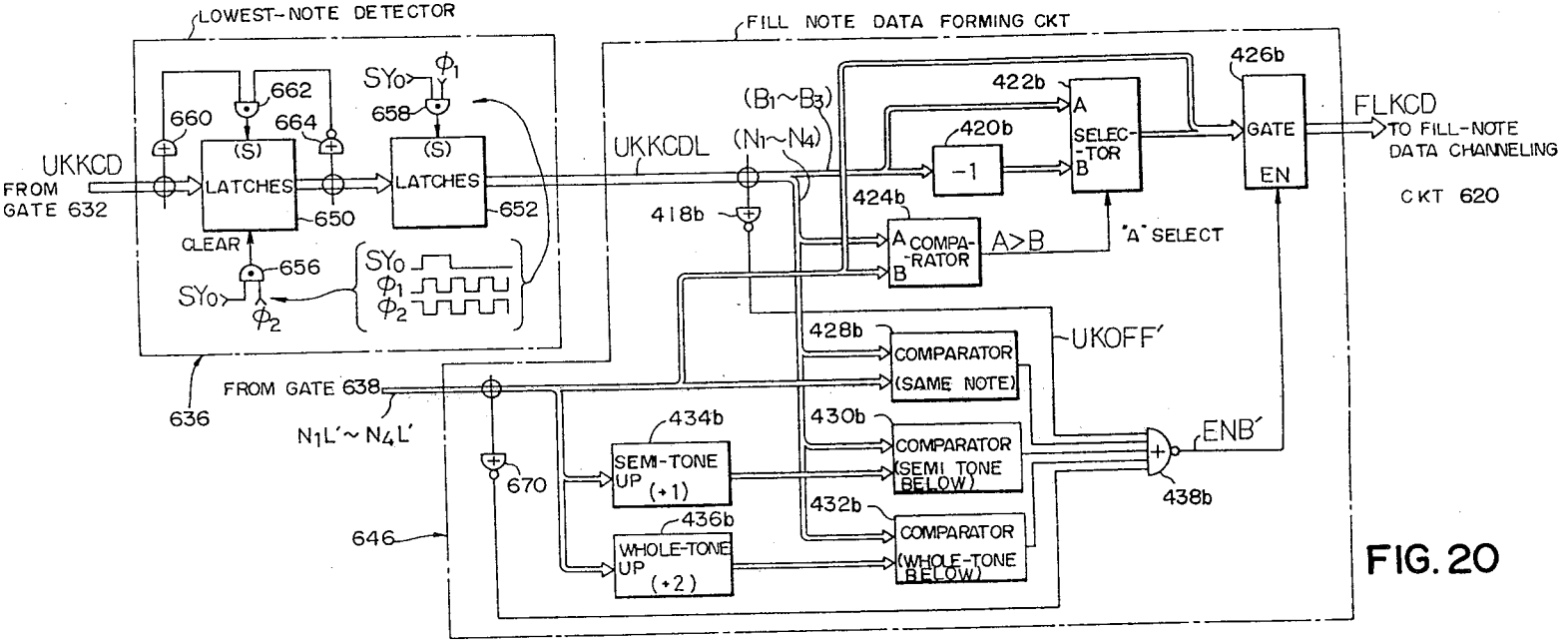
FIG. 20 is a partly block and partly schematic diagram showing in greater detail the lowest-note detector circuit and fill-note data forming circuit in the instrument of FIG. 19.

As shown in detail in FIG. 20, the lowest-note detector circuit 636 comprises first and second latch circuits 650 and 652. The first latch circuit 650 latches the first incoming set of upper-key data UKKCD during each key scanning cycle. The second latch circuit 652 latches the output data from the first latch circuit 650 and transforms them into D.C. format. Since the key-scanning counter 622 scans the upper-key switches 572*a* in the order of ascending pitches, the set of data UKKCD which comes in first during each scanning cycle represents the lowest depressed upper key.

With reference back to FIG. 19 a NOR gate is provided at 654 for receiving all the bits N1'–B3' of the data output from the key-scanning counter 622. The NOR gate 654 puts out a pulse SYo when all its inputs are ZERO, i.e., at a time immediately preceding each scanning cycle.

In the lowest-note detector circuit 636 of FIG. 20, the output pulse SYo from the NOR gate 654 enters a two-input AND gate 656 coupled to the reset input of the first latch circuit 650, and another two-input AND gate 658 coupled to the strobe input S of the second latch circuit 652. Thus, immediately before the start of each scanning cycle, the pulse SYo causes the AND gate 656 to clear the first latch circuit 650, and the second latch circuit 652 is also caused to take in the output data from the first latch circuit.

The other input of the AND gate 656 receives the pulse train $\phi 2$ having a phase lag of 180 degrees with respect to the master clock pulse train $\phi$. The AND gate 656 clears the first latch circuit 650 upon simultaneous receipt of the pulses SYo and $\phi 2$. The other input of the other AND gate 658 receives the clock pulse train $\phi 1$. It will be noted that the duration of each pulse SYo, which is equal to one time slot, is twice that of each clock pulse $\phi 1$ or $\phi 2$. Thus, during the first half of each pulse SYo, the output data from the first latch circuit 650 are introduced into the second latch circuit 652. The first latch circuit 650 is cleared during the second half of the pulse SYo.

The upper-key data UKKCD from the gate 632 enter not only the data input of the first latch circuit 650 but also an OR gate 660. The output from this OR gate 660 enters one of the two inputs of an AND gate 662, which delivers its output to the strobe input S of the first latch circuit 650. The data output from the first latch circuit 650 enter both the second latch circuit 652 and a NOR gate 664, the latter applying its output to the other input of the AND gate 662.

As may now be apparent, the AND gate 662 is enabled when the output from the first latch circuit 650 is all ZEROs, i.e., when the first latch circuit has no data latched therein after having been cleared preparatory to each scanning cycle. The OR gate 660 delivers a ONE output to the AND gate 662 on receipt of the first set of upper-key data UKKCD, which of course represents the lowest depressed upper key, during the subsequent cycle of key scanning operation. The corresponding output from the AND gate 662 causes the first latch circuit 650 to latch the first incoming set of upper-key data UKKCD. Thereupon the output from the NOR gate 664 becomes ZERO, so that the first latch circuit 650 is nonresponsive to the subsequent sets of upper-key data UKKCD during the same key scanning cycle.

The second latch circuit 652 accepts as foresaid the set of lowest-depressed-upper-key data from the first latch circuit 650 prior to each scanning cycle. The second latch circuit continues the production of this set of lowest-depressed-upper-key data UKKCDL until it latches the next set of such data.

In FIG. 20 is also shown the fill-note data forming circuit 646. Analogues in configuration with the circuit 594 of FIG. 18, the forming circuit 646 comprises a substracter **420*b*, selector 422*b*, comparator circuits 424*b*, 428*b*, 430*b*, 432*b*, gate 426*b*, and NOR gate 438*b*. These components of the circuit 646 function just like their counterparts, identified by like reference characters, in the circuit of FIG. 18**.

The fill-note data forming circuit 646 further includes a NOR gate **418*b* for providing an all-upper-key-off signal UKOFF' in response to the lowest-depressed-upper-key data UKKCDL from the lowest-note detector circuit 636. This NOR gate 418*b* is employed in lieu of the AND gate 418*a* in the circuit 594 of FIG. 18 because the first latch circuit 650 in the detector circuit 636 is cleared prior to each key scanning cycle. Shown at 670 is a NOR gate to which are input the lower-key note data N1L'–N4L'. The function of this NOR gate 670 is the same as that of the inverter 440 in the LK/UK data conversion inhibit circuit 398 of FIG. 13**, namely, the detection of no key depression on the lower keyboard.

Also included in the fill-note data forming circuit 646 is a semi-tone up circuit **434*b* for alteration of each incoming set of lower-key note data N1L'–N4L' into that representative of a note semi-tone above, and a whole-tone up circuit 436*b* for conversion of each incoming lower-key note data set into that indicative of a note whole-tone above. The semi-tone up circuit 434*b* always adds one to each incoming data set, and the whole-tone up circuit 436*b* always adds two to each incoming data set. This is because, in the embodiment of FIG. 19, the successive sets of note-coded data vary incrementally from "0001" up to "1100" owing to the continuous counting of the note counter 628. It is therefore unnecessary for the semi-tone up and the whole-tone up circuits 434*b* and 436*b* to add one or two, and two or three, unlike the up circuits 434 and 436 of FIG. 13 or 434*a* and 436*a* of FIG. 18**.

Such being the organization of the fill-note data forming circuit 646, it provides the desired key-coded fill-note data FLKCD. Put out successively with the progress of the repeated scanning of the key switches, the sets of fill-note data FLKCD are assigned to appropriate sounding channels by the succeeding channeling circuit 620 exclusively for such fill-note data. Connected next to the channeling circuit 620, the filltone generator circuit **570*a* generates fill-tone signals on receipt of the channeled fill-note data. The sounding system 596*a*** translates the fill-tone signals into audible sounds.

Figure 21:
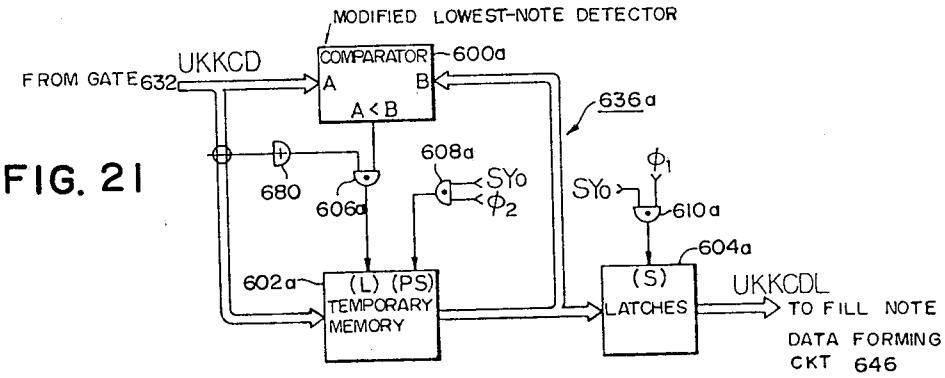
FIG. 21 is a partly block and partly schematic diagram of a modification of the lowest-note detector circuit of FIG. 20.

Given in FIG. 21 is a block diagram of an alternative lowest-note detector circuit **636*a* for use in place of the circuit 636 in the electronic musical instrument of FIGS. 19 and 20. The modified lowest-note detector circuit 636*a* is similar in configuration to the lowest-note detector circuit 592 of FIG. 18. The circuit 636*a* comprises a comparator 600*a*, temporary memory circuit 602*a*, latch circuit 604*a*, and AND gates 606*a*, 608*a* and 610*a*, all of which function like their corresponding parts in the circuit 592 of FIG. 18**.

Input to the AND gate **608*a*, however, are the pulses SYo and $\phi 2$, and the pulses SYo and $\phi 1$ are input to the AND gate 610*a*. All these pulses SYo, $\phi 1$ and $\phi 2$ have been explained in conjunction with the lowest-note detector circuit 636 of FIG. 20. The reasons for the inputting of such pulses to the AND gates 608*a* and 610*a* will also be self-evident upon reconsideration of the AND gates 656 and 658 in the circuit 636 of FIG. 20. An OR gate is provided at 680 for inputting an upper-key-on signal to the AND gate 606*a*** in response to the upper-key data UKKCD.

In the modified lowest-note detector circuit **636*a* the temporary memory circuit 602*a* is preset with all ONEs by the output from the AND gate 608*a* prior to each cycle of key scaning operation. Therefore, when this circuit 636*a* is used in combination with the fill-note data forming circuit 646 of FIG. 20, and AND gate must be substituted for the NOR gate 418*a*, in the circuit 646**, for the production of the all-upper-key-off signal UKOFF'.

Possible Modifications

Although the present invention has been shown and described hereinabove in terms of some preferable embodiments thereof, it is understood that such embodiments are by way of example only and are not to impose limitations upon the invention. The following is a list of some of the possible variations, modifications and adaptations that are intended to be embraced within the scope of the invention.

In all the embodiments disclosed herein the key-coded fill-note data have been formed from the data representative of lower keys being actually depressed. This invention permits, however, the formation of fill notes from key-coded data that are generated automatically and which, for convenience, are assumed to represent lower keys, even though such keys have not been, or are not being, depressed. Such automatically generated data include those put out by the key coder 26, FIG. 1, during AUTO BASS/CHORD performance in the SINGLE FINGER mode, and those which continue to be produced even after the release of keys during performance in the MEMORY mode.

It will also be understood that the keyboards for use in the creation of fill-note data are not limited to the upper and lower keyboards, as in the foregoing embodiments, but include solo, pedal, or any other keyboards available. Further the invention finds application to electronic musical instruments of the type wherein a single keyboard is divided into at least two sections each associated with a different tone color. A familiar example of such instruments has its single bank of keys grouped into a high or melody section and a low or accompaniment section, both having their own distinctive tone colors. In this type of instrument, fill-note data may be formed by detecting the successive lowest depressed upper keys in the higher group of keys and by changing the octave-coded data of depressed keys in the lower key group so that the resulting notes may fall within an octave below the lowest depressed upper keys in the higher key group. The actual circuit configuration for carrying this concept into practice can be identical with those disclosed herein, there being differences only between the upper keyboard and the higher key group and between the lower keyboard and the lower key group.

Another operational feature of the foregoing embodiments that should not be taken in a limitative sense is the confinement of each fill note within an octave below the lowest pressed upper key at every moment. Further, although fill tones have been generated in relation to the lowest depressed upper key in the above embodiments, it is also possible to relate fill notes with the highest or intermediate ones of upper keys played together.

In essence, therefore, the present invention advocates the alteration of the octave to which each depressed key on one keyboard or in one key group belongs, in such a way that the resultantly obtained fill note may be within a predetermined interval away (either below or above) from a representative one (either lowest, highest, or intermediate) of the notes of pressed keys on another keyboard or in another key group.

Still further, if desired, fill-note data may be obtained simply by combining the note-coded data of pressed keys on one keyboard or in one key group with the octave-coded data of the representative ones of depressed keys on another keyboard or in another key group. Additional modifications of the invention include the omission of the lowest-note detector circuit, in cases where the upper keyboard or some equivalent keyboard or key group is monophonic.

It will also be appreciated that the present invention employs digital circuitry for providing fill-note data, by digitally processing key-coded data representative of keys on two keyboards or in two key groups. Such digital data processing enables the instrument to incorporate a myriad of additional features or refinements without any substantial modification of the existing parts. An example of such additional features is, as disclosed herein, the inhibition of fill notes having some undesired total relations with the notes of pressed upper keys. Further, in order o variably shift the octave of each fill tone to be generated, an adder/subtracter combination capable of adding or subtracting variable numbers may be provided, for example, on the input side of the selector 238 in the fill-note data forming circuit 70 of FIG. 4.

The foregoing will have made clear that the invention as disclosed herein is well calculated to attain the advantageous effects set forth earlier in this specification. It will also have been understood that a variety of modifications and changes are possible to add to the utility of the electronic musical instrument or to conform to its design requirements or preferences, without departing from the scope of this invention.

What is claimed is:

1. An electronic musical instrument comprising:

(a) first and second keyboard means respectively including keys corresponding to musical notes;

(b) key data generating means responsive to the depressing of the keys on the first and second keyboard means for generating key data indentifying the individual keys in accordance with a prescribed key code, the key code resolving itself into a note code for representation of the note name of each key and an octave code for representation of the octave to which the key belongs, so that each set of key-coded key data, representative of a single key, is composed of note-coded data and octave-coded data, the key data comprising first key data indicative of the keys of the first keyboard means and second key data indicative of the keys of the second keyboard means;

(c) fill-note data forming means for creating key-coded fill-note data by combining octave-coded data which are in predetermined octaval relation with the octave-coded data included in the first key data, with the note-coded data included in the second key data; and (d) tone generator means for generating fill tones in response to the key-coded fill-note data.

2. An instrument as defined in claim 1, wherein the fill-note data forming means comprises:

(a) means for comparing the note-coded data included in the first key data and the note-coded data included in the second key data as to the pitches of the note names represented by the note-coded data;

(b) means for providing octave-coded data indicative of an octave neighboring the one represented by the octave-coded data included in the first key data; and (c) means for selecting either of the octave-coded data derived from the first key data and the octave-coded data indicative of the neighboring octave, as dictated by the output from the comparing means;

(d) the selected octave-coded data being combined with the note-coded data in the second key data to provide the key-coded fill-note data.

3. An instrument as defined in claim 1, further comprising means for detecting a representative one from among a plurality of sets of first key data corresponding to keys played together, and wherein the fill-note data forming means creates the key-coded fill-note data by combining the octave-coded data derived from the representative set of first key data with the note-coded data included in the second key data.

4. An instrument as defined in claim 3, wherein the representative set of first key data corresponds to the lowest of the notes represented by the plurality of sets of first key data.

5. An instrument as defined in claim 3, wherein the fill-note data forming means comprises:

(a) means for coming the note-coded data included in each representative set of first key data and the note-coded data included in each corresponding set of second key data as to the pitches of the note names represented by the note-coded data;

(b) means for providing octave-coded data indicative of an octave neighboring the one represented by the octave-coded data derived from the representative set of first key data; and (c) means responsive to the output from the comparing means for selecting either of the octave-coded data derived from the representative set of first key data and the octave-coded data indicative of the neighboring octave;

(d) the selected octave-coded data being combined with the note-coded data in the second key data to provide the key-coded fill-note data.

6. An instrument as defined in claim 5, wherein:

(a) the representative set of first key data corresponds to the lowest of the notes represented by the plurality of sets of first key data;

(b) the providing means provides octave-coded data indicative of an octave just below the one represented by the octave-coded data in the representative set of first key data;

(c) the selecting means selects the octave-coded data indicative of the octave just below the one represented by the octave-coded data in the representative set of first key data when the note-coded data in the representative set of first key data represent a note name lower than the note name represented by the note-coded data in the corresponding set of second key data; and (d) the selecting means selects the octave-coded data in the representative set of first key data when the note-coded data in the representative set of first key data represent a note name higher than the note name represented by the note-coded data in the corresponding set of second key data;

(e) whereby the resulting fill notes invariably fall within an octave below the note of the representative set of first key data.

7. An instrument as defined in claim 3, 4, 5 or 6, further comprising means for inhibiting the production of fill notes having predetermined pitch relationship to the note of the representative set of first key data.

8. An instrument as defined in claim 7, wherein the inhibiting means inhibit the production of fill notes that are either the same as, or a semi-tone or a whole-tone apart from, the note of the representative set of first key data.

9. An electronic musical instrument comprising:

(a) first and second keyboard means respectively including keys corresponding to musical notes;

(b) key data generating means responsive to the depressing of the keys on the first and the second keyboard means for generating key data identifying the individual keys in accordance with a prescribed key code, the key code resolving itself into a note code for identifying the note name of each key and an octave code for identifying the octave to which the key belongs, so that each set of key-coded key data, representative of a single key, is composed on note-coded data and octave-coded data, the key data comprising first key data indicative of the keys of the first keyboard means and second key data indicative of the keys of the second keyboard means;

(c) fill-note data forming means for creating key-coded fill-note data by combining octave-coded data which are in predetermined octaval relationship with the octave-coded data included in the first key data, with the note-coded data included in the second key data;

(d) tone generator means having a plurality of sounding channels; and (e) means for assigning the key data and the fill-note data to appropriate ones of the sounding channels in the tone generator means.

10. An instrument as defined in claim 9, wherein:

(a) the sounding channels in the tone generator means are divided into a first group for the first keyboard means and a second group for the second keyboard means; and (b) the fill-note data are assigned to the first group of sounding channels by the assigning means.

11. An instrument as defined in claim 10, wherein the tone generator means further comprises:

(a) a first tone color circuit for imparting a first tone color to all the tones generated through the first group of sounding channels; and (b) a second tone color circuit for imparting a second tone color to all the tones generated through the second group of sounding channels.

12. An instrument as defined in claim 10, wherein the assigning means comprises:

(a) a channeling circuit for assigning the first key data to first recurrent series of time-divisional channels corresponding respectively to the first group of sounding channels in the tone generator means and for assigning the second key data to second recurrent series of time-divisional channels corresponding respectively to the second group of sounding channels in the tone generator means;

(b) a data memory for storing and putting out the first key data and the fill-note data;

(c) controls means for controlling the storage of the first key data and the fill-note data in the data memory; and (d) selector means for delivering to the tone generator means the first key data and the fill-note data from the data memory during the first recurrent series of time-divisional channels and for delivering to the tone generator means the second key data from the channeling circuit during the second recurrent series of time-divisional channels.

13. An instrument as defined in claim 12, wherein the control means comprises;

(a) means for detecting whether or not each set of fill-note data being fed to the data memory represents a note name already stored therein; and (b) means for preventing the storage in the data memory of any fill-note data set representing a note name already stored therein.

14. An instrument as defined in claim 12, further comprising:

(a) means for detecting a representative one from among a plurality of sets of first key data when such data sets are assigned to any one of the first recurrent series of time-divisional channels;

(b) the fill-note data forming means creating the key-coded fill-note data by combining the octave-coded data derived from each representative set of first key data with the note-coded data included in the second key data.

15. An instrument as defined in claim 14, wherein the control means further comprises:

(a) means for detecting a change from one representative set of first key data to another; and (b) means for causing the data memory to delete all the fill-note data stored therein in the event of a change from one representative set of first key data to another.

16. An instrument as defined in claim 10, wherein the assigning means comprises:

(a) a channeling circuit for assigning the first key data to first recurrent series of time-divisional channels corresponding respectively to the first group of sounding channels in the tone generator means and for assigning the second key data to second recurrent series of time-divisional channels corresponding respectively to the second group of sounding channels in the tone generator means;

(b) a rechanneling circuit for re-assigning the first key data and fill-note data to the first recurrent series of time-divisional channels; and (c) selector means for delivering to the tone generator means the first key data and fill-note data from the rechanneling circuit during the first recurrent series of time-divisional channels and for delivering to the tone generator means the second key data from the channeling circuit during the second recurrent series of time-divisional channels.

17. An electronic musical instrument comprising:

(a) first and second keyboard means respectively including keys corresponding to musical notes;

(b) first key data generating means responsive to the depressing of keys on the first keyboard means for generating first sets of key data identifying the individual keys of the first keyboard means in accordance with a prescribed key code, the key code resolving itself into a note code for identifying the note name of each key and an octave code for identifying the octave to which the key belongs, so that each set of key-coded key data, representative of a single key, is composed of note-coded data and octave-coded data;

(c) the first key data generating means including means for putting out the first sets of key data as assigned to recurrent series of time-divisional channels;

(d) a first tone generator circuit having a plurality of sounding channels, corresponding to each series of time-divisional channels, for translating the first sets of key data into tone signals;

(e) second key data generating means responsive to the depressing of keys on the second keyboard means for generating second sets of key data identifying the individual keys of the second keyboard means in accordance with the key code;

(f) the second key data generating means including means for putting out the second sets of key data as assigned to the recurrent series of time-divisional channels;

(g) a second tone generator circuit having a plurality of sounding channels, corresponding to each series of time-divisional channels, for translating the second sets of key data into tone signals;

(h) means for detecting a representative one from among a plurality of first sets of key data when such data sets are assigned to any one of the recurrent series of time-divisional channels;

(i) fill-note data synthesizing means for creating key-coded fill-note data by combining octave-coded data derived from each representative first set of key data with the note-coded data included in each second set of key data assigned to the same series of time-divisional channels; and (j) a third tone generator circuit having a plurality of sounding channels, corresponding to each series of time-divisional channels, for translating the fill-note data into tone signals.

18. An electronic musical instrument comprising:

(a) first and second keyboard means respectively including keys corresponding to musical notes;

(b) first key data generating means responsive to the depressing of keys on the first keyboard means for generating first sets of key data identifying the individual keys of the first keyboard means in accordance with a prescribed key code, the key code resolving itself into a note code for identifying the note name of each key and an octave code for identifying the octave to which the key belongs, so that each set of key-coded key data, representative of a single key, is composed of note-coded data and octave-coded data;

(c) a first tone generator circuit having a plurality of sounding channels for translating the first sets of key data into tone signals;

(d) a first channeling circuit for assigning the first sets of key data to appropriate ones of the sounding channels in the first tone generator circuit;

(e) second key data generating means responsive to the depressing of keys on the second keyboard means for generating second sets of key data identifying the individual keys of the second keyboard means in accordance with the key code;

(f) a second tone generator circuit having a plurality of sounding channels for translating the second sets of key data into tone signals;

(g) a second channeling circuit for assigning the second sets of key data to appropriate ones of the sounding channels in the second tone generator circuit;

(h) means for detecting a representative one from among a plurality of first sets of key data when such data sets are generated during each unit length of time;

(i) fill-note data forming means for creating key-coded fill-note data by combining octave-coded data derived from each representative first set of key data with the note-coded data included in each second set of key data generated during the same unit length of time;

(j) a third tone generator circuit having a plurality of sounding channels for translating the fill-note data into tone signals; and (k) a third channeling circuit for assigning the sets of fill-note data to appropriate ones of the sounding channels in the third tone generator circuit.

19. An instrument as defined in claim 17 or 18, wherein the fill-note data forming means comprises:

(a) comparator means for comparing the note names represented by the note-coded data included in each representative first set of key data and in each corresponding second set of key data;

(b) means for providing octave-coded data indicative of an octave neighboring the one represented by the octave-coded data included in each representative first set of key data; and (c) selector means responsive to the output from the comparator means for selecting either of the octave-coded data derived from each representative first set of key data and the octave-coded data indicative of the neighboring octave;

(d) the fill-note data forming means combining the selected octave-coded data with the note-coded data derived from the second key data to provide the key-coded fill-note data.

20. An instrument as defined in claim 17 or 18, wherein the fill-note data forming means further comprises means for inhibiting the production of fill-note data representative of notes having predetermined pitch relationship to the notes of the representative first sets of key data.

* * * * *